US012564755B2

(12) United States Patent
Keiser

(10) Patent No.: US 12,564,755 B2
(45) Date of Patent: Mar. 3, 2026

(54) EXERCISE APPARATUS WITH ROTATABLE CAM

(71) Applicant: Keiser Corporation, Fresno, CA (US)

(72) Inventor: Dennis L. Keiser, Sanger, CA (US)

(73) Assignee: Keiser Corporation, Fresno, CA (US)

( * ) Notice: Subject to any disclaimer, the term of this patent is extended or adjusted under 35 U.S.C. 154(b) by 173 days.

(21) Appl. No.: 18/655,039

(22) Filed: May 3, 2024

(65) Prior Publication Data

US 2024/0366990 A1 Nov. 7, 2024

Related U.S. Application Data

(60) Provisional application No. 63/500,564, filed on May 5, 2023.

(51) Int. Cl.
*A63B 21/00* (2006.01)

(52) U.S. Cl.
CPC ..... *A63B 21/155* (2013.01); *A63B 21/4033* (2015.10)

(58) Field of Classification Search
CPC ... A63B 21/153; A63B 21/154; A63B 21/155; A63B 21/156; A63B 21/4033; A63B 21/4035
See application file for complete search history.

(56) References Cited

U.S. PATENT DOCUMENTS 4,194,751 A 3/1980 Shinmura
5,102,121 A * 4/1992 Solow ..... A63B 21/0628 482/137
5,310,394 A * 5/1994 Kallios ..... A63B 21/00181 482/93
5,722,921 A * 3/1998 Simonson ..... A63B 21/4033 482/137
5,776,040 A 7/1998 Webb et al.
7,083,554 B1 * 8/2006 Lo Presti ..... A63B 23/0482 482/142
7,172,538 B2 * 2/2007 Keiser ..... A63B 21/00069 482/907
7,396,319 B1 * 7/2008 Ellis ..... A63B 23/0488 482/136
10,478,659 B2 * 11/2019 O'Connor ..... A63B 21/159
(Continued)

FOREIGN PATENT DOCUMENTS

CN 115414638 A 12/2022
WO WO 2012/108858 A1 8/2012
WO WO-2018165226 A1 * 9/2018 ..... A63B 23/0494

OTHER PUBLICATIONS

International Search Report and Written Opinion in International Application No. PCT/US2024/027635, mailed on Oct. 14, 2024, in 21 pages.

*Primary Examiner* — Zachary T Moore
(74) *Attorney, Agent, or Firm* — KNOBBE, MARTENS, OLSON & BEAR, LLP

(57) ABSTRACT

A coupling mechanism for an exercise apparatus is disclosed. The coupling mechanism may include a resistance source coupled with a housing, a rod coupled to the resistance source, a clevis coupled to the rod, and a cam rotatably coupled to the clevis about an axis. The cam may include a curved outside surface with a first channel, and a curved inside surface with a second and third channel. The coupling mechanism may also include a cable key coupled to the cam and several cables.

29 Claims, 37 Drawing Sheets

(56) References Cited

U.S. PATENT DOCUMENTS

| | | | | |
|---|---|---|---|---|
| 2003/0092540 | A1* | 5/2003 | Gillen | A63B 21/4047 482/99 |
| 2006/0100069 | A1* | 5/2006 | Dibble | A63B 23/03525 482/100 |
| 2011/0034304 | A1* | 2/2011 | Kuo | A63B 21/0628 482/99 |
| 2021/0186793 | A1* | 6/2021 | Braun | A63B 21/15 |

* cited by examiner

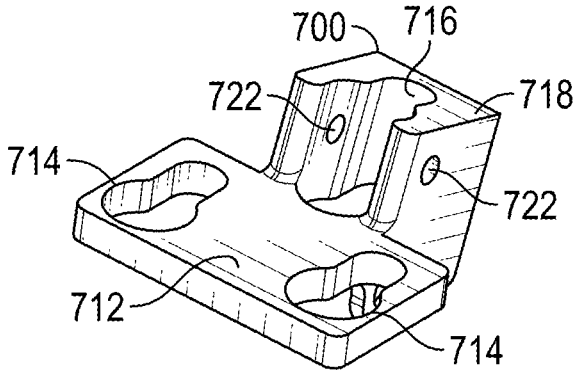
FIG. 14A
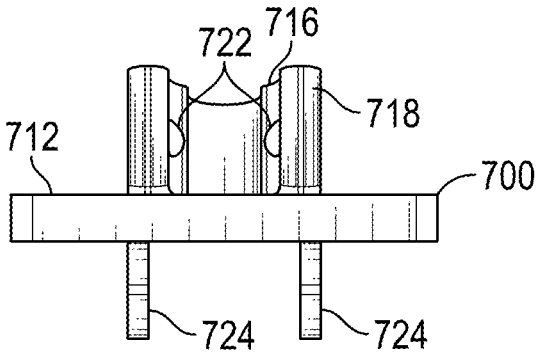
FIG. 14B
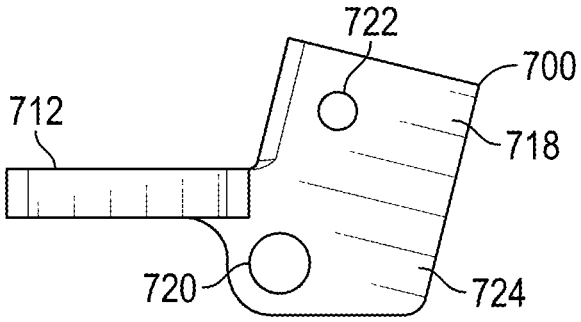
FIG. 14C
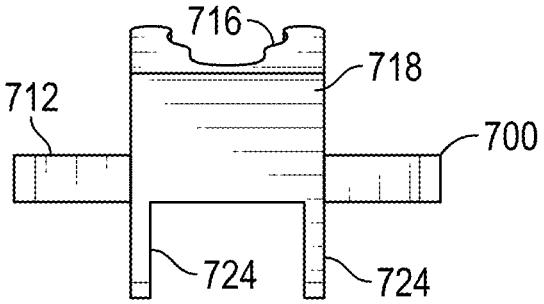
FIG. 14D
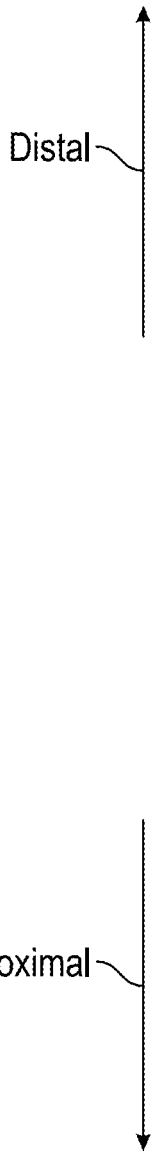

EXERCISE APPARATUS WITH ROTATABLE CAM

REFERENCE TO RELATED APPLICATIONS

This application claims the benefit of U.S. Provisional Application No. 63/500,564, filed May 5, 2023, which is hereby incorporated by reference in its entirety.

BACKGROUND

The present disclosure relates to an exercise apparatus and, more particularly, to an adjustable exercise apparatus that features a rotatable CAM.

SUMMARY

For purposes of summarizing the disclosure and the advantages achieved over the prior art, certain objects and advantages of the disclosure are described herein. Not all such objects or advantages may be achieved in any particular embodiment. Thus, for example, those skilled in the art will recognize that the invention may be embodied or carried out in a manner that achieves or optimizes one advantage or group of advantages as taught herein without necessarily achieving other objects or advantages as may be taught or suggested herein.

In some aspects, the techniques described herein relate to a coupling mechanism for an exercise apparatus, the coupling mechanism including: a resistance source rotatably coupled with a housing; a rod coupled to the resistance source; a clevis coupled to the rod; a cam rotatably coupled to the clevis about an axis, the cam including: a curved outside surface having a first channel; and a curved inside surface having a second channel and a third channel; a first cable, wherein one end of the first cable is coupled to one or more resistance engagements and another end of the cable is connected to the cam; and a second cable and a third cable coupled to the housing on one end and the cam on another end.

In some aspects, the techniques described herein relate to a coupling mechanism, further including a cable key which couples the first, second, and third cables to the cam. In some aspects, the techniques described herein relate to a coupling mechanism, wherein the curved outside surface is larger than the curved inside surface. In some aspects, the techniques described herein relate to a coupling mechanism, wherein a curvature of the curved inside surface and a curvature of the curved outside surface is noncontinuous. In some aspects, the techniques described herein relate to a coupling mechanism, wherein the axis is nonconcentric with the curved inside surface and the curved outside surface. In some aspects, the techniques described herein relate to a coupling mechanism, wherein the axis is positioned off center of the cam. In some aspects, the techniques described herein relate to a coupling mechanism, wherein a distance between the axis of rotation and the curved outside surface is larger than the distance between the axis of rotation and the curved inside surface. In some aspects, the techniques described herein relate to a coupling mechanism, wherein a horizontal distance between the first cable and the second and third cables remains constant as the cam rotates around the axis, rotates about the coupling of the resistance source and housing, and moves toward the resistance source. In some aspects, the techniques described herein relate to a coupling mechanism, wherein the first cable is positioned within the first channel and wrapped around the curved outside surface of the cam when the cam is in a neutral position. In some aspects, the techniques described herein relate to a coupling mechanism, wherein the second cable and the third cable are positioned within the second channel and the third channel, respectively, and wrapped around the curved inside surface of the cam when the cam is in a rotated position. In some aspects, the techniques described herein relate to a coupling mechanism, further including a pulley assembly coupling the first cable to the one or more resistance engagements. In some aspects, the techniques described herein relate to a coupling mechanism, wherein the curved outside surface and first channel pass between the second and third cables as the cam rotates and moves. In some aspects, the techniques described herein relate to a coupling mechanism, wherein a force exerted on the first cable remains constant as the cam rotates and moves. In some aspects, the techniques described herein relate to a coupling mechanism, wherein the cables remain oriented vertically as the cam rotates and moves.

In some aspects, the techniques described herein relate to a cam rotatably attached to a resistance unit of an exercise apparatus, the cam including: a first circular segment including a first cable channel; a second circular segment including a second cable channel and a third cable channel, wherein the second circular segment is positioned opposite the first circular segment; and an aperture positioned such that a distance between a tangent of the first cable channel and a tangent of the second and third cable channels, is constant as the cam rotates from a first position to a second position.

In some aspects, the techniques described herein relate to a cam, wherein the aperture is offset from a center of the cam. In some aspects, the techniques described herein relate to a cam, further including a rectangular cutout between the first circular segment and the second circular segment. In some aspects, the techniques described herein relate to a cam, further including another cutout between the first circular segment and the second circular segment and positioned opposite the rectangular cutout. In some aspects, the techniques described herein relate to a cam, further including a threaded hole which extends through the first circular segment and is positioned adjacent the rectangular cutout. In some aspects, the techniques described herein relate to a cam, wherein the second cable channel and third cable channel are spaced apart. In some aspects, the techniques described herein relate to a cam to, wherein a width of the first circular segment is smaller than a width of the second circular segment. In some aspects, the techniques described herein relate to a cam, wherein the non constant radius of the second circular segment is smaller, on average, than the non constant radius of the first circular segment. In some aspects, the techniques described herein relate to a cam, further including a raised surface surrounding the aperture. In some aspects, the techniques described herein relate to a cam, wherein the cam further moves vertically and horizontally to reach the second position. In some aspects, the techniques described herein relate to a cam, wherein the tangent of the inner surface and the tangent of the outer surface are oriented in the direction of an external force acting on the cam. In some aspects, the techniques described herein relate to a cam, wherein the tangent of the inner surface and the tangent of the outer surface are oriented vertically. In some aspects, the techniques described herein relate to a cam, wherein the tangent of the inner surface and the tangent of the outer surface remain oriented parallel one another. In some aspects, the techniques described herein relate to a cam, wherein a horizontal position of the tangent of the inner surface and the tangent of the outer surface does not change as the cam rotates and moves.

In some aspects, the techniques described herein relate to a method of transmitting force from a resistance unit to a pulley assembly, the method including: applying a force adjacent to an outside surface of a cam; rotating the cam in a first direction about a first axis in response to the force; moving the cam toward the resistance unit in response to the force; rotating the resistance unit about a second axis in a second direction in response to the force; reducing the force applied to the cam; rotating the cam in the second direction about the first axis in response to the reduction in the force; moving the cam away from the resistance unit in response to the reduction in the force; and rotating the resistance unit in a first direction in response to the reduction in force.

In some aspects, the techniques described herein relate to a method, wherein the cam rotates 90 degrees. In some aspects, the techniques described herein relate to a method, wherein the cam rotates greater than 90 degrees and less than 270 degrees. In some aspects, the techniques described herein relate to a method, wherein the cam rotates less than 90 degrees. In some aspects, the techniques described herein relate to a method, wherein the first direction is a clockwise direction. In some aspects, the techniques described herein relate to a method, wherein the second direction is a counter-clockwise direction. In some aspects, the techniques described herein relate to a method, wherein the applied force does not change in direction. In some aspects, the techniques described herein relate to a method, wherein the applied force does not change in magnitude.

In some aspects, the techniques described herein relate to a coupling mechanism for an exercise apparatus, the coupling mechanism including: a resistance source rotatably coupled with a housing; a rod coupled to the resistance source and configured to oscillate in a linear direction; a clevis coupled to the rod; a cam rotatably coupled to the clevis about an axis, the cam including: a curved outside surface; and a curved inside surface positioned opposite the curved outside surface; one or more tension members coupled to the cam and disposed on the curved outside surface, wherein a first portion of the one or more tension members extends away from the cam tangentially adjacent to the curved outside surface, wherein a second portion of the one or more tension members extends away from the cam tangentially adjacent to the curved inside surface; and an anchor attached to the housing and coupled to the second portion of the one or more tension members; and a movable resistance engagement coupled to the first portion of the one or more tension members.

In some aspects, the techniques described herein relate to a coupling mechanism, wherein a curvature of the curved inside surface and a curvature of the curved outside surface is noncontinuous. In some aspects, the techniques described herein relate to a coupling mechanism, wherein the axis is nonconcentric with the curved inside surface and the curved outside surface. In some aspects, the techniques described herein relate to a coupling mechanism, wherein the axis is positioned off center of the cam. In some aspects, the techniques described herein relate to a coupling mechanism, wherein a distance between the axis of rotation and the curved outside surface is larger, on average, than the distance between the axis of rotation and the curved inside surface. In some aspects, the techniques described herein relate to a coupling mechanism, wherein a horizontal distance between the first and second portions of the one or more tension members extending tangentially adjacent from the cam remains constant as the cam rotates around the axis, rotates about the coupling of the resistance source and housing, and moves toward the resistance source. In some aspects, the techniques described herein relate to a coupling mechanism, further including a pulley assembly coupling the first portion of the one or more tension members to the movable resistance engagement. In some aspects, the techniques described herein relate to a coupling mechanism, wherein the one or more tension members includes a first belt or cable. In some aspects, the techniques described herein relate to a coupling mechanism, wherein the first belt is fixed to the cam between the curved inside surface and curved outside surface. In some aspects, the techniques described herein relate to a coupling mechanism, further including a second belt, wherein the first belt is fixed to the cam and a pulley assembly, and wherein the first belt is partially disposed on the curved outside surface of the cam. In some aspects, the techniques described herein relate to a coupling mechanism, wherein the second belt is fixed to the cam and the anchor, and wherein the second belt is partially disposed on the curved inside surface of the cam. In some aspects, the techniques described herein relate to a coupling mechanism, wherein the first and second portions of the one or more tension members are oriented parallel to one another. In some aspects, the techniques described herein relate to a coupling mechanism, wherein the first and second portions of the one or more tension members do not change orientation as the cam rotates and moves. In some aspects, the techniques described herein relate to a coupling mechanism, wherein the first and second portions of the one or more tension members are oriented vertically. In some aspects, the techniques described herein relate to a coupling mechanism, wherein a force exerted on the first portion of the one or more tension members does not change as the cam rotates and moves.

In some aspects, the techniques described herein relate to a cam of an exercise apparatus, the cam including: a first circular segment including an outer surface; a second circular segment including an inner surface and positioned opposite the first circular segment, and wherein the first and second circular segments have a non-constant radius; and an aperture positioned between the inner surface and outer surface such that a distance between a tangent of the inner surface and a tangent of the outer surface is constant regardless of the orientation and movement of the cam.

In some aspects, the techniques described herein relate to a cam, further including two cylindrical cutouts positioned adjacent to one another and located between the first circular segment and the second circular segment, wherein the cutouts are configured to provide an anchor point for one or more belts to attach to the cam. In some aspects, the techniques described herein relate to a cam, further including a wedge configured to be attached to the first and second circular segments, wherein the wedge is positioned adjacent to the two cylindrical cutouts, and wherein the wedge secures the one or more belts to the cam. In some aspects, the techniques described herein relate to a cam, further including a plate and a plurality of fasteners configured to secure the wedge to the first and second segments. In some aspects, the techniques described herein relate to a cam, further including a receiver cutout positioned between the first circular segment and the second circular segment, wherein the receiver cutout is configured to receive a belt and a portion of a clamp. In some aspects, the techniques described herein relate to a cam, further including a plate cutout positioned adjacent the receiver cutout, wherein the plate cutout is configured to receive a second portion of the clamp, and wherein the first and second portions of the clamp are secured together via one or more fasteners. In some aspects, the techniques described herein relate to a cam, further including one or more cutouts located in the first or second circular segments. In some aspects, the techniques described herein relate to a cam, wherein the second circular segment is smaller than the first circular segment. In some aspects, the techniques described herein relate to a cam, wherein the aperture is offset from a center of the cam. In some aspects, the techniques described herein relate to a cam, wherein the tangents are oriented parallel to each other. In some aspects, the techniques described herein relate to a cam, wherein the tangent of the inner surface and the tangent of the outer surface are oriented in the direction of an external force acting on the cam. In some aspects, the techniques described herein relate to a cam, wherein the tangent of the inner surface and the tangent of the outer surface are oriented vertically. In some aspects, the techniques described herein relate to a cam, wherein a horizontal position of the tangent of the inner surface and the tangent of the outer surface do not change as the cam rotates and moves.

In some aspects, the techniques described herein relate to an apparatus for locking a portion of a belt, the apparatus including: an upper semicylindrical portion including: a curved edge; and a lower semicylindrical portion including: a chamfered edge; wherein the lower portion and upper portion join to form a cylindrical shape; wherein a gap is formed between the upper portion and the lower portion to accommodate the belt, the gap forming a curved inlet between the curved edge and the chamfered edge; and a fastener which secures the upper portion and lower portion to the belt.

In some aspects, the techniques described herein relate to an apparatus, wherein the upper semicylindrical portion further includes a first through hole and the lower semicylindrical portion includes a second through hole by which the fastener extends. In some aspects, the techniques described herein relate to an apparatus, wherein the first through hole is stepped. In some aspects, the techniques described herein relate to an apparatus, wherein the lower semicylindrical portion further includes a hexagonal cutout which extends axially. In some aspects, the techniques described herein relate to an apparatus, wherein the lower semicylindrical portion further includes one or more bolt channels which extend axially. In some aspects, the techniques described herein relate to an apparatus, wherein the upper cylindrical portion and the lower cylindrical portion include one or more teeth which extend into the gap. In some aspects, the techniques described herein relate to an apparatus, wherein the teeth of the upper cylindrical portion are offset from the teeth of the lower cylindrical portion. In some aspects, the techniques described herein relate to an apparatus, wherein the upper cylindrical portion includes 3 teeth and the lower cylindrical portion includes 4 teeth. In some aspects, the techniques described herein relate to an apparatus, wherein the upper cylindrical portion and the lower cylindrical portion each contain less than 10 teeth. In some aspects, the techniques described herein relate to an apparatus, wherein the belt leaves the curved inlet tangentially adjacent the lower semicylindrical portion. In some aspects, the techniques described herein relate to an apparatus, wherein the belt wraps around the lower semicylindrical portion and the upper cylindrical portion. In some aspects, the techniques described herein relate to an apparatus, wherein the belt wraps around the lower semicylindrical portion and the upper cylindrical portion at least 1 and ¼ times. In some aspects, the techniques described herein relate to an apparatus, wherein the radius of the joined lower semicylindrical portion and upper semicylindrical portion is ¾ inches. In some aspects, the techniques described herein relate to an apparatus, wherein the upper portion is smaller than the lower portion. In some aspects, the techniques described herein relate to an apparatus, wherein the upper semicylindrical portion further includes a flanged edge opposite the curved edge. In some aspects, the techniques described herein relate to an apparatus, wherein the lower semicylindrical portion further includes a recessed edge opposite the chamfered edge. In some aspects, the techniques described herein relate to an apparatus, wherein the flanged edge and the recessed edge contact when the lower portion and upper portion are joined.

In some aspects, the techniques described herein relate to a method of securing a belt in an exercise apparatus including: clamping a first end of a belt between an upper semicylindrical clamp and a lower semicylindrical clamp; fastening the upper semicylindrical clamp and lower semicylindrical clamp together; tightening the fastener to increase a clamping force exerted on the belt; wrapping the belt around an outer surface of the semicylindrical clamps; securing the second end of the belt to a feature of a workout apparatus; and fastening the lower semicylindrical clamp to another feature of the workout apparatus with one or more fasteners.

In some aspects, the techniques described herein relate to a method, wherein the upper semicylindrical clamp and the lower semicylindrical clamp have one or more through holes. In some aspects, the techniques described herein relate to a method, wherein the through hole of the lower semicylindrical clamp is threaded. In some aspects, the techniques described herein relate to a method, further including inserting a fastener into the through holes and through the belt. In some aspects, the techniques described herein relate to a method, wherein the feature is a second upper cylindrical clamp and a second lower cylindrical clamp. In some aspects, the techniques described herein relate to a method, wherein the feature is one or more of a cam or a pulley. In some aspects, the techniques described herein relate to a method, wherein the feature is one or more of a cam or a tension bolt. In some aspects, the techniques described herein relate to a method, wherein the belt is wrapped around the semicylindrical clamps 1 and ¼ turns. In some aspects, the techniques described herein relate to a method, further including rotating the clamps to adjust a number of wraps via a hexagonal through hole in the lower semicylindrical clamp.

In some aspects, the techniques described herein relate to a belt and pulley apparatus including: one or more pulleys; a pulley housing attached to the one or more pulleys; a clamp hold attached to the pulley housing, the clamp hold including a tapered aperture; two wedges positioned within the aperture, each wedge including: a flanged portion which extends from the aperture and rests on top of the clamp hold; and a tapered portion positioned within the aperture; and a belt secured between the two wedges.

In some aspects, the techniques described herein relate to a belt and pulley apparatus, wherein the two wedges further include one or more teeth which grip the belt. In some aspects, the techniques described herein relate to a belt and pulley apparatus, wherein the one or more teeth are offset. In some aspects, the techniques described herein relate to a belt and pulley apparatus, wherein each wedge includes 4 teeth. In some aspects, the techniques described herein relate to a belt and pulley apparatus, wherein each wedge includes less than 10 teeth. In some aspects, the techniques described herein relate to a belt and pulley apparatus, further including a backstop attached to the pulley housing and positioned opposite the clamp hold. In some aspects, the techniques described herein relate to a belt and pulley apparatus, wherein the tapered aperture is rectangular in shape.

In some aspects, the techniques described herein relate to a method of securing a belt to a pulley including: threading a belt through an aperture of a clamp hold in a first direction; clamping the belt between two wedges; inserting the belt and two wedges into the aperture of the clamp hold in a second direction to secure the belt and wedges in place, wherein the wedges exert a clamping force on the belt; exerting a force of the belt in the second direction to increase the clamping force on the belt.

In some aspects, the techniques described herein relate to a method, wherein the clamp hold is secured to a pulley assembly. In some aspects, the techniques described herein relate to a method, wherein the belt is also secured to a cam. In some aspects, the techniques described herein relate to a method, wherein the aperture and the wedges are tapered. In some aspects, the techniques described herein relate to a method, wherein the wedges have a flanged portion which rests outside the aperture. In some aspects, the techniques described herein relate to a method, wherein the belt clamps include teeth which contact the belt.

In some aspects, the techniques described herein relate to a device for securing a cable to a cam, the device including: a first portion which inserts into a cutout of the cam, the first portion including two cable slots which hold two cables inserted from a first direction; a second portion which extends orthogonally above the first portion, the second portion including: an elongated cable slot for holding another cable inserted from a second direction; and two support walls which extend downward from the second portion, wherein the two support walls are spaced apart to accommodate a portion of a cam.

In some aspects, the techniques described herein relate to a device, wherein the two cable slots and the elongated cable slot have a wide portion and a narrow portion for inserting and securing a ball-ended cable. In some aspects, the techniques described herein relate to a device, wherein the second portion further includes a through hole which extends orthogonal to the elongated slot, and wherein the two support walls are traversed by another through hole. In some aspects, the techniques described herein relate to a device, wherein a fastener is inserted into the through hole to prevent the ball-ended cable from leaving the elongated cable slot. In some aspects, the techniques described herein relate to a device, wherein a fastener is inserted into the another through hole to secure the two support walls to the cam. In some aspects, the techniques described herein relate to a device, wherein the first portion resembles a flat rectangular shape. In some aspects, the techniques described herein relate to a device, wherein the second portion resembles an elongated rectangular shape.

In some aspects, the techniques described herein relate to a method of securing cables to a cam including: inserting, from a first direction, two ball-ended cables into two adjacent slots of a first portion of a cable key; inserting, from a second direction, another ball-ended cable into an elongated slot of a second portion of the cable key; inserting the first portion into a cutout of the cam; positioning a portion of the cam to fit between the two sidewalls which extend from the second portion of the cable key;

In some aspects, the techniques described herein relate to a method, further including fastening the cable key to the cam via a through hole positioned on the two sidewalls. In some aspects, the techniques described herein relate to a method, further including fastening a screw though a second through hole positioned on the second portion which secures the another ball cable in the elongated slot. In some aspects, the techniques described herein relate to a method, wherein the first portion resembles a flat rectangular shape. In some aspects, the techniques described herein relate to a method, wherein the second portion resembles a elongated rectangular shape.

In some aspects, the techniques described herein relate to an apparatus for clamping a belt to a cam, the apparatus including: a first portion having a curved surface; a second portion positioned adjacent the first portion, wherein a top surface of the second portion has substantially the same curvature of the curved surface, wherein the top surface and curved surface are configured to clamp the belt; a third portion positioned adjacent the second portion, wherein the third portion and second portion are configured to clamp to the cam, wherein the first portion, second portion, and third portion are fastened to the cam.

In some aspects, the techniques described herein relate to an apparatus, wherein one or more of the one or more through holes is threaded. In some aspects, the techniques described herein relate to an apparatus, wherein the one or more through holes of the semicylindrical portion is stepped. In some aspects, the techniques described herein relate to an apparatus, further including one or more teeth protruding from the curved surface. In some aspects, the techniques described herein relate to an apparatus, further including one or more teeth protruding from the top surface. In some aspects, the techniques described herein relate to an apparatus, wherein the teeth of the curved surface are offset from the teeth of the top surface. In some aspects, the techniques described herein relate to an apparatus, wherein the number of teeth is more than 1 and less than 10. In some aspects, the techniques described herein relate to an apparatus, wherein the first portion is semicylindrical in shape. In some aspects, the techniques described herein relate to an apparatus, wherein the second portion is arcuate in shape. In some aspects, the techniques described herein relate to an apparatus, wherein the third portion resembles a plate. In some aspects, the techniques described herein relate to an apparatus, wherein each of the first portion, second portion, and third portion include one or more through holes whereby one or more fasteners extend.

In some aspects, the techniques described herein relate to a method of clamping a belt to a cam including: inserting a third portion into a first cutout of the cam; inserting a second portion into a second cutout positioned adjacent the first cutout, the second cutout being positioned on an outside edge of the cam; positioning a belt along an outside surface of the cam and a top surface of the second portion; positioning a first portion above the second portion and on top of the belt; and fastening the first portion, second portion, third portion, belt, and cam together.

In some aspects, the techniques described herein relate to a method, wherein fastening the first portion, second portion, third portion, belt, and cam together includes: aligning one or more through holes of the first portion, second portion, and third portion; and inserting a fastener through the through holes. In some aspects, the techniques described herein relate to a method, wherein one or more of the one or more through holes is threaded. In some aspects, the techniques described herein relate to a method, wherein the one or more through holes of the semicylindrical plate is stepped. In some aspects, the techniques described herein relate to a method, further including one or more teeth protruding from the semicylindrical plate. In some aspects, the techniques described herein relate to a method, further including one or more teeth protruding from the arcuate plate. In some aspects, the techniques described herein relate to a method, wherein the teeth of the semicylindrical plate and the arcuate plate are offset. In some aspects, the techniques described herein relate to a method, wherein the number of teeth is more than 1 and less than 10. In some aspects, the techniques described herein relate to a method, wherein the first portion is semicylindrical in shape. In some aspects, the techniques described herein relate to a method, wherein the second portion is arcuate in shape. In some aspects, the techniques described herein relate to a method, wherein the third portion resembles a plate.

BRIEF DESCRIPTION OF THE DRAWINGS

FIG. 14A is a perspective view illustration of a cable key, according to some embodiments.

FIG. 14B is a right side view illustration of the cable key, according to some embodiments.

FIG. 14C is a left side view illustration of the cable key, according to some embodiments.

FIG. 14D is a back side view illustration of the cable key, according to some embodiments.

DETAILED DESCRIPTION OF CERTAIN EMBODIMENTS

The present exercise apparatus can take a variety of forms and can be used in a variety of manners as will be apparent from the description of the following embodiments. Additionally, some of the embodiments include a combination of some of the aspects and features described above, and others will include additional aspects and features. As noted above, not all of the aspects and features of the present disclosure need to be employed in a single embodiment.

Each illustrated embodiment includes a resistance unit that allows for variable resistance and variable degrees and extensions of motion by the user. In addition, the resistance units are designed to permit the user to perform a wide variety of exercises to work various muscles or muscle groups with the same piece of equipment. The resistance unit can be stationary or movable, and can include movable pulleys that allow the user to change the direction in which the user pushes or pulls during a set of the exercise repetitions. Various examples of resistance units, including exercise apparatuses with pneumatic devices can be found in U.S. Pat. Nos. 4,257,593; 5,526,692; 5,336,145; 6,962,554; 7,172,538; 7,686,749; 7,998,038; 8,052,584; 8,3231,58; and 8,523,789, the contents of which are hereby incorporated by reference. These patents describe exercising apparatuses and related devices using pneumatic devices to provide controllable resistances, and which form part of this disclosure. Various aspects, features and advantages of the described apparatus can be used with various types of resistance mechanisms (for example, but without limitation, weight stacks, resistance unit, exercise system, multi-function exercise station, leg press, leg extension machine, leg curl machine, standing hip machine, abdominal machine, lower back machine, upper back machine, lateral pull down machine, military press machine, chest press, triceps machine, arm curl machine, seated butterfly machine, seated calf machine, lateral shoulder raise machine, squat machine, hip abductor machine, or variations thereof) as described in these patents. The apparatus may further be stationary or movable.

As used herein, "cable" and "belt" may be used to mean a flexible link such as a steel or fiber rope, cord, cable, belt, or the like. Further, such terms may be used interchangeably.

Figure 1:
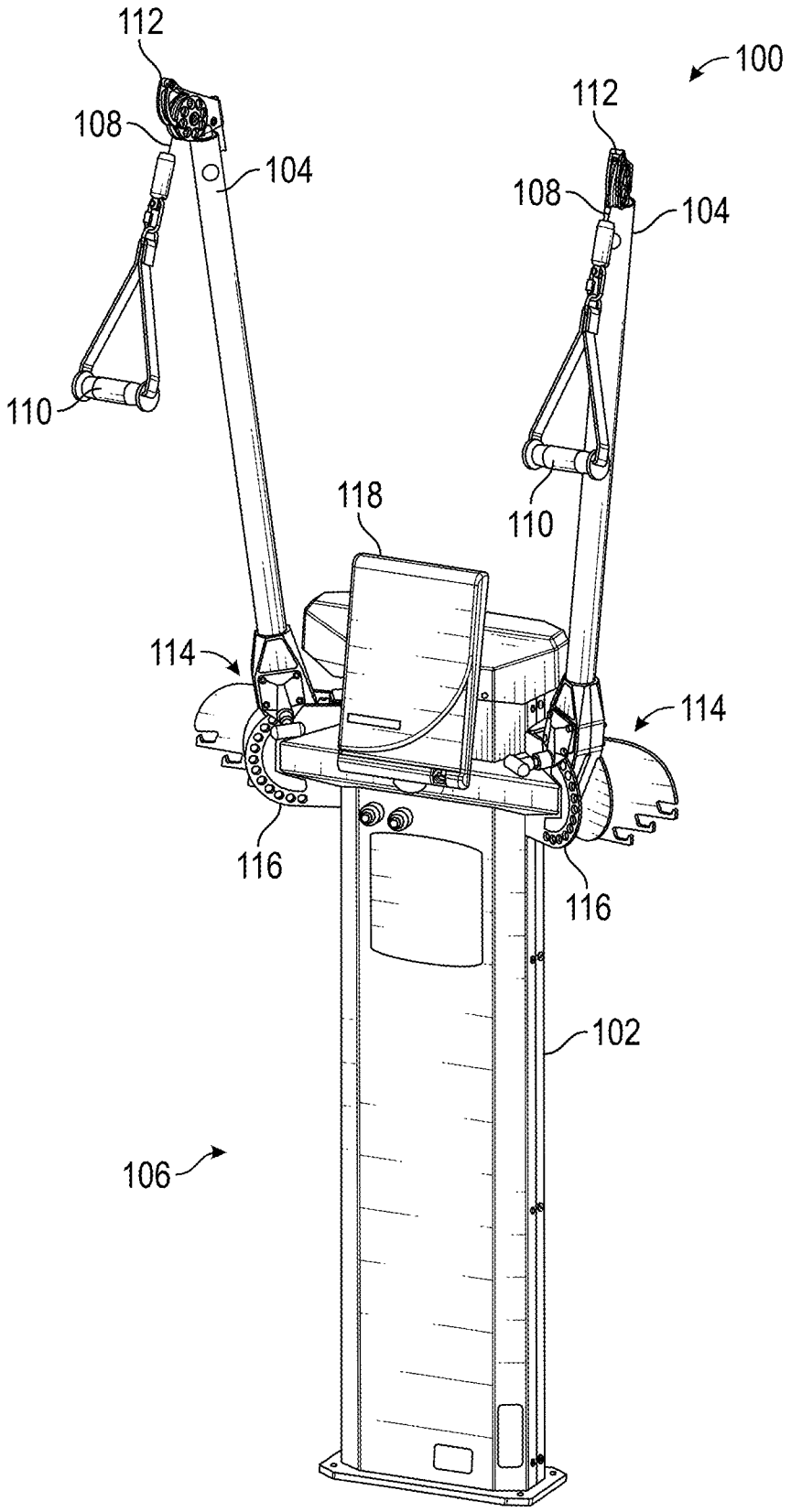
FIG. 1 is a perspective view illustration of an exercise apparatus, according to some embodiments.
Figure 2:
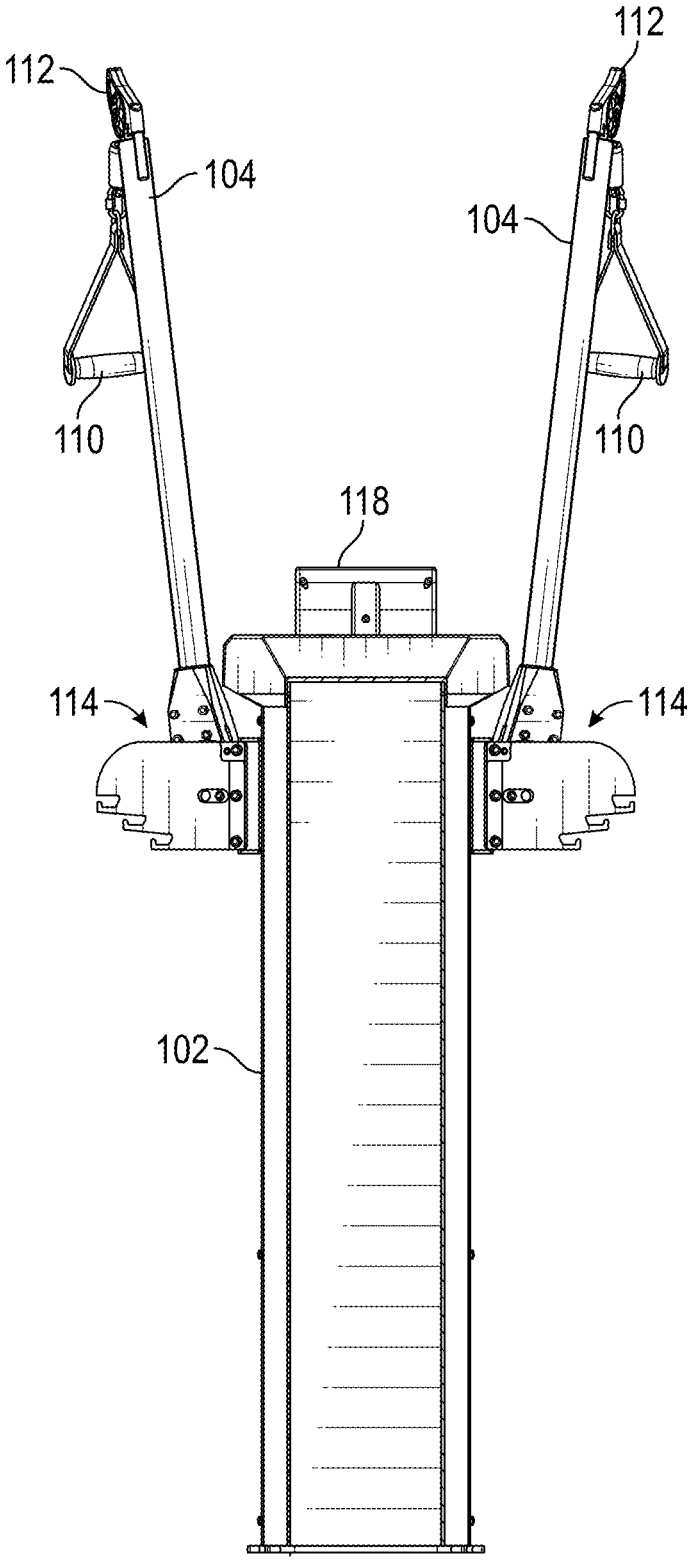
FIG. 2 is a back side view illustration of the exercise apparatus, according to some embodiments.

FIG. 1 shows a front perspective view of a potential embodiment of an exercise apparatus 100. FIG. 2 shows a back view of the exercise apparatus 100.

The exercise apparatus 100 has a housing 102 which houses a resistance assembly (e.g. resistance unit) and coupling mechanism (not shown). A user interface 118 may be mounted to the housing 102. The housing 102 also supports a pair of adjustable arms 104. The arms 104 are disposed on opposite sides of the housing 102 and extend outward from the housing 102. In the illustrated embodiment, each arm 104 extends at an angle relative to a front side 106 of the housing. This arrangement is advantageous because it permits three exercise apparatuses 100 to be mounted close to each other in a triangular arrangement. That is, each exercise apparatus 100 may be arranged along one leg of an equilateral triangle with a rear side of the exercise apparatus 100 facing one another. Because the arms 104 of each exercise apparatus 100 are spaced apart, the movement of the arm 104 of one exercise apparatus 100 does not interfere with the movement of an adjacent arm 104 of the next exercise apparatus 100.

In certain embodiments, each arm 104 has a tubular structure through which a user cable 108 passes. In certain embodiments, the outer end of the arm supports a handle pulley assembly 112 via a hinge connection. The hinge connection allows the handle pulley assembly 112 to rotate about an axis of the arm 104. The handle pulley assembly 112 comprises a pulley that is offset to one side of the arm axis. In certain embodiments, the handle pulley assembly 112 includes a plurality of holes formed in its side brackets. The holes lighten the weight of the handle pulley assembly 112 in order to respond more quickly to the movement of the user and to do so with less resistance.

In certain embodiments, the first end of the user cable 108 is threaded over the pulley of the handle pulley assembly 112 and a handle 110 is connected to this first end of the user cable. In the illustrated embodiment, the handle 110 preferably is releasably connected to the end of the user cable 108 in order to exchange different types of user interface. The arrangement of the hinge connection and handle pulley assembly 112 automatically aligns the user cable 108 with the handle pulley assembly 112 when the handle 110 is pulled from substantially any direction outwardly from the arm 104. The second end of the user cable 108 is similarly arranged and is similarly connected to the other handle 110.

A hinge assembly 114 hinges the opposite end of each arm 104 to the housing 102. In certain embodiments, each hinge assembly 114 provides about 180° of movement (slightly less in the illustrated embodiment) in order to vary the vertical position of the corresponding handle pulley assembly 112. For example, in order to do biceps curls, the arms 104 would be positioned to extend straight down and the user would pull the handles 110 upward from the handle pulley assembly 112. In order to do lateral-pull-downs or triceps pushes, the arms 104 would be positioned to extend straight up and the user would pull down on the handles 110. The arms 104 preferably can be selectively locked in a number of positions between these two extremes.

For this purpose, each hinge assembly 114 may include a locking mechanism. In some embodiments each hinge assembly includes a bracket 116 that receives a lug. The bracket 116 is formed by at least two bracket plates: a front bracket plate and a back bracket plate. The bracket 116 is disposed on (and preferably at least partially integrated with) the housing 102 and the lug may be disposed on the inner end of the arm 104. At least one of the bracket plates may include a plurality of locking holes that are spaced in an arcuate pattern along an outer edge of the bracket plate. The lug can support a knob that controls a dowel (not shown). The dowel selectively engages one of the locking holes. In this manner, the user can releasably select the vertical position of the arm 104. In the illustrated embodiment, the knob is supported on the front side of the front bracket plate by a support bracket on the lug. The user may pull out the knob to disengage the dowel from a locking hole and releases (if a spring bias is provided) or pushes the knob to engage the dowel with the locking hole.

Each hinge assembly 114 may but need not include an axle in order to accommodate the full range of movement of the arm 104 and to not pinch the user cable 108 during such movement. The hinge assemblies 114 also may be zero-clearance (i.e., have no slop) in order that the user to does not sense any "play" in the structure as he or she pulls on the handles 110. For this purpose, the front bracket plate may be connected to the housing 102. The rear bracket plate may be connected to the front bracket plate by fasteners. Each bracket plate may include a hole, and the holes are aligned when assembled. The lug includes two corresponding semi-spherical dimples that are arranged on opposite sides of the lug. A ball bearing may be disposed between each hole and the corresponding dimple such that the ball bearing is captured between the corresponding bracket plate and the lug. Each ball bearing has a diameter larger than the hole and is sized to partially nest within the respective dimple. The ball bearings together act as the pivot about which the arm rotates. By tightening the fasteners and thereby drawing the bracket plates together, play or looseness between the lug and bracket can be substantially eliminated.

Figure 3:
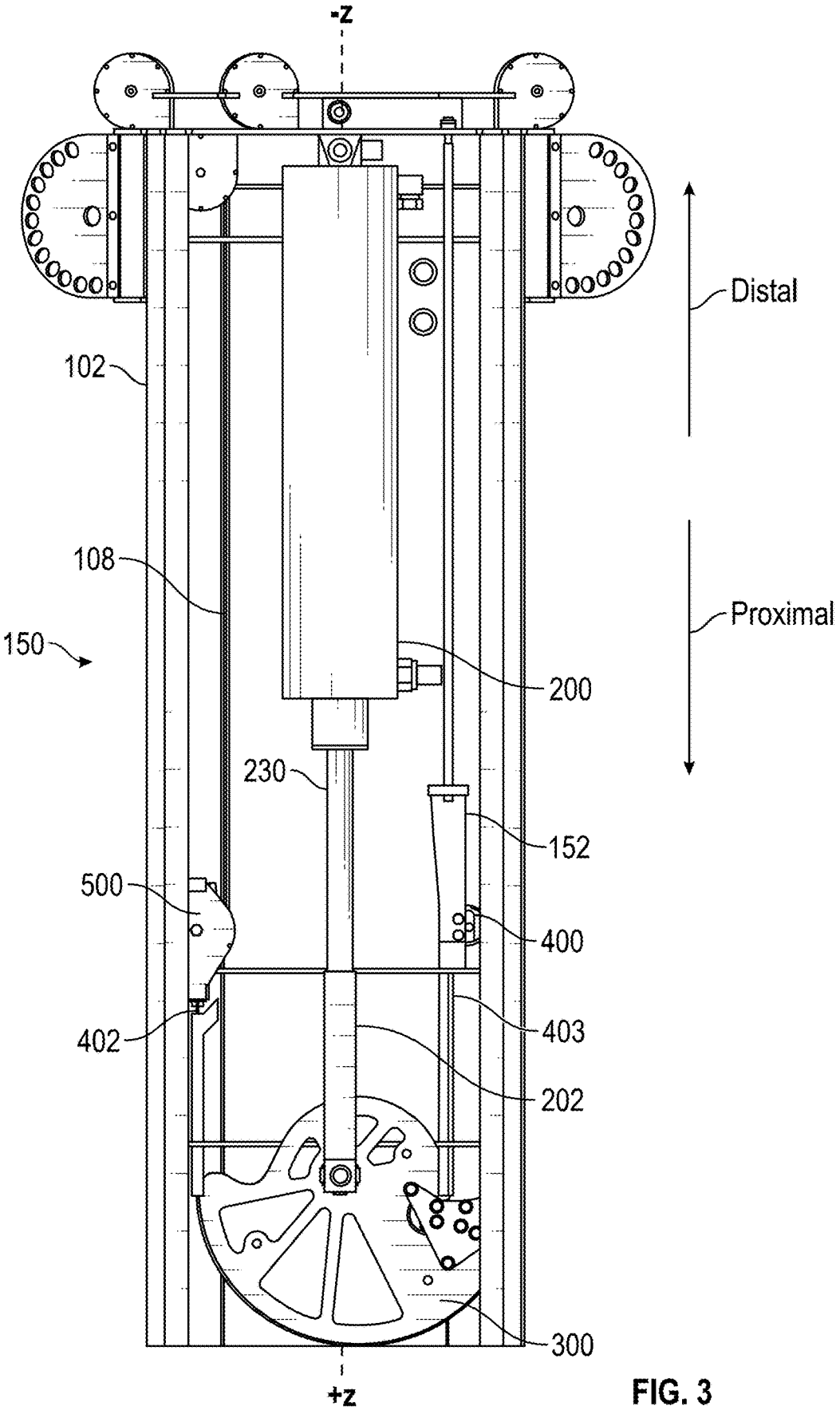
FIG. 3 is a back side view of the exercise apparatus with a back panel removed, according to some embodiments.

FIG. 3 shows a rear view of an exercise apparatus 100 with a back panel removed. As shown, a resistance unit and coupling mechanism 150 are located within the housing 102. The coupling mechanism 150 includes a resistance source 200 depicted here as a pneumatic cylinder, a cam 300, a belt lock 400, a first lower belt 402, a second lower belt 403, a lower pulley assembly 500, and a tension mechanism 152. The coupling mechanism 150 transfers a resistant force from the resistance source 200 to the user cable 108 to oppose movement of the handle 110 by the user.

As described herein, the term "proximal" refers to a +z direction while the term "distal" refers to a −z direction.

A distal end of the resistance source 200 is be attached to the housing 102 and positioned along the z-axis as shown. The resistance source 200 is attached to a rod 230 which attaches to a proximal end of the resistance source 200, and a clevis 202 which is attached to a proximal end of the rod 230. In some embodiments, an accumulator may be attached to the distal end of the resistance source 200. In some embodiments, the clevis 202 is attached to the resistance source directly without a rod 230.

The clevis 202 is rotatably coupled with the cam 300. The first lower belt 402 is positioned adjacent an outer surface of the cam 300 and attached on one end to the lower pulley assembly 500. The lower pulley assembly 500 is part of a block and tackle pulley system with one or more pulleys fixed to the housing 102. The lower pulley assembly 500 is attached to the user cable 108. The other end of the first lower belt 402 is attached to the cam 300. The second lower belt 403 is attached to the cam 300 on one end and attached to the belt lock 400 on the other end. The belt lock 400 may be held in place by the tension mechanism 152 which is fastened to the housing 102. This tension mechanism 152 may be tightened or loosed to adjust the tension exerted on the lower belts 402, 403.

In an example use of the exercise apparatus 100, a user would apply a force to the user cable 108 by pulling the handle 110 (not shown). This would cause the lower pulley assembly 500 to move in the-z direction and thus cause an upward force to be exerted on the first lower belt 402. This force would cause the cam 300 to rotate about an attachment point with the clevis 202 and simultaneously cause the cam 300 to move in the-z direction. This movement would result in the rod 230 to move in the-z direction and thus actuate the resistance source 200. Further, the irregular shape of the cam 300 causes a lateral force, which is perpendicular to the z-axis, to cause the cam 300 to move in a lateral direction as it rotates.

According to some embodiments, the lower pulley assembly 500 and block and tack pulley system is optional. In some embodiments, the first lower belt is attached to the handles (e.g. 110 of FIG. 1). In some embodiments, the first lower belt is attached to the user cable (e.g. 108). In some embodiments, the belt is attached to an arm (e.g. 104) of the exercise apparatus. In some embodiments, the belt or cable may attach to a resistance engagement other than a handle that a user may interact with (e.g. a pedal, grip, bar, pad etc.). The resistance unit and coupling mechanism may be implemented in other exercise apparatus such as described in the patents incorporated herein.

The resistance source 200 (e.g. resistance unit or assembly) of the illustrated embodiment may function as a pneumatic actuator or resistance piston. In some embodiments, the resistance source is a spring or stretchable band. In some embodiments, the resistance source is a free weight.

According to some embodiments, the pneumatic actuator is a linear actuator that includes a cylinder (e.g. 200) and a piston rod (e.g. 230). The cylinder can include a cylinder body and a piston that moves or translates within the cylinder body. The piston divides the cylinder body into two variable volume chambers. At least one of the chambers only selectively communicates with the atmosphere so as to provide the desired resistance. The other chamber may be open to the atmosphere; however, in some applications, both chambers can be pressurized (e.g., be of equal pressure), can selectively communicate with the atmosphere and/or can communicate with each other. The piston rod can be connected to the piston and extend through one of the variable volume chambers. The piston rod moves linearly along a stroke axis as the piston slides within the cylinder bore. The stroke length of the piston rod is sufficient to provide the desired stroke for the block-and-tackle mechanism (as discussed above). A cap closes the opposite end of the cylinder body (i.e., opposite of the end through which the piston rod extends). The cap can include a lug. A pivot pin preferably secures the lug to the cylinder-mounting bar such that the pneumatic actuator can pivot within the housing about the pivot pin. For example, the pneumatic actuator in the illustrated embodiment hangs from a bar within the housing so as to pivot within a plane that is generally parallel to the front/back side of the housing. The actuator in this position may have an upper chamber and a lower chamber. The actuator may communicate with at least one accumulator (not shown). The accumulator may be rigidly mounted within the housing. An air equalization line may connect the accumulator with the cylinder so as to expand effectively the variable volume of the upper chamber. In this manner, the effective air volume of the cylinder is increased, and air pressure thus will not increase as dramatically when the piston is moved.

According to some embodiments, the accumulator and the upper chamber may also selectively communicate with a source of pressurized air and with the atmosphere. According to some embodiments, an air compressor, which can be remotely disposed relative to the exercise apparatus, communicates with the upper chamber through an inlet valve on the cylinder. In certain embodiments, a user actuates the inlet valve via a button. The button can be accessible to the user from the housing. Pushing the button would add air pressure to the charged side of the cylinder, e.g., the upper chamber. According to some embodiments, an outlet valve may communicate with the charged side of the cylinder to selectively expel air to the atmosphere in order to decrease air pressure on the charged side of the cylinder. In certain embodiments, the user actuates the outlet valve via another button. The button can be accessible to the user. Thus, a user may adjust, i.e., increase or decrease, the air pressure within the resistance assembly by operating the appropriate valves via the respective button.

In some embodiments, the user cable 108 can be a formed of a synthetic material, such as a polymer. One suitable example for the user cable 108 is a polyester/nylon blend rope; however, a coated steel cable can also be used. For example, the user cable 108 can comprises ⅛-inch wire cable with a plastic sheathing, and most of the pulleys of the unit that support the cable can have a diameter of about five inches. Although any suitable cable and pulley size can be employed, it is preferable that the associated pulleys have a diameter about 40 times the diameter of the coated-wire cable. Smaller diameter pulleys, however, can be used with other types of cables, e.g., 2.5-inch diameter pulleys used with polyester/nylon blend rope.

Figure 4:
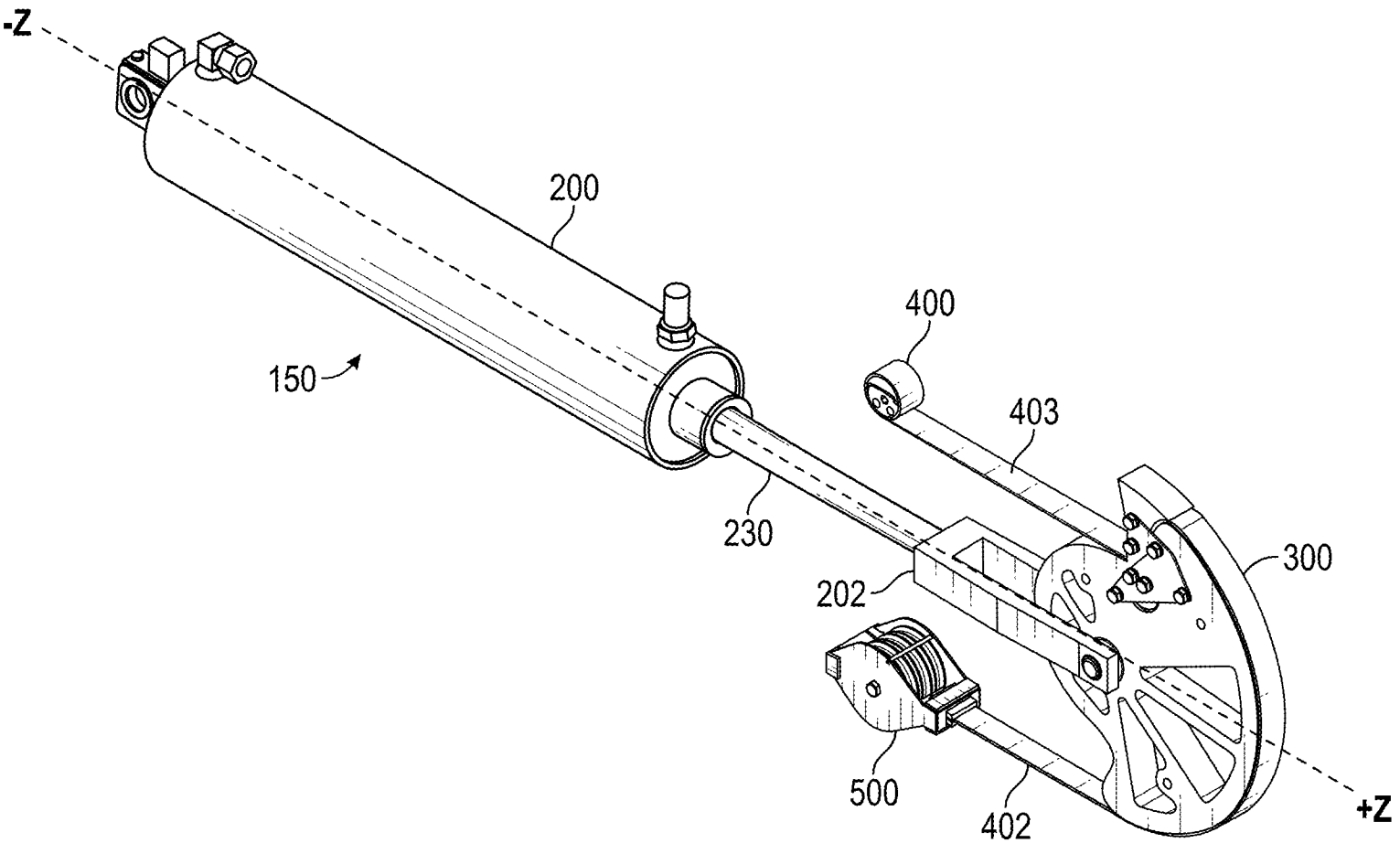
FIG. 4 is a perspective view illustration of a coupling mechanism, according to some embodiments.

FIG. 4 is a perspective view of a coupling mechanism 150 isolated from the rest of the exercise apparatus 100. A resistance source 200 is shown attached to a rod 230 which is attached to a clevis 202. A cam 300 is rotatably attached to the clevis 202. A first lower belt 402 is attached to the cam 300 and extends along an outside surface of the cam 300. The first lower belt 402 is also attached to a lower pulley assembly 500. The lower pulley assembly 500 may be attached to a user cable (not shown). A second lower belt 403 is attached to the cam 300 and also to the belt lock 400. The belt lock 400 may be attached to a tension bolt (not shown).

Figure 5:
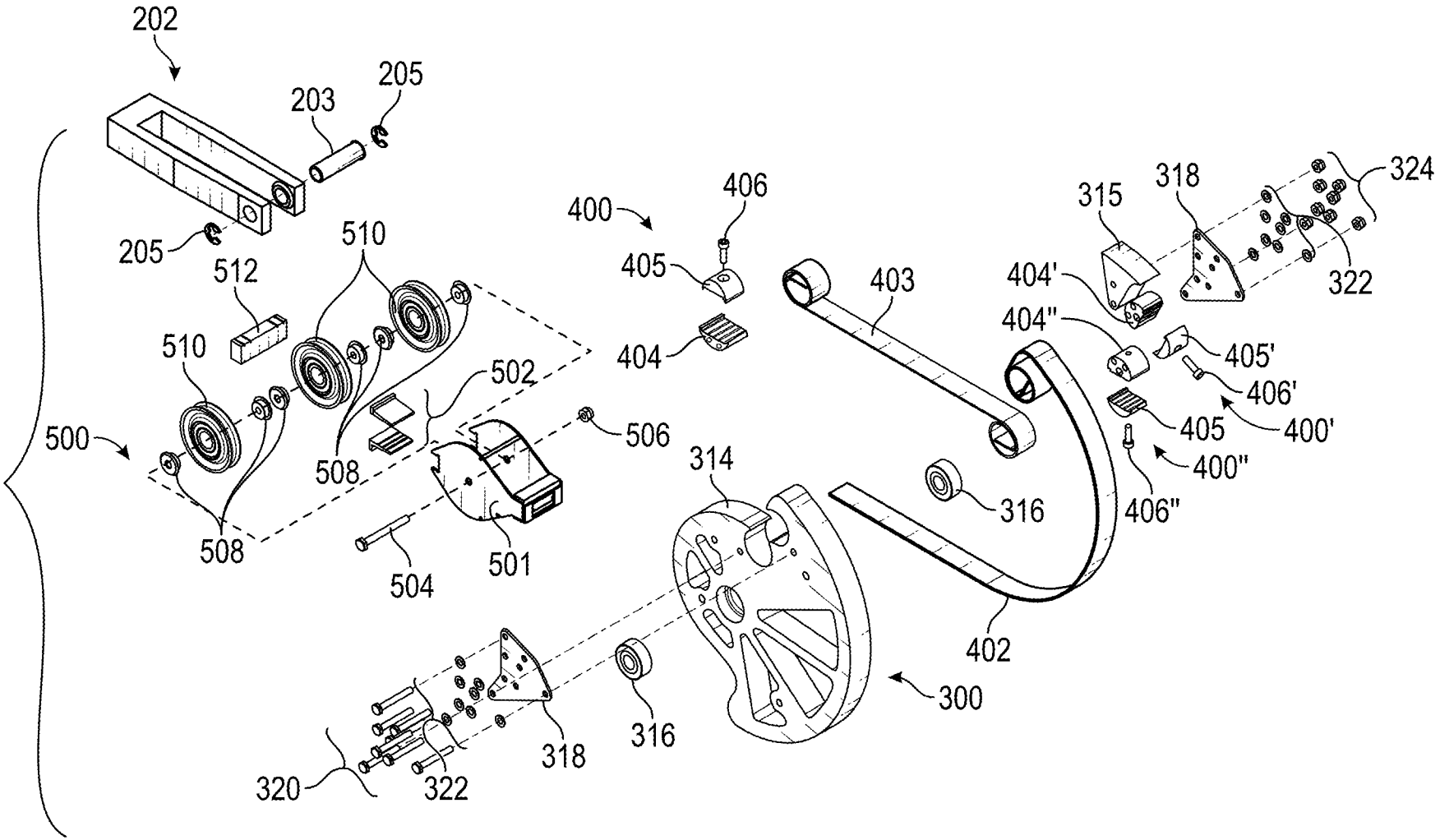
FIG. 5 is an exploded view illustration of the coupling mechanism without a resistance source and rod, according to some embodiments.

FIG. 5 shows an exploded view of a coupling mechanism without a resistance source and rod.

A cam 300 primarily includes a cam base 314. The cam base 314 includes a central aperture and several cutouts. The cam base 314 may be a single unitary piece of material. The cam 300 further includes a cam wedge 315 which is secured to the cam base 314 between two plates 318. The cam wedge 315, cam base 314, and two plates 318 surround a first inside belt lock 400' and a second inside belt lock 400" which are positioned within the cam 300. The cam wedge 315, two plates 318, and belt locks 400', 400" are held in place by a plurality of bolts 320, washers 322, and nuts 324. An end of a first lower belt 402 is configured to attach to the first inside belt lock 400' and an end of a second lower belt 403 is configured to attach to the second inside belt lock 400".

A belt lock 400 attaches to another end of the second lower belt 403. The belt lock 400 includes a upper piece 405, a lower piece 404, and a fastener 406 to secure the pieces together. The first inside belt lock 400' includes an upper piece 405', a lower piece 404', and a fastener 406'. The second inside belt lock 400" includes an upper piece 405", a lower piece 404", and a fastener 406".

A lower pulley assembly 500 attaches to another end of the first lower belt 402. The lower pulley assembly 500 includes a pulley housing 501 which encloses three pulley wheels 510 and several bushings 508 separating the wheels from each other and the pulley housing 501. In this embodiment there are four bushings 508. A bolt 504 and nut 506 secure the bushings 508 and three pulley wheels 510 to the pulley housing 501. The lower pulley assembly 500 further includes belt clamps 502 positioned on a proximal end of the pulley housing 501. The belt clamps 502 attach the first lower belt 402 to the pulley housing 501. A backstop 512 is attached to distal end of the pulley housing 501.

Two bearings 316 attach to the aperture of the cam base 314. A shaft 203 can be inserted through the aperture and two bearings 316 to attach the cam 300 to the clevis 202. Clips 205 may be positioned on each side of the shaft 203 secure the shaft 203 in place.

Figure 6A:
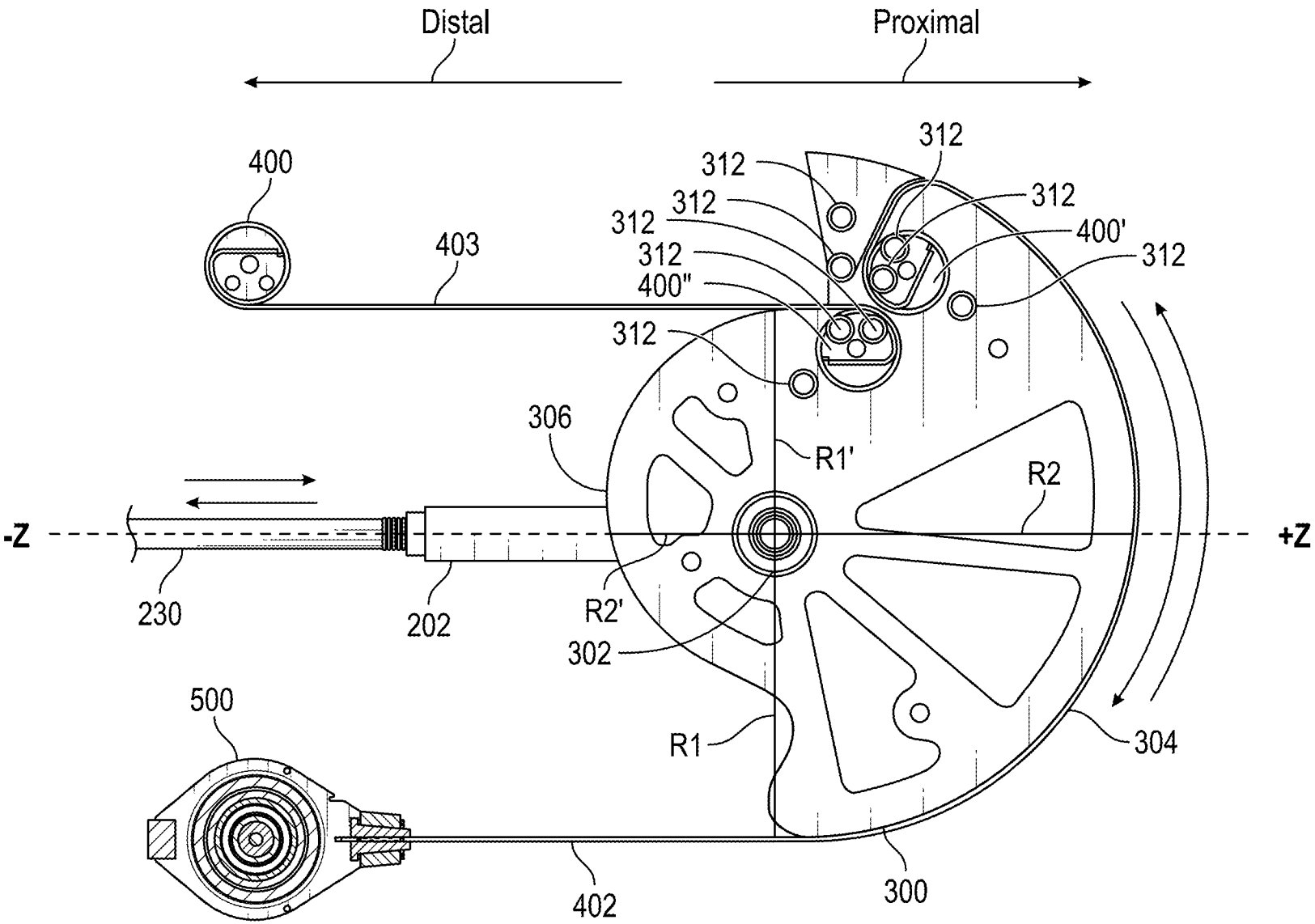
FIG. 6A is a back side sectional view illustration of the coupling mechanism in a neutral position, according to some embodiments.
Figure 6B:
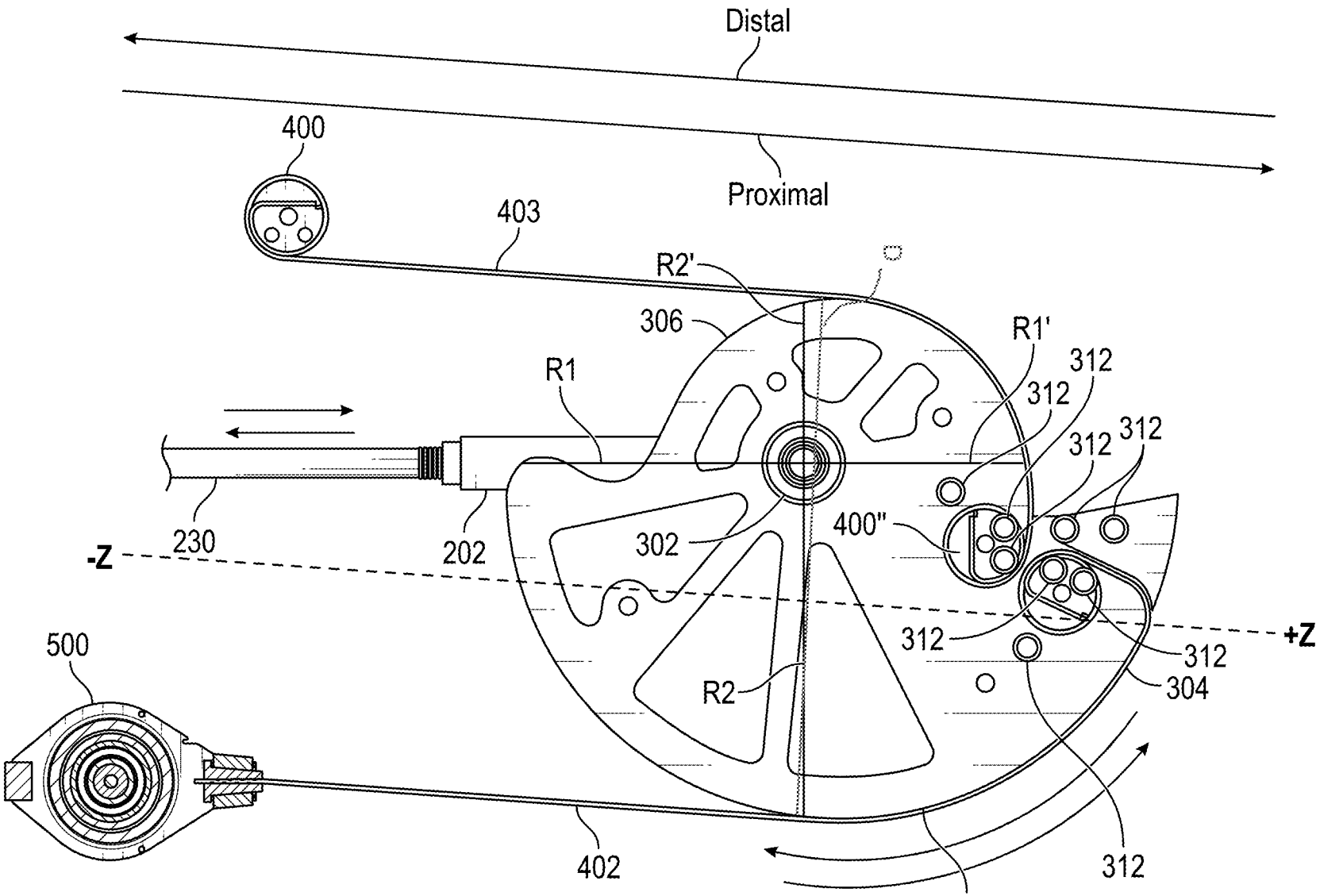
FIG. 6B is a back side sectional view illustration of the coupling mechanism in a rotated position, according to some embodiments.

FIGS. 6A and 6B show a back sectional view of a coupling mechanism, such as the coupling mechanism of FIG. 4. In FIG. 6A the cam 300 is in a neutral position. In FIG. 6B the cam 300 is in a rotated position. An aperture 302 (i.e. rotational axis) is shown positioned near the center of the cam 300. A bearing is shown positioned within the aperture 302. The aperture 302 allows the cam 300 to attach to, and rotate about, the clevis 202.

A first inside belt lock 400' is positioned within the cam 300 and attaches the first lower belt 402 to the cam 300. A second inside belt lock 400" is positioned within the cam 300, adjacent to the first inside belt lock 400', and attaches the second lower belt 403 to the cam 300. Several bolt holes 312 used for securing the belt locks are shown.

The cam 300 has an outer surface 304 which is curved and contacts the first lower belt 402. The cam 300 has an inner surface 306 which is curved and contacts the second lower belt 403. As shown in FIG. 6A, a first end of the first lower belt 402 attaches to the lower pulley assembly 500 and is positioned tangentially adjacent to the outer surface of the cam 300. A second end of the first lower belt 402 wraps around the outer surface of the cam 300 to attach to the first inside belt lock 400'. A first end of the second lower belt 403 attaches to the belt lock 400 and is positioned tangentially adjacent to the inner surface of the cam 300. A second end of the second lower belt 403 contacts the inner surface of the cam 300 and is attached to the second inside belt lock 400".

The curvature of each surface varies such that the radius of each surface, in relation to the rotational axis of the cam 600, is non constant. For instance, radius R1 of the outer surface is less than radius R2 of the outer surface. Further, radius R1' of the inner surface is greater than R2' of the inner surface. These radii are inversely related such that as the cam 300 rotates, the radius of one surface decreases while the other increases and vice versa. The varying radius's make it such that a distance D, between the outer surface 304 and inner surface 306 where the belts extend tangentially parallel to the z-axis, is constant as the cam 600 rotates and moves out of alignment with the z-axis. Because of this, the horizontal distance between the belt lock 400 and lower pulley assembly 500 remains constant as the cam 300 rotates and moves from its resting position. Distance D need not pass though the rotational axis of the cam 600. According to some embodiments, the curvature of the inner surface and the curvature of the outer surface is such that a total diameter of the cam 300 may be constant, i.e. R1+R1' or R2+R2" shown for illustrative purposes. According to some embodiments, this may be expressed that R2+R2'=R1+R1'. In some embodiments, the curvature of each surface may follow a logarithmic spiral. In certain embodiments, the radius of the inner surface may be generally smaller than the radius of the outer surface.

Figure 7A:
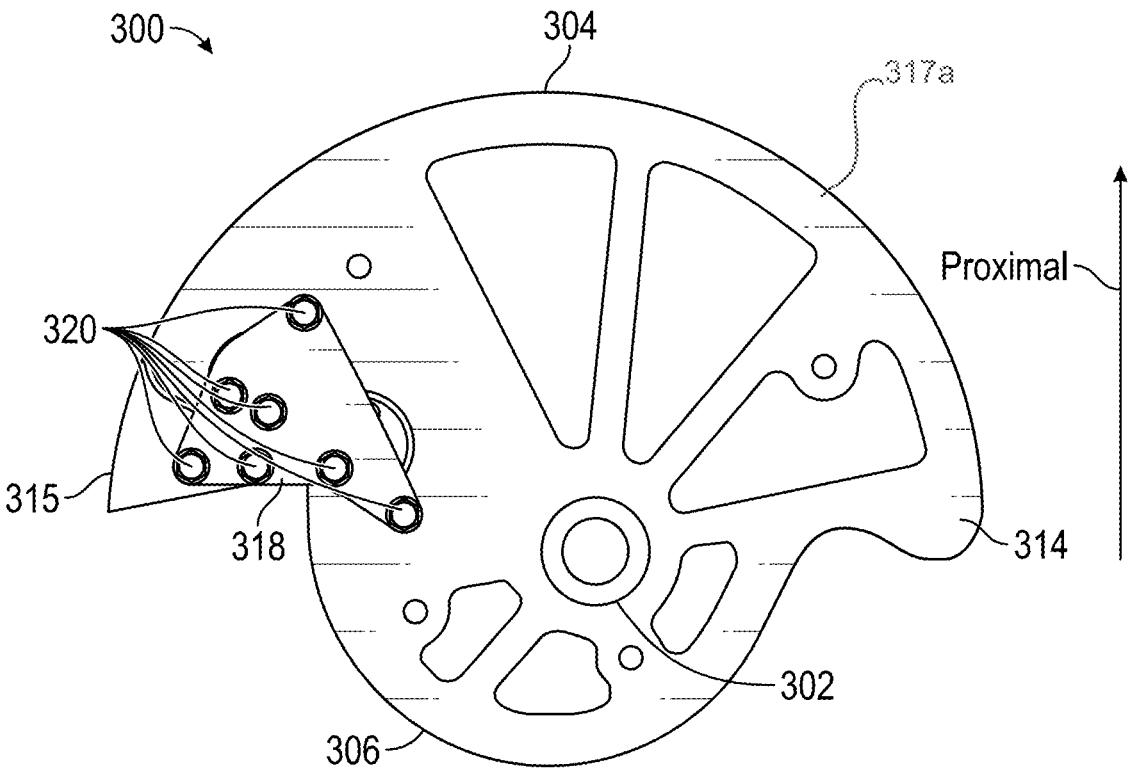
FIG. 7A is a back side view illustration of the cam, according to some embodiments.
Figure 7B:
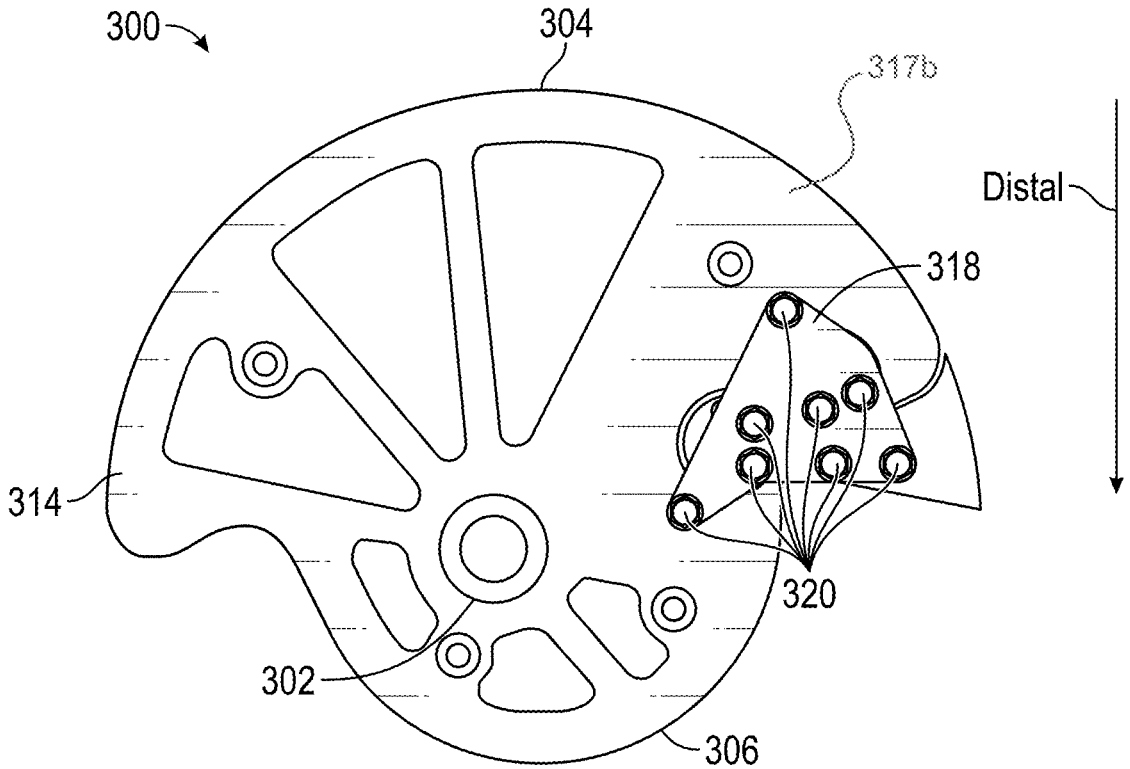
FIGS. 7B is a front side view illustration of the cam, according to some embodiments.

In use, a force in the −z direction is exerted on a user cable attached to the lower pulley assembly 500. This force causes a clockwise moment about a center of the aperture 302 of the cam 300. The belt lock 400 is immovably fixed and attached to an opposite side of the cam 300 which causes an opposing moment to act on the cam 300. The combination of these moments causes the cam 300 to move vertically in the −z direction toward a resistance source. Further, because the belt lock 400 is fixed and the lower pulley assembly 500 is not, the force causes the cam 300 to rotate in a clockwise direction to a position shown in FIG. 6B. Because the curvature of each surface is not constant, the rotation of the cam 300 causes the axis of rotation to move out of alignment with the z-axis. A resistance source (such as resistance source 200 of FIG. 4) is pivotally, or rotationally, attached to a housing (i.e. at a second axis) to allow this motion to occur. Thus, the cam 300 rotates about the attachment point with the clevis, the resistance source, rod, clevis, and cam rotate about the second axis, and the cam, rod and clevis move toward the resistance source. When the force exerted on the user cable is relaxed, the cam 300 moves in the +z direction, moves horizontally (e.g. laterally) back into alignment with the z-axis, and rotates counter-clockwise back to the neutral position shown in FIG. 6A. Despite the motion of this cycle of movement, the distance D between the belts, which maintain a vertical orientation along the z-axis, do not change. Due to the rotational, horizontal, and vertical movement of the cam during each cycle, the location at which the belts meet the tangent of the outer and inner surfaces 304, 306 may change. Throughout each cycle of movement, the force felt by the user and acting on the first cable 702 remains constant. According to some embodiments, the curvature of the inside and outside surfaces on the cam vary such that this force acting on the first cable 702 increases or decreases throughout the cycle of movement FIGS. 7A and 7B show front and back views of a cam 300. An aperture 302 is shown within a cam base 314. In certain embodiments, the cam base includes a front surface 317*b,* a back surface 317*a,* an outer surface 304, and an inner surface 306. A portion of the cam base 314 extends into the aperture 302 to form a bearing rest. Bearings may be positioned within the aperture 302 and attached to the cam base 314. Plates 318 are shown positioned on both the front surface 317*b* and the back surface 317*a*. In certain embodiments, the plates 318 attach the cam wedge 315 to the cam base 314 via a plurality of bolts 320. In certain embodiments, the outer surface 304 extends along a proximal side of the cam base 314 and substantially resembles a crescent or semicircle shape (e.g. first circular segment). In certain embodiments, an inner surface 306 extends along a distal side of the cam base 314 and substantially resembles a crescent or semicircle (e.g. second circular segment). In certain embodiments, the cam base 314 has several cutouts. These cutouts may reduce the overall weight of the cam 300.

Figure 7C:
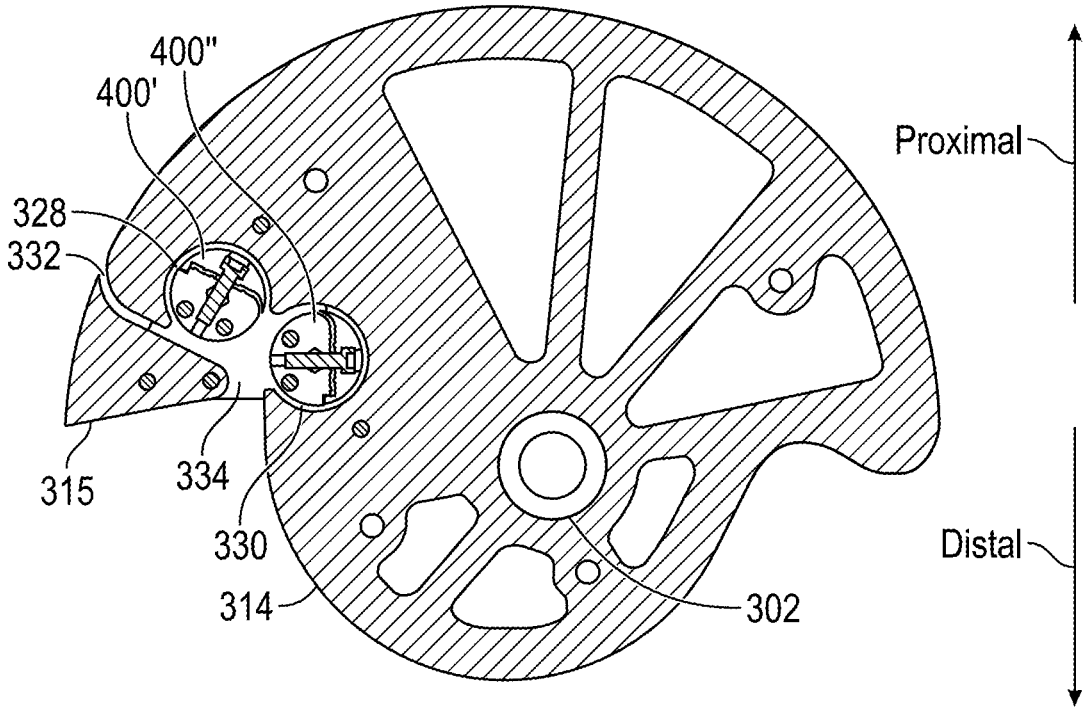
FIG. 7C is a back cross-sectional view illustration of the cam, according to some embodiments.

FIG. 7C shows a back cross-sectional view of the cam 300. A first pocket 328 and a second pocket 330 are located between the cam base 314 and cam wedge 315. The pockets 328, 330 are cylindrical in shape and house the first inside belt lock 400' and second inside belt lock 400" respectively. The pockets 328, 330 also house parts of the first and second belt (not shown). A first belt gap 332 is located between the cam base 314 and the cam wedge 315. The first belt gap 332 accommodates the first belt and allows access from the outer surface 304 to the first pocket 328. A second belt gap 334 is located between the cam wedge 315 and the inner surface 306. The second belt gap 334 accommodates the second belt.

Figure 8A:
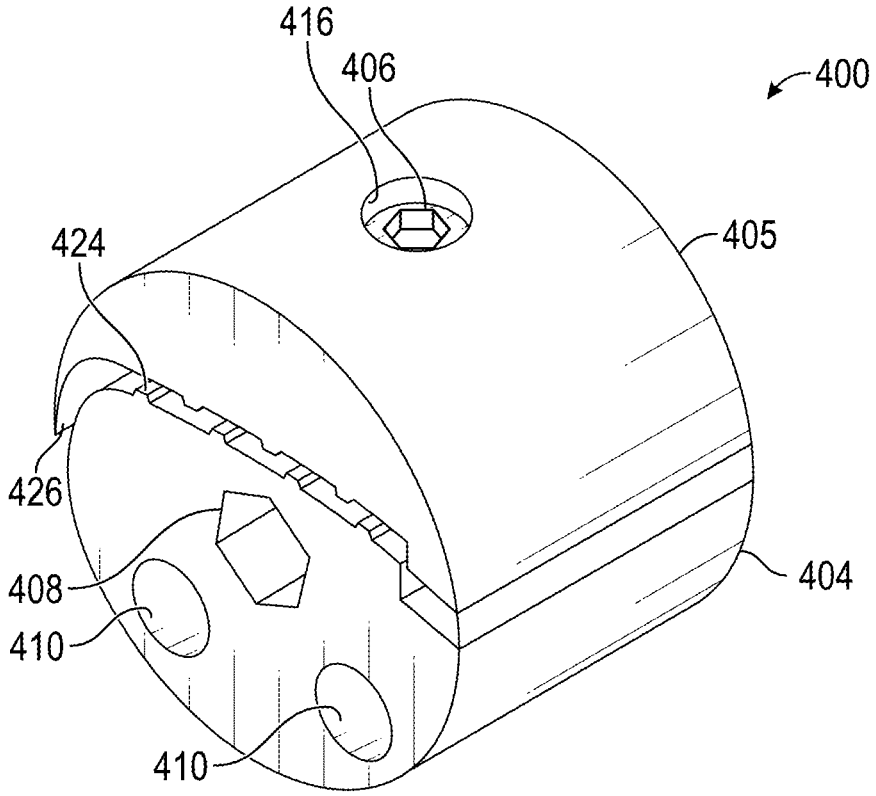
FIG. 8A is a perspective view illustration of a belt lock, according to some embodiments.
Figure 8B:
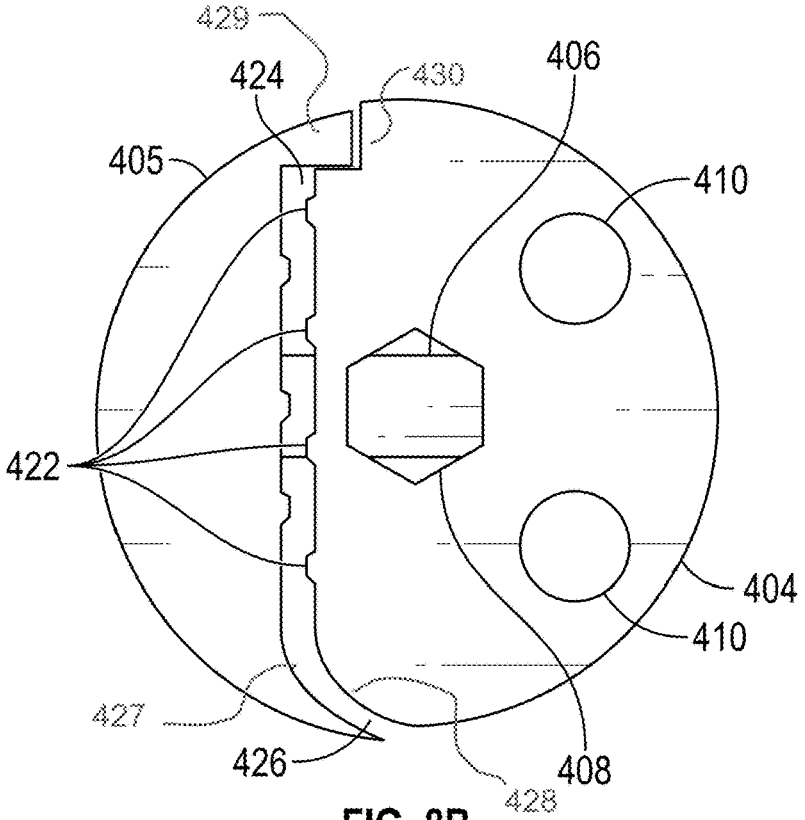
FIG. 8B is a back side view illustration of the belt lock, according to some embodiments.
Figure 8C:
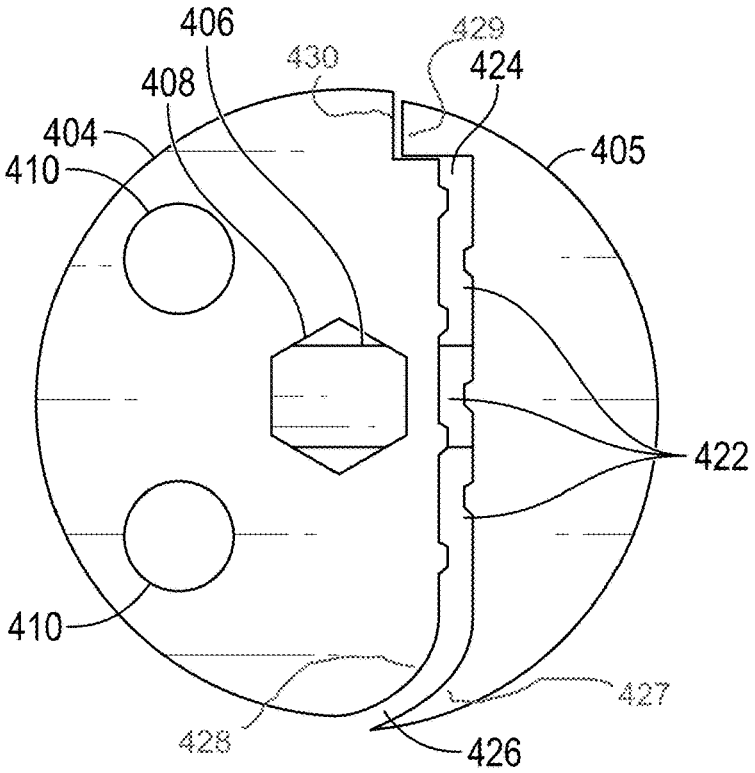
FIG. 8C is a front side view illustration of the belt lock, according to some embodiments.
Figure 8D:
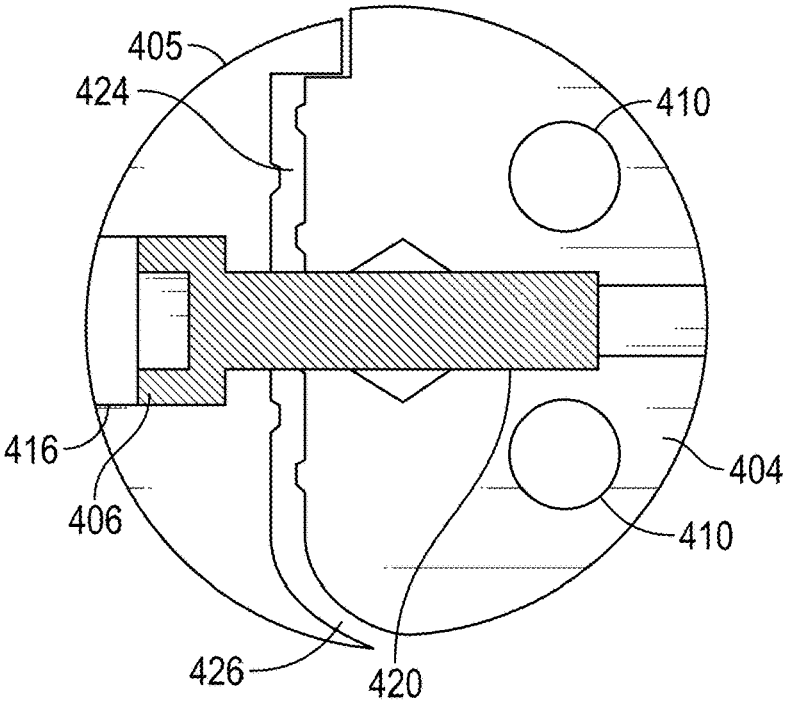
FIG. 8D is a back cross-sectional view illustration of the belt lock, according to some embodiments.

FIG. 8A-8D shows different views of a belt lock. The belt lock shown could be any one of belt locks 400, 400', and 400". For simplicity, the belt lock of this figures will be referred to as belt lock 400. FIG. 8A shows a perspective view of a belt lock 400. FIGS. 8B and 8C show front and back views of the belt lock 400. FIG. 8D shows a cross-sectional view of FIG. 8B.

In certain embodiments, the belt lock 400 includes three separate components, the lower piece 404, the upper piece 405, and the fastener 406. In certain embodiments, the lower piece 404 and the fastener 406 interlock to form a cylindrical shape whereby a belt may be clamped. In certain embodiments, the lower piece 404 and the upper piece 405 may be generally semicylindrical in shape. In certain embodiments, the fastener 406 keeps the lower piece 404, the upper piece 405, and the belt together. The upper piece 405 can include a fastener aperture 416 where the fastener 406 is inserted and adjusted. The lower piece 404 can include a tapped hole 420 for the fastener 406. In certain embodiments, the lower piece 404 can further include a hexagonal cutout 408 which extends through a front and back surface. In certain embodiments, the lower piece 404 comprises two bolt channels 410. In certain embodiments, the hexagonal cutout 408 is disposed closer to a center of the belt lock 400 than the two bolt channels 410. In certain embodiments, the hexagonal cutout 408 extends from the front to back surface. In certain embodiments, the two bolt channels 410 are configured to secure the belt lock 400 to the cam as shown in FIG. 7C. In certain embodiments, the upper piece 405 is smaller than the lower piece 404.

A belt gap 424 is designed to accommodate a belt and is defined by an inside surface of the upper piece 405 and an inside surface of the lower piece 404. The inside surface of the upper piece 405 has three teeth 422 which extend into the belt gap 424. The inside surface of the lower piece 404 has four teeth 422 which extend into the belt gap and are offset from the three teeth 422 of the inside surface of the upper piece 405. These teeth 422 help to secure the belt 403 into place. The belt gap 424 has a curved inlet 426 where the belt leaves the belt gap 424. The curved inlet 426 is angled such that the belt, when exiting the belt gap 424 is positioned to wrap around the belt lock 400. For example, the belt may leave the belt gap 424 tangentially adjacent to the belt lock 400. In certain embodiments, the curved inlet 426 is defined by a curved edge 427 of the upper piece 405 and a recessed edge 428 of the lower piece 404. The curved inlet 426 helps the belt maintain contact with an outside surface of the belt lock 400 while it wraps. Wrapping the belt around the belt lock 400 helps to distribute the load acting on the belt and belt lock 400. This helps to secure the belt into place and reduces the chance of the belt breaking or tearing as belt failure typically occurs at the location where the belt is clamped. In some embodiments, the curvature of the outside surface of the belt lock 400 is non continuous. In some embodiments, the curvature of the outside surface of the belt lock 400 is fixed. In some embodiments, the curvature of the outside surface of the lower piece 404 is different than the curvature of the outside surface of the upper piece 405. In some embodiments, each inside surface may have one or more teeth. In some embodiments, each surface may have less than 10 teeth.

The lower piece 404 and the upper piece 405 can be configured to contact each other near the belt gap 424 on an end opposite the curved inlet 426. For example, the upper piece 405 can have a flanged edge 429 and the lower piece 404 can have a chamfered edge 430. The flanged edge 429 and the chamfered edge 430 can contact each other as the upper piece 405 and the lower piece 404 are fastened together. This configuration can further anchor the lower piece 404 and the upper piece 405 together and ensure proper orientation during assembly.

Figure 8E:
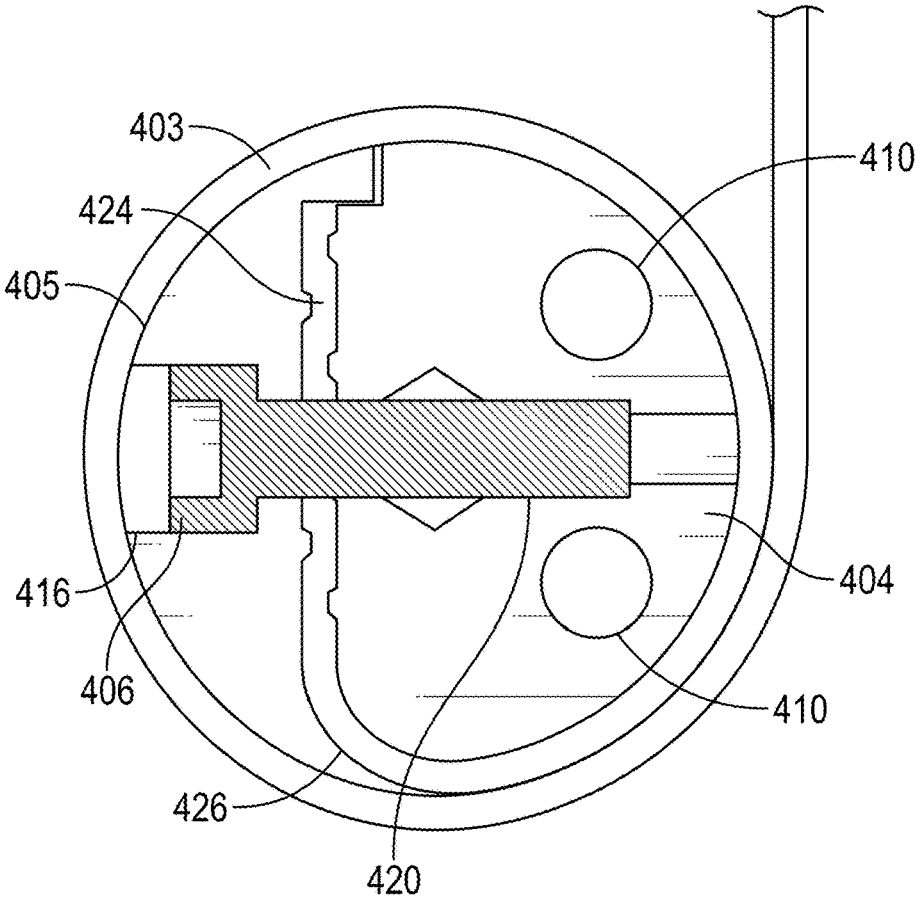
FIG. 8E is a back cross-sectional view illustration of the belt lock attached to a belt, according to some embodiments.

FIG. 8E is a cross sectional view of the belt lock 400 attached to a second lower belt 403. In use, a belt is clamped between the upper piece 405 and lower piece 404. The fastener 406 is then inserted through the fastener aperture 416 and into the tapped hole 420. The fastener may then be tightened to hold the upper piece 405, lower piece 404, and belt in place. The fastener aperture 416 may penetrate the belt positioned within the clamp. In some embodiments, the belt may include a hole for the fastener 406 to pass through. The belt extends through the curved inlet 426 and wraps around the outer surface of the belt lock 400 1 and ¼ times before extending tangentially toward the cam. The overlapping belt helps to evenly distribute the load placed on the belt 403 while also reinforcing the clamping force exerted on the portion of the belt 403 positioned within the belt lock 400. Further, the belt lock 400 ensures that the belt is bent over a radius which is designed and tested for safety. In some embodiments, the radius is ¾ inch.

The hexagonal cutout 408 is used to tension the belt. For example, upon installation of the belt lock 400, a tool, such as an Allen wrench, may be inserted into the hexagonal cutout 408 and rotated such that the belt lock 400 as a whole rotates. This causes the belt to wrap or unwrap from the belt lock 400 to a desired point thus raising or lowering the tension on the belt. This allows for final adjustments of the tension in the belt. In some embodiments, the belt lock 400 may be rotated 90 degrees or less during final adjustments. In some embodiments, the belt lock 400 may be rotated between 90 degrees and 360 degrees. In some embodiments, the belt lock 400 may be rotated greater than 360 degrees.

The versatile design of the belt lock allows for it to be attached to other areas of the exercise device besides the cam. For example, in some embodiments where the pulley assembly and block and tackle system are not used, an end of the lower belt may be attached to the belt lock and the belt lock may be attached directly to an exercise arm of the exercise apparatus. The two bolt holes in belt lock would allow the belt lock to be secured directly to arms. A pulley may be fixed to a top surface of the exercise apparatus housing to direct the lower cable from the cam to the arms. Using the belt lock in this manner has several benefits. For example, as the arm moves, the angle at which the belt lock is positioned relative to the pulley may change. As the belt lock is fixed to the arm, the changing angle causes the lower belt to wrap and unwrap relative to the belt lock as the arm moves. This eliminates the need for a pivot to attach the belt lock to the arm. In some embodiments, the belt lock may be used on each end of a belt to connect two cams together.

Figure 9A:
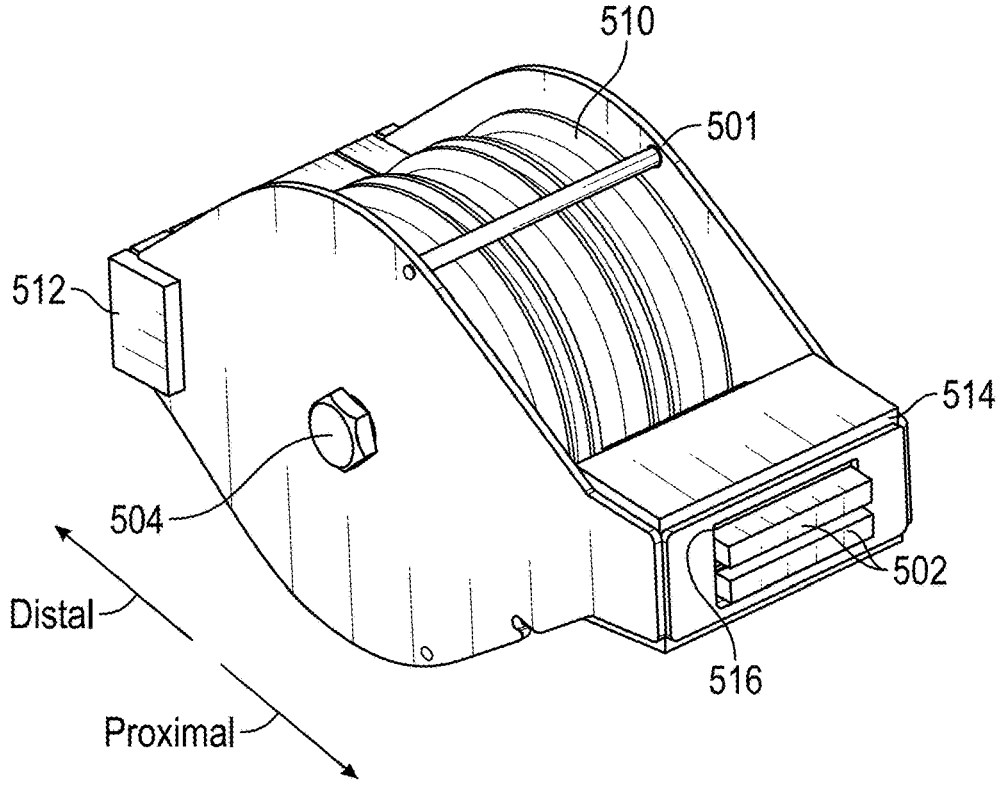
FIG. 9A is a perspective view illustration of a lower pulley assembly, according to some embodiments.
Figure 9B:
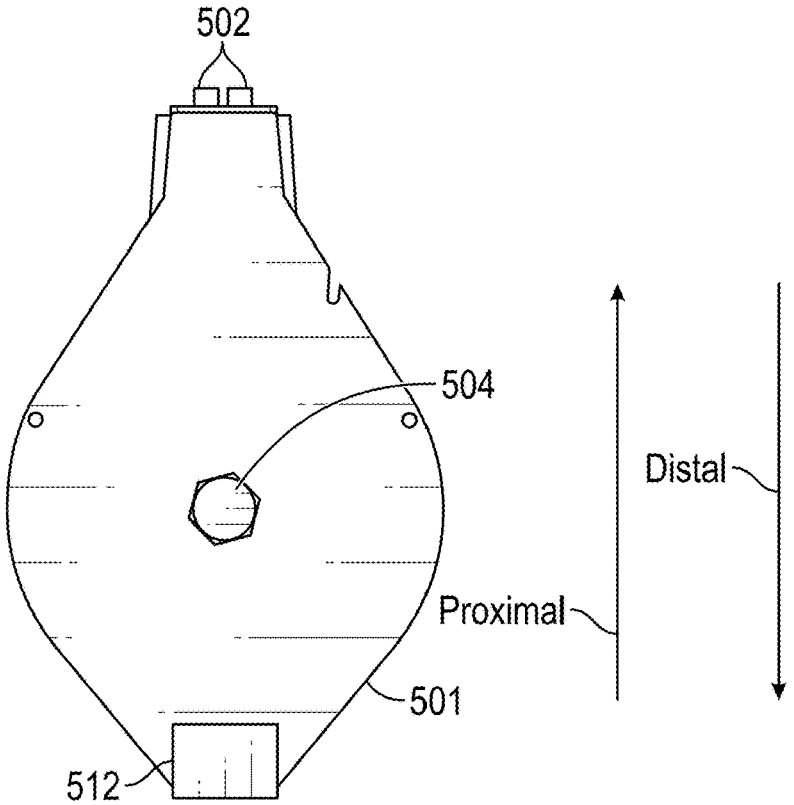
FIG. 9B is a back side view illustration of the lower pulley assembly, according to some embodiments.
Figure 9C:
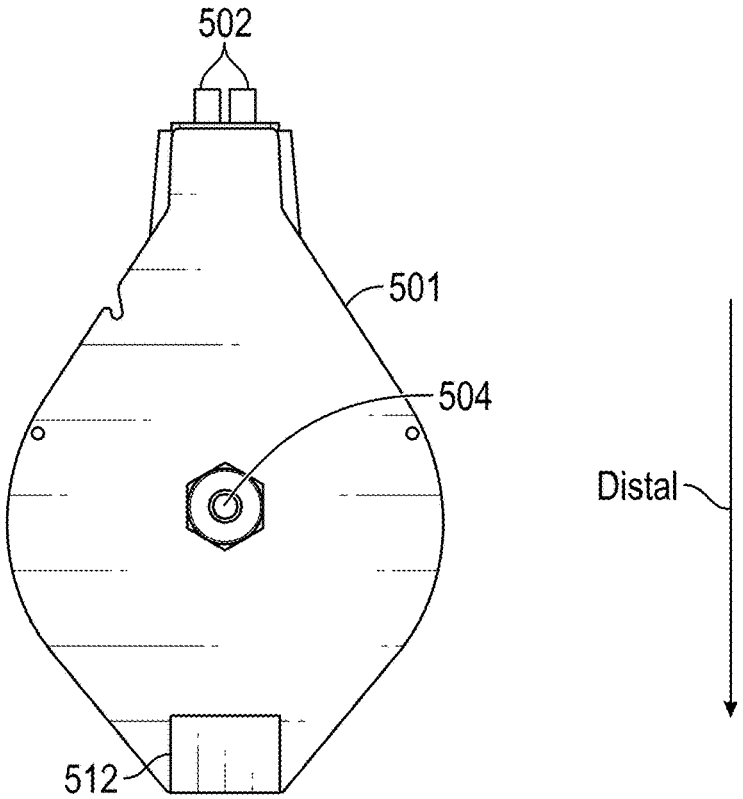
FIG. 9C is a front side view illustration of the lower pulley assembly, according to some embodiments.
Figure 9D:
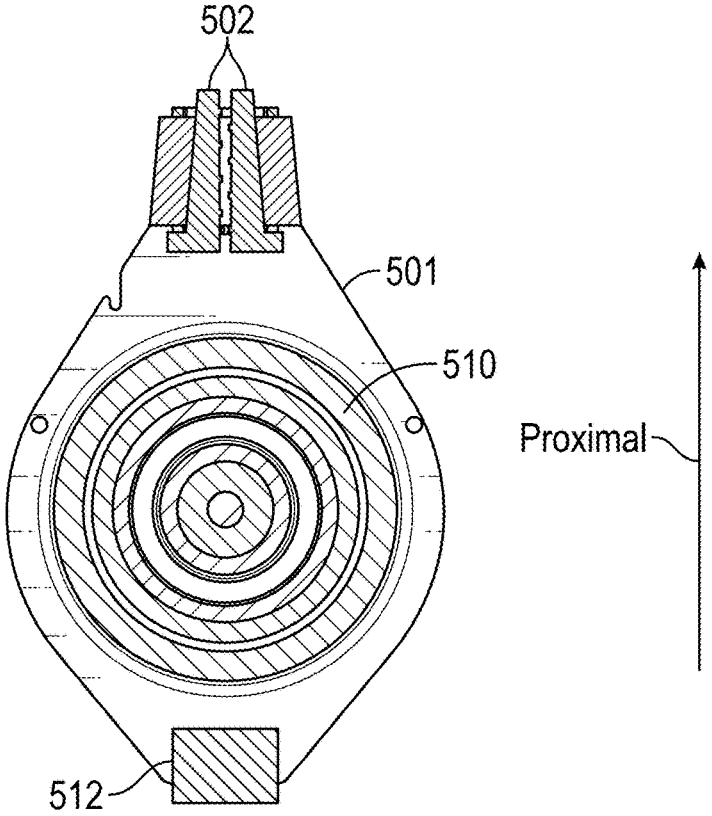
FIG. 9D is a cross sectional view illustration of the lower pulley assembly, according to some embodiments.

FIG. 9A is a perspective view of a lower pulley assembly 500. FIGS. 9B and 9C show a front and backside of the lower pulley assembly 500. FIG. 9D shows a cross sectional view of the lower pulley assembly 500.

A pulley housing 501 includes two ovular shaped plates positioned on either side of three pulley wheels 510. Cross-bars are positioned near the center of the ovular shaped plates and connect the plates together. A backstop 512 is positioned on a distal end of the lower pulley assembly 500 and attaches to the pulley housing 501. The backstop protects the pulley housing 501 from colliding with a stationary pulley/pulleys of the block and tackle system. In some embodiments, the block and tackle system include the lower pulley assembly 500 and two pulleys which are welded to the exercise apparatus housing. A bolt 504 transverses the pulley housing 501 and three pulley wheels 510 to hold the wheels in place. A proximal end of the lower pulley assembly 500 has a clamp hold 514 which is rectangular in shape and attached between each ovular plate of the pulley housing 501. The clamp hold 514 has an aperture 516 for holding belt clamps 502.

The belt clamps 502 include two wedge shaped portions which substantially fit within the aperture 516. The belt clamps 502 have a top flange which rests on a top surface of the clamp hold 514 and prevents the belt clamps 502 from falling through the aperture 516. In use, a belt is clamped between each of the wedge portions of the belt clamps 502. The rectangular shape and design of the belt clamps 502 help to ensure an even distribution of clamping force on the belt. This is especially useful when the belt is a flat or belt shaped. This minimized the chance of the belt breaking or tearing when under tension.

Figure 9E:
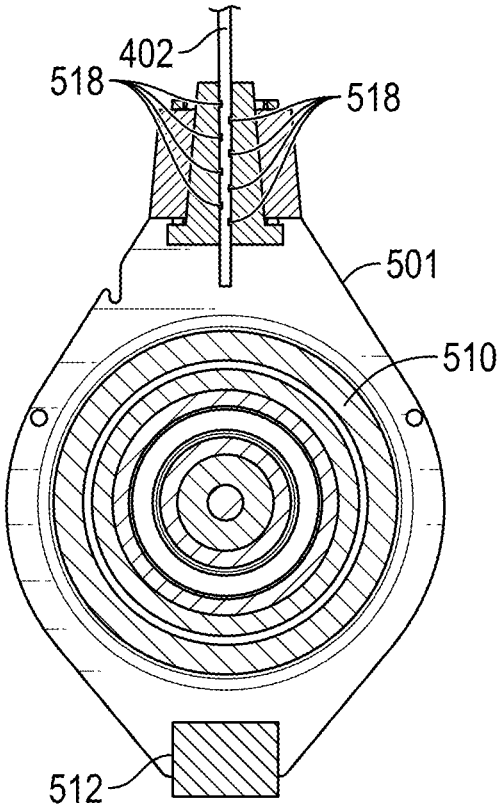
FIG. 9E is a cross sectional view illustration of the lower pulley assembly, according to some embodiments.

In FIG. 9D and 9E, the belt clamp 502 is shown extending through the aperture 516. The aperture 516 is tapered to accommodate the wedge shape of the belt clamps 502 such that the aperture 516 is wider on a distal side and narrower on a proximal side. Each of the belt clamps 502 has four teeth 518 on an inside surface. The teeth 518 help to secure the belt 402 when positioned between the wedge portions. In some embodiments, the belt clamps 502 include one or more teeth each. In some embodiments, the belt clamps 502 include less than 10 teeth each.

During assembly of the lower pulley assembly 500, the first lower belt 402 is threaded through the aperture 516 in the distal direction. The first lower belt 402 is then clamped between the belt clamps 502. The belt clamps 502 and first lower belt 402 are then placed into the aperture 516 in a proximal direction and a force is applied to the first lower belt 402 and the belt clamps 502 in a proximal direction to secure the belt clamps 502 in place. Due to the wedge shape of the belt clamps 502 and the tapered shape of the aperture 516, any proximal force on the first lower belt 402 will cause the belt clamps 502 to move further into the aperture 516 and increase the clamping force on the first lower belt 402.

Figure 10:
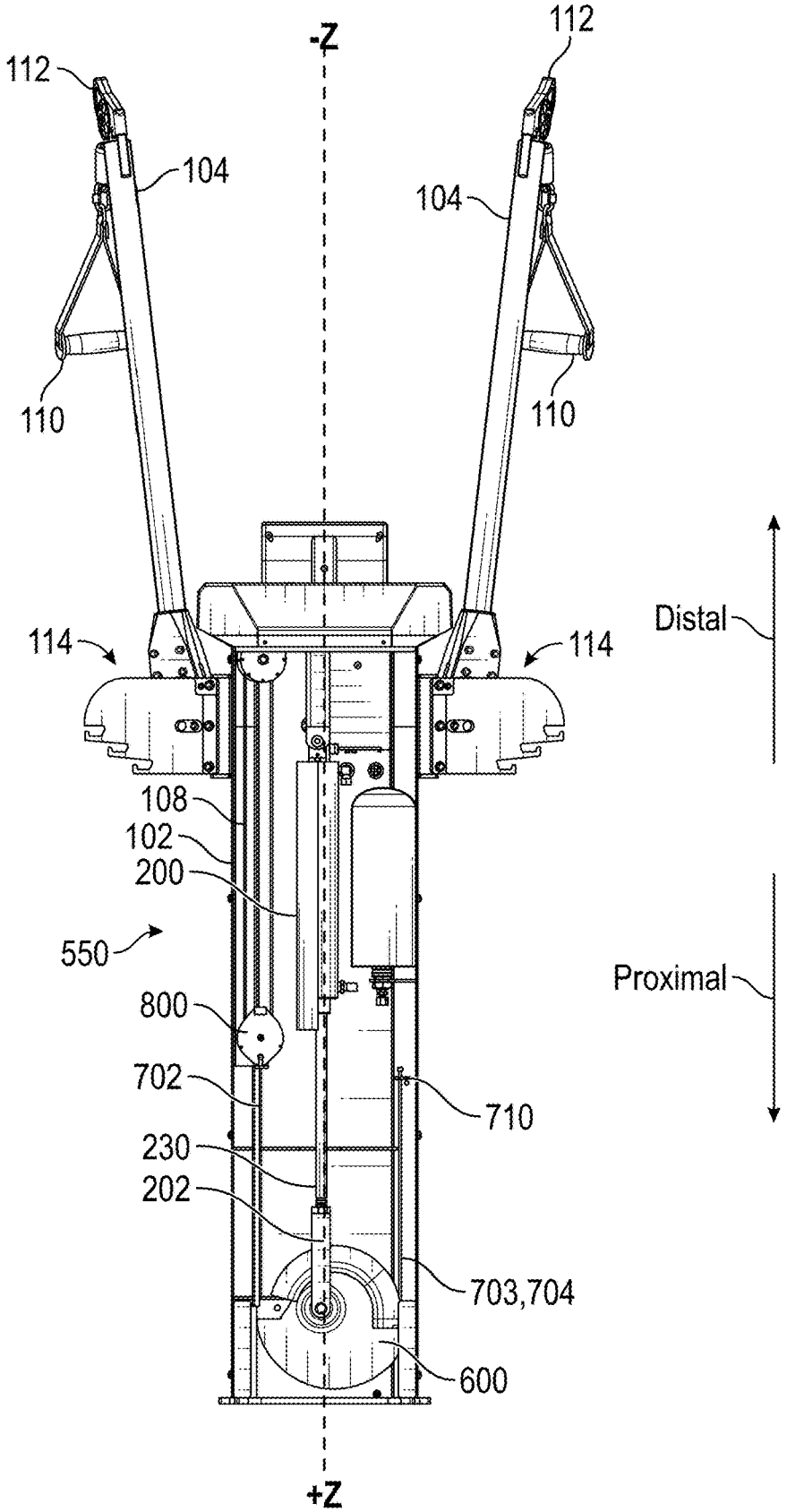
FIG. 10 a back side view illustration of an embodiment of the exercise apparatus with the back panel removed, according to some embodiments.

FIG. 10 a rear view of an embodiment of the exercise apparatus 100 with a back panel removed. As shown, a resistance unit and coupling mechanism 550 are located within the housing 102. The exercise apparatus 100 functions in a similar manner as described in FIGS. 2 and 3.

A coupling mechanism 550 includes a resistance source 200 depicted here as a pneumatic cylinder, a cam 600, a cable key (not shown), a first lower cable 702, a second lower cable 703, a third lower cable 704, a lower pulley assembly 800, and a cable hold 710. The coupling mechanism 150 transfers a resistant force from the resistance source 200 to a user cable 108 to oppose movement of the handle 110 by the user.

A back end of the resistance source 200 is be attached to the housing 102 and positioned along the z-axis as shown. The resistance source 200 is attached to a rod 230 which extends from a front end of the resistance source 200, and a clevis 202 which is attached to a front end of the rod 230. In some embodiments, an accumulator may be attached to the back end of the resistance source 200. In some embodiments, the clevis 202 is connected to the resistance source directly without a rod 230.

The clevis 202 is rotatably coupled with the cam 600. The first lower cable 702 is positioned adjacent an outer surface of the cam 600 and attached on one end to the lower pulley assembly 800. The lower pulley assembly 800 is attached to the user cable 108. The other end of the first lower cable 702 is attached to the cam 600. The second and third lower cables 703, 704 are attached to the cam 600 on one end and attached to the cable hold 710 on the other end. This cable hold 710 may be fixed to the housing 102. In some embodiments, the cable hold 710 is held in place by the tension bolt which is fastened to the housing 102. This tension bolt may be tightened or loosed to adjust the tension exerted on the lower cables 702, 703, and 704.

A handle pulley assembly 112, arm 104, and hinge assembly 114 all function as described in FIG. 2.

According to some embodiments, the lower pulley assembly 800 is optional. In some embodiments, the first lower belt is attached to the handles (e.g. 110 of FIG. 1). In some embodiments, the first lower belt is attached to the user cable (e.g. 108). In some embodiments, the first lower belt is attached to an arm (e.g. 104) of the exercise apparatus. In an example embodiment, a pulley is fixed to a top surface of the exercise apparatus housing to direct the belt toward the arm. In some embodiments, the first lower belt is attached to another cam. The cam may be coupled with the arm of the exercise apparatus.

Figure 11:
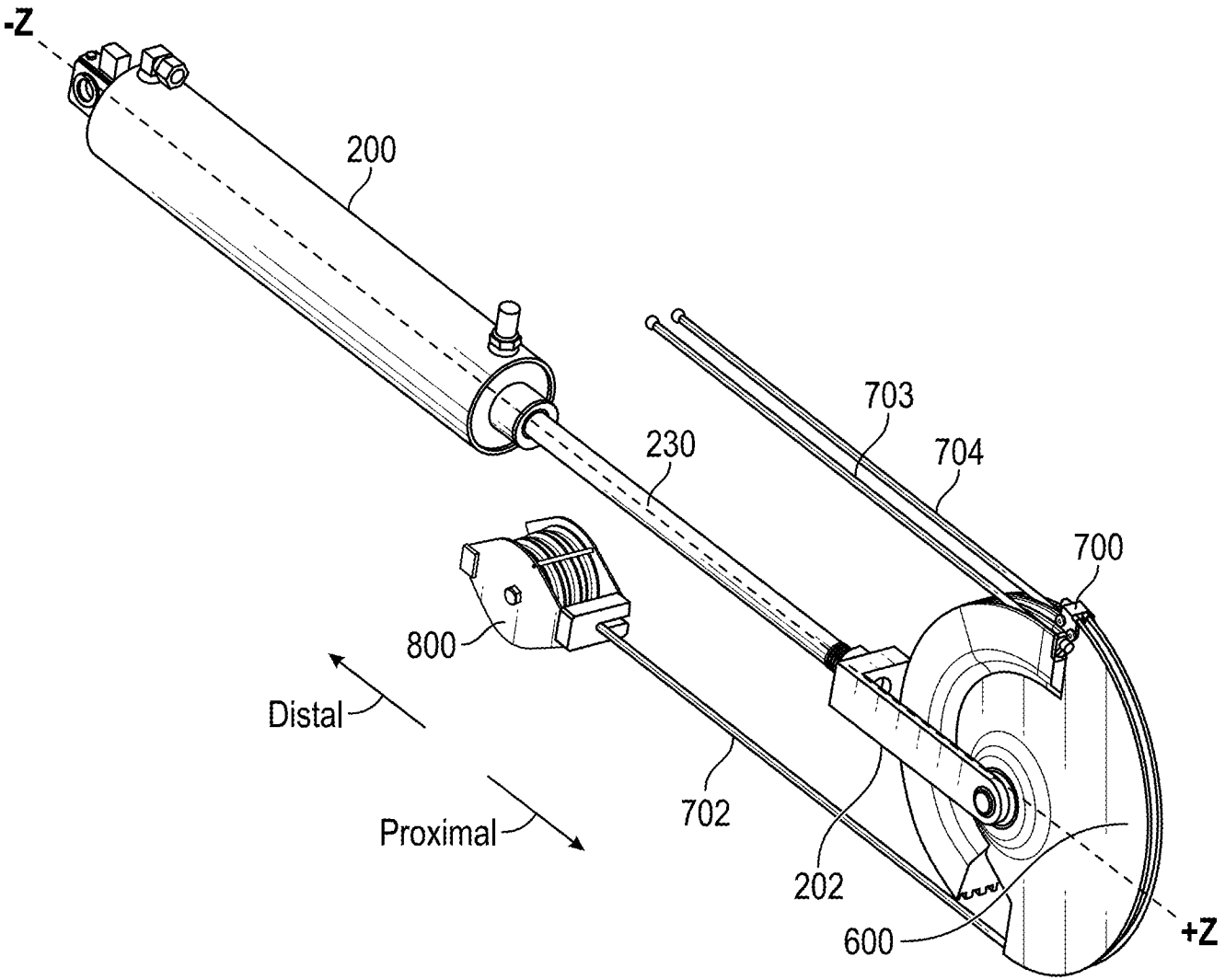
FIG. 11 is a perspective view illustration of the coupling mechanism, according to some embodiments.

FIG. 11 is a perspective view of another embodiment of a coupling mechanism 550 isolated from the rest of the exercise apparatus 100. A resistance source 200 is shown attached to a rod 230 which is attached to a clevis 202. A cam 600 is rotatably attached to the clevis 202. A first cable 702 is attached to the cam 600 by a cable key 700. The first cable 702 extends along an outside surface of the cam 600 and attaches to a lower pulley assembly 800. A user cable (not shown) may be attached to the pulley wheels of the lower pulley assembly 500. A second cable 703 and a third cable 704 are attached to the cam 600 via the cable key 700. The second and third cables 703, 704 extend along an inside surface of the cam 600 and attach to a tension bolt (not shown).

Figure 12:
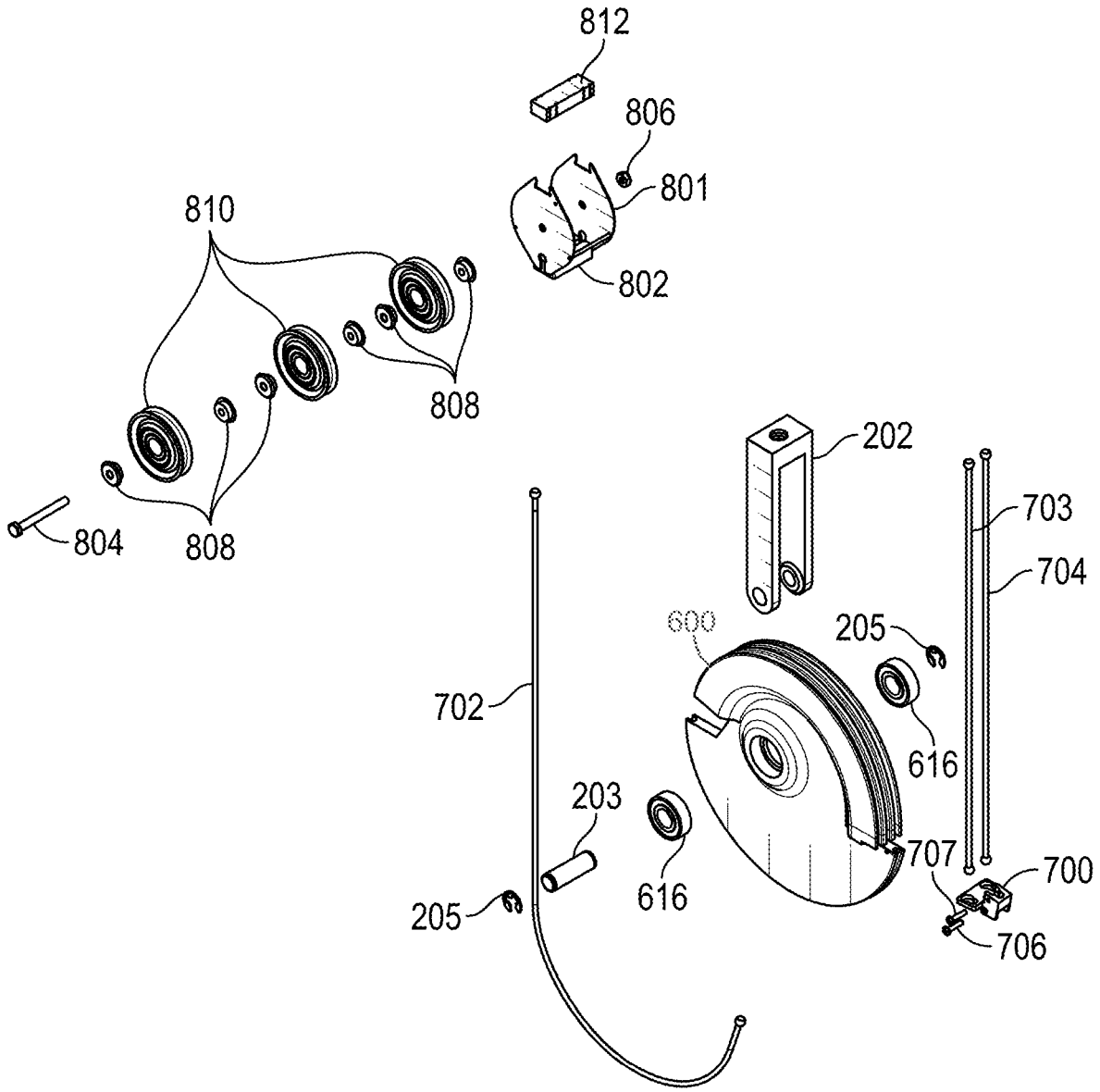
FIG. 12 is an exploded view illustration of the coupling mechanism without the resistance source and rod, according to some embodiments.

FIG. 12 shows an exploded view of the coupling mechanism without the resistance source and rod.

A lower pulley assembly 800 includes a pulley housing 801 which encloses three pulley wheels 810 and several bushings 808 separating the wheels from each other and the pulley housing 801. In this embodiment there are four bushings 808. A bolt 804 and nut 806 secure the bushings 808 and three pulley wheels 810 to the pulley housing 801. The lower pulley assembly 800 further includes a cable hold 802 positioned on a proximal end of the pulley housing 801. The cable hold 802 attaches a lower cable 702 to the pulley housing 801. A backstop 812 is attached to a distal end of the pulley housing 801.

Another end of the first cable 702 wraps around an outer surface of a cam 600 and attaches to a cable key 700. The cable key 700 is fastened to the cam 600 by one or more screws 706. The one or more screws 706 may hold the cables in place. The cable key 700 also attaches to an end of a second cable 703 and an end of a third cable 704. Another end of second cable 703 and third cable 704 attach to a cable hold or a tensioner. The cam 600 has an aperture where two bearings 616 are attached. The cam 600 attaches to a clevis 202 at the aperture.

Figure 13A:
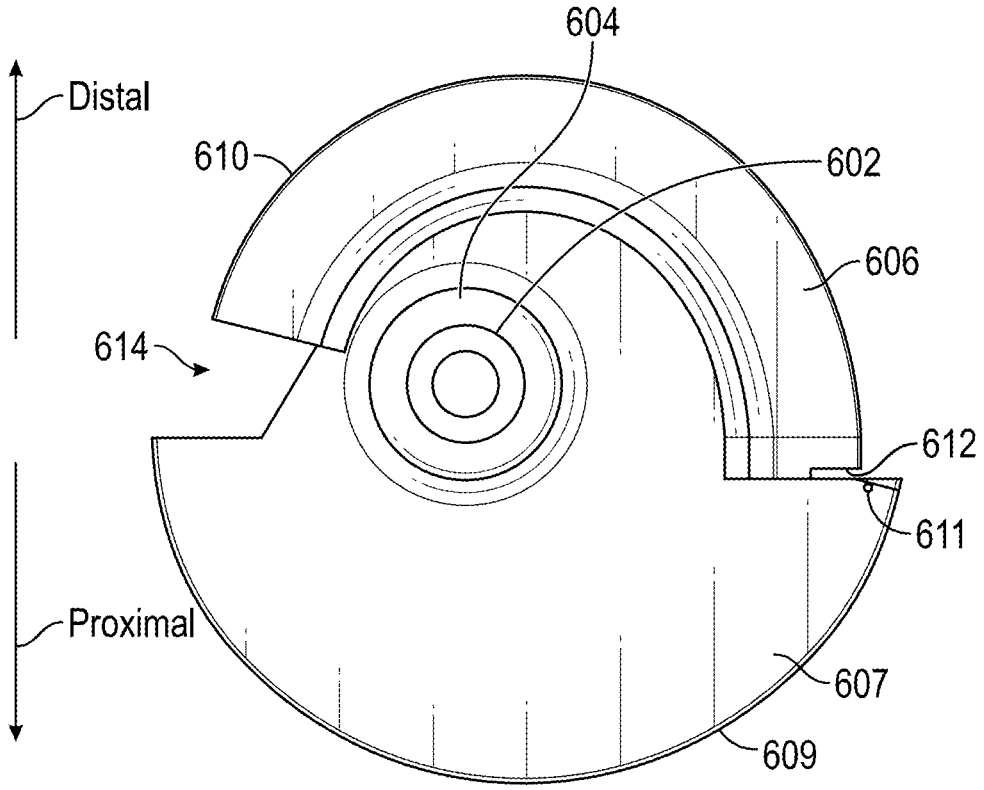
FIG. 13A is a back view illustration of the cam, according to some embodiments.

FIG. 13A is a back view of a cam 600. Although not shown, the front view is symmetrical to the back view. The cam 600 has an outer surface 609 (e.g. first circular segment) which resembles the shape of a semicircle or crescent oriented such that the shape faces a distal direction. The cam 600 has an inner surface 610 (e.g. second circular segment) which resembles the shape of a semicircle or crescent oriented such that the shape faces a proximal direction. The inner surface 610 is smaller than the outer surface 609. The inner surface 610 does not meet the outer surface 609 as it is separated by a first cutout 614 on one side and a second cutout 612 on another side. In some embodiments, the cutouts are rectangular in shape. This gives the cam 600 an appearance of a nonconcentric circle where one half is smaller than the other. A threaded hole 611 traverses the lower surface 607 near the second cutout 612. In some embodiments, the hole 611 is not threaded.

The curvature of both the inner surface 610 and outer surface 609 varies such that it is not consistent. As described above in relation to FIGS. 6A and 6B, the curvature of the inner surface 610 and outer surface 609 of the cam 600 is such that the distance between cables that extend tangentially adjacent from the cam 600 will maintain constant (i.e., D1 of FIGS. 16A-16D) as the cam 600 rotates and moves within each cycle. According to some embodiments, the curvature of each surface may be such that a diameter, made up of a radius of the inner surface 610 and a radius of the outer surface 609, based about an aperture 602 (i.e. axis of rotation) may be constant throughout rotation. In some embodiments, the curvature may be logarithmic.

In certain embodiments, the aperture 602 extends through the cam 600 and is positioned between the outer surface 609 and inner surface 610 so that it is centrally offset. A portion of the cam 600 extends into the aperture 602 to form a bearing rest. Immediately surrounding the aperture 602 is a raised surface 604 which extends radially from the aperture 602. Surrounding the raised surface 604 is a lower surface 607. A chamfer transitions the raised surface 604 to the lower surface 607. The lower surface 607 extends in the proximal direction until it meets the outer surface 609. The lower surface 607 extends in the distal direction until it meets a second raised surface 606. Another chamfer transitions the lower surface 607 to the second raised surface 606. The second raised surface 606 extends distally until meeting the inner surface 610.

Figure 13B:
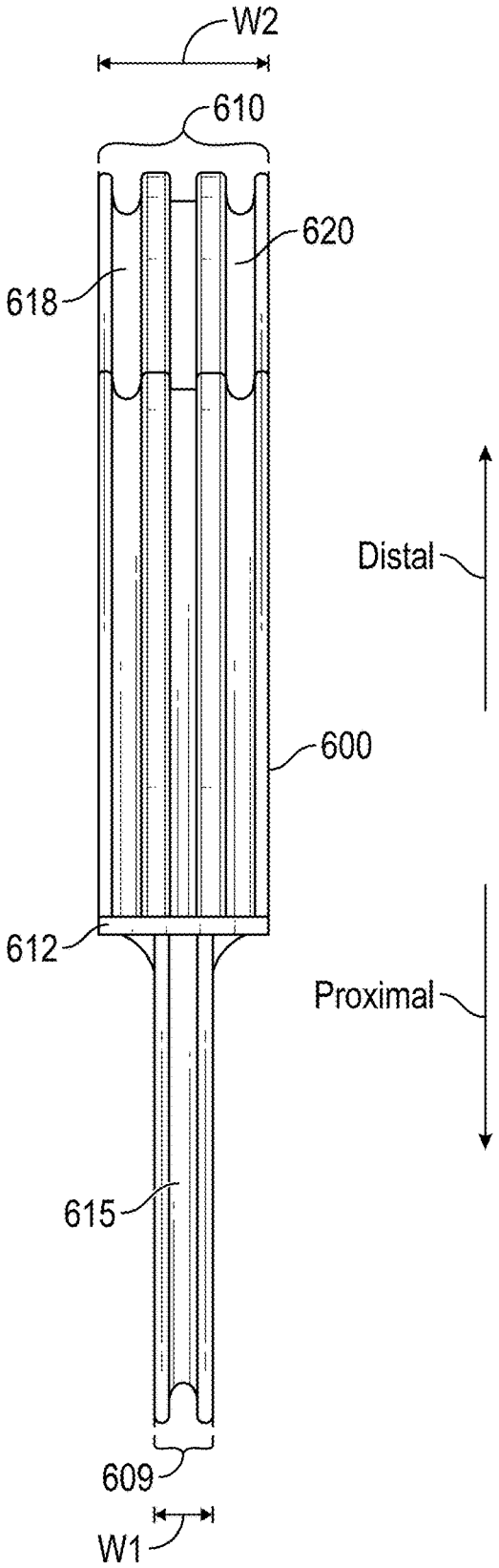
FIG. 13B is a left side view illustration of the cam, according to some embodiments.
Figure 13C:
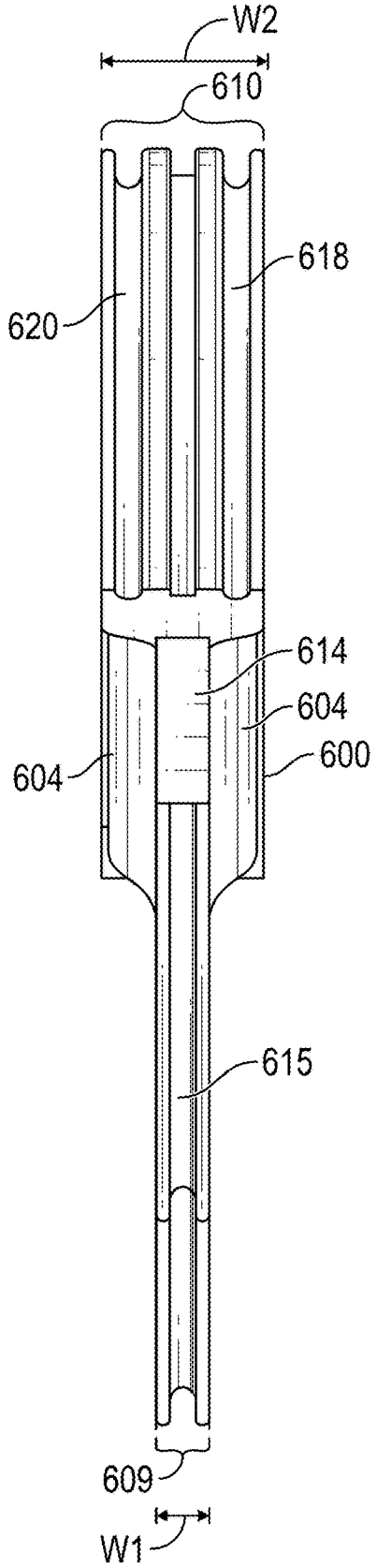
FIG. 13C is a right side view illustration of the cam, according to some embodiments.
Figure 13D:
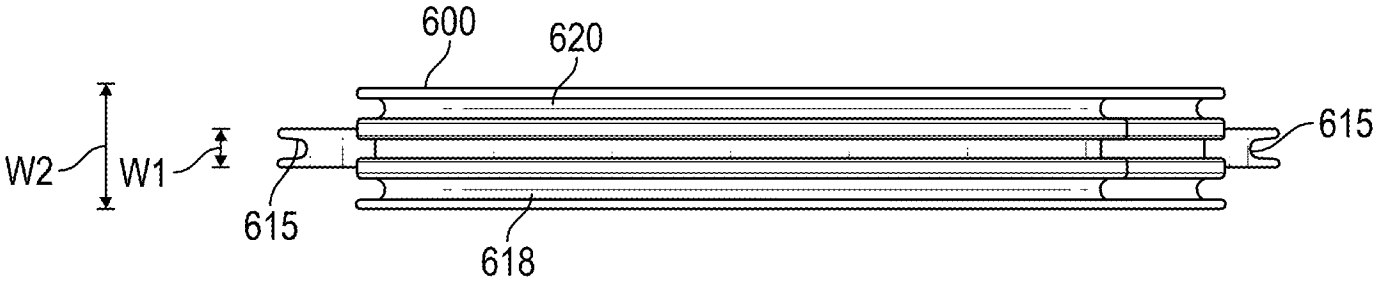
FIG. 13D is a top down view illustration of the cam, according to some embodiments.
Figure 13E:
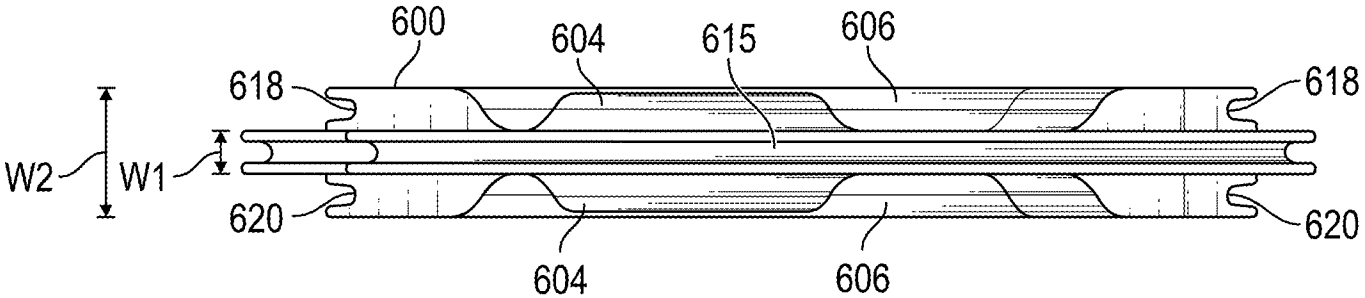
FIG. 13E is a bottom up view illustration of the cam, according to some embodiments.

FIG. 13B is a left side view of the cam 600 and FIG. 13C is a right side view of the cam 600. FIG. 13D is a top down view of the cam 600 and FIG. 13E is a bottom up view of the cam 600. The outer surface 609 is positioned adjacent and perpendicular to the lower surface 607. The inner surface 610 is positioned adjacent and perpendicular to the second raised surface 606. As shown in FIG. 13C the outer surface 609 is separated from the inner surface 610 by the first cutout 614. As shown in FIG. 13B the outer surface 609 is separated from the inner surface 610 by the second cutout 612.

The outer surface 609 includes a first channel 615 where a first cable may be placed. The first channel 615 extends along the full length of the outer surface 609. The inner surface 610 includes a second channel 620 and a third channel 618 where a second and third cable may be placed. The third channel 618 and second channel 620 extend along the full length of the inner surface 610. The first raised surface 604 and second raised surface 606 are shown extending from the lower surface.

A width W1 of the outer surface 609 is smaller than a width W2 of the inner surface 610. Further, the third channel 618 and second channel 620 spaced apart such that the width of the outer surface 609 fits between. Thus, each cable channel does not interfere with the other. In use, this allows for the cam 600 to rotate freely without the outer surface 609 interfering with the second and third cable (see FIGS. 16C and 16D).

FIGS. 14A is a perspective view of a cable key 700. FIG. 14B is a right sideview of the cable key 700. FIG. 14C is a left sideview of the cable key 700. FIG. 14D is a back view of the cable key 700.

The cable key 700 includes a rectangular flat portion 712 which has two slots 714. The cable key 700 further includes an elongated rectangular portion 718 which extends perpendicular to and away from the rectangular flat portion 712. The elongated rectangular portion 718 is traversed by an elongated slot channel 716. Two support walls 724 extend from the elongated rectangular portion 718 in the distal direction and is separated by a gap.

The two slots 714 and the elongated slot channel 716 are designed to accommodate a cable with a ball on one end such as the cables described in the incorporated '538 and '749 patents (e.g. ball ended cables). The two slots 714 and elongated slot channel 716 have a wide portion where the ball may be inserted and a narrow portion to hold the ball in place.

A first hole 720 traverses the two support walls 724. A second hole 722 perpendicularly traverses the elongated rectangular portion 718 and perpendicularly intersects the elongated slot channel 716. The one or more screws 706 is inserted into the first hole 720, which aligns with a threaded hole in a cam 600, and secures the cable key 700 to the cam 600. A second screw 707 is inserted into the second hole 722 which helps to prevent the movement of a first cable 702 after having been inserted into the elongated slot channel 716. In some embodiments, the holes may be tapped or threaded.

Figure 14E:
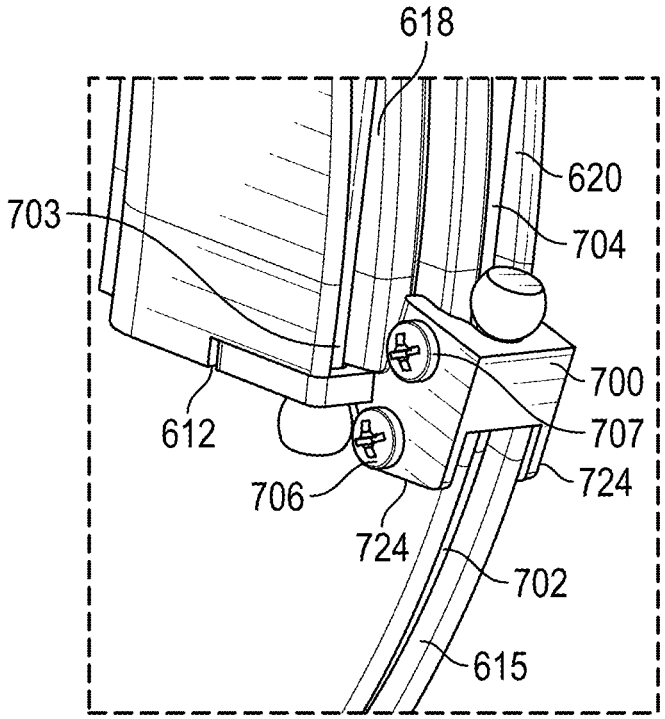
FIG. 14E is a close up perspective view illustration of the cable key attached to the cam, according to some embodiments.

FIG. 14E is a close up view of the cable key 700 attached to the cam 600 and secured in place by the one or more screws 706. The rectangular flat portion 712 is positioned in a second cutout 612 of the cam 600. The two support walls 724 are positioned around a first channel 615 of the cam 600 and help to hold the cable key 700 in place. The first channel 615, second channel 620, and third channel 618 of the cam 600 are located adjacent the cable key 700. Each channel has a cable positioned within, i.e. a first cable 702, second cable 703 and third cable 704. The first cable 702 is positioned within the elongated slot channel 716 and the second cable 703 and third cable 704 are positioned within the two slots 714. A ball is shown extending from the first cable 702 and another ball is shown extending from the second cable 703. The balls lock the cables (e.g. 702, 703, 704) to the cable key 700.

The cable key 700 secures the first cable 702, second cable 703, and third cable 704 to the cam 600 and ensured that the cables stay in the channels of the cam 600 as the cam moves and rotates. According to some embodiments, the process for attaching the cable key to the cam may begin with inserting, from a first direction, the two ball-ended cables into the two adjacent slots of the flat rectangular portion. Next another ball ended cable is inserted into the elongated slot of the elongated rectangular portion of the cable key from a second direction. The flat rectangular portion may then be inserted into the rectangular cutout of the cam. Part of the cam (i.e. the outer surface and first channel 615) is positioned to fit between the two sidewalls which extend from the elongated rectangular portion of the cable key. The cable key is fastened to the cam via the through hole positioned on the two sidewalls. A screw is then fastened in the second through hole positioned on the elongated rectangular portion which secures the ball cable in the elongated slot.

Figure 15:
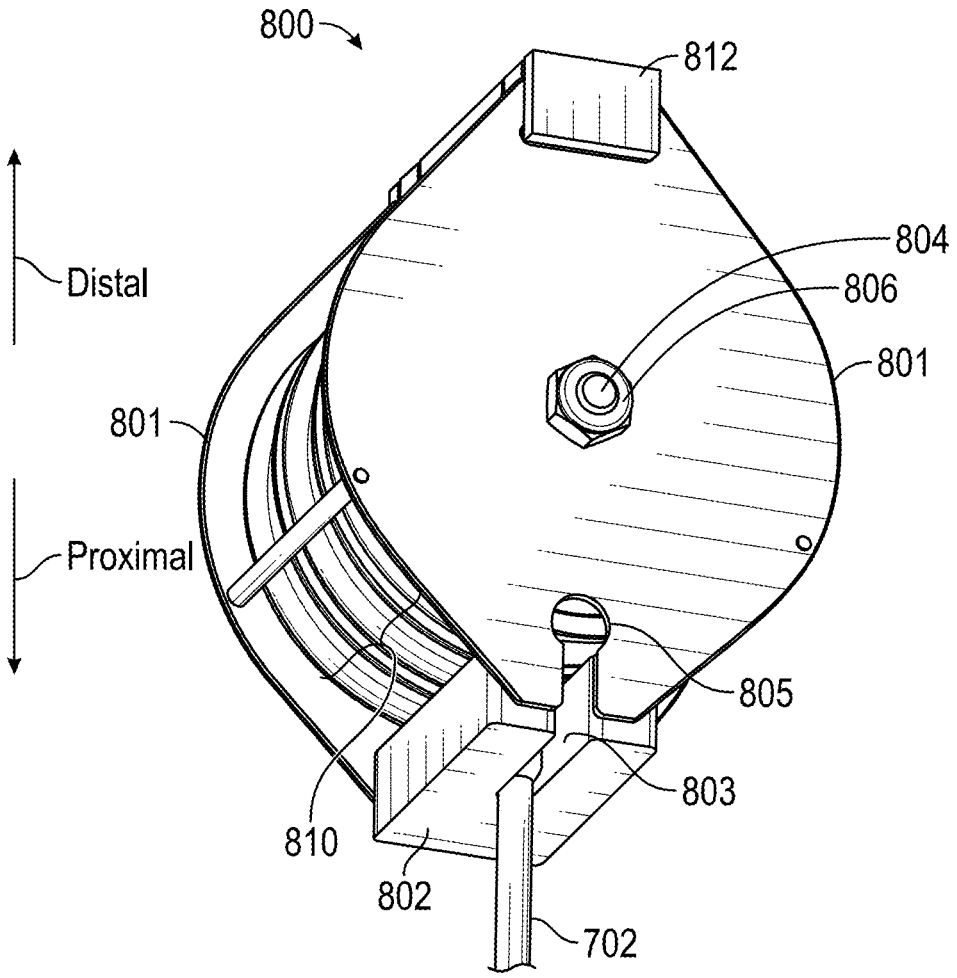
FIG. 15 is a perspective view illustration of the lower pulley assembly, according to some embodiments.

FIG. 15 is a perspective view of a pulley housing 801. The pulley housing 801 includes two ovular shaped plates positioned on either side of the pulley wheels 810. Crossbars are positioned near the center of the ovular shaped plates and connect the plates together. A backstop 812 is positioned on a distal end of the lower pulley assembly 800 and attaches to the pulley housing 801. Three pulley wheels 810 are positioned within the pulley housing 801 along with several bushings. A bolt 804 transverses the pulley housing 801 and three pulley wheels 810 to hold the wheels and bushings in place. The cable hold 802 is positioned at the proximal end of the lower pulley assembly 800. The cable hold 802 is rectangular in shape and attached between each ovular plate of the pulley housing 801. The 802 has a slot 803 where the first cable 702 is inserted. As described above, the cables may have a ball on each end. The cable ball prevents the first cable 702 from detaching from the cable hold 802 as the cable ball is larger that the slot 803. One of the ovular plates includes a cutout 805 which allows for the cable ball to be inserted above the cable hold 802 while allowing the rest of the first cable 702 to pass through the slot 803.

Figure 16A:
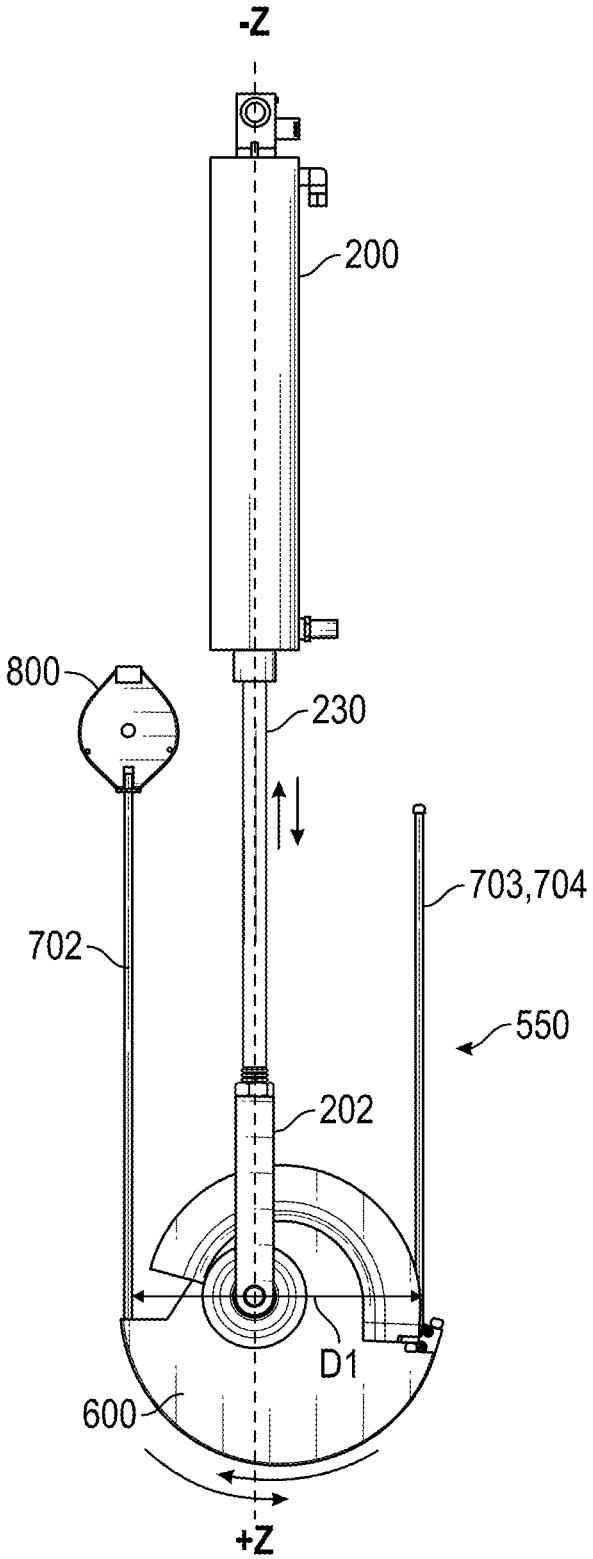
FIG. 16A is a back side view illustration of the coupling mechanism in a neutral position, according to some embodiments.
Figure 16B:
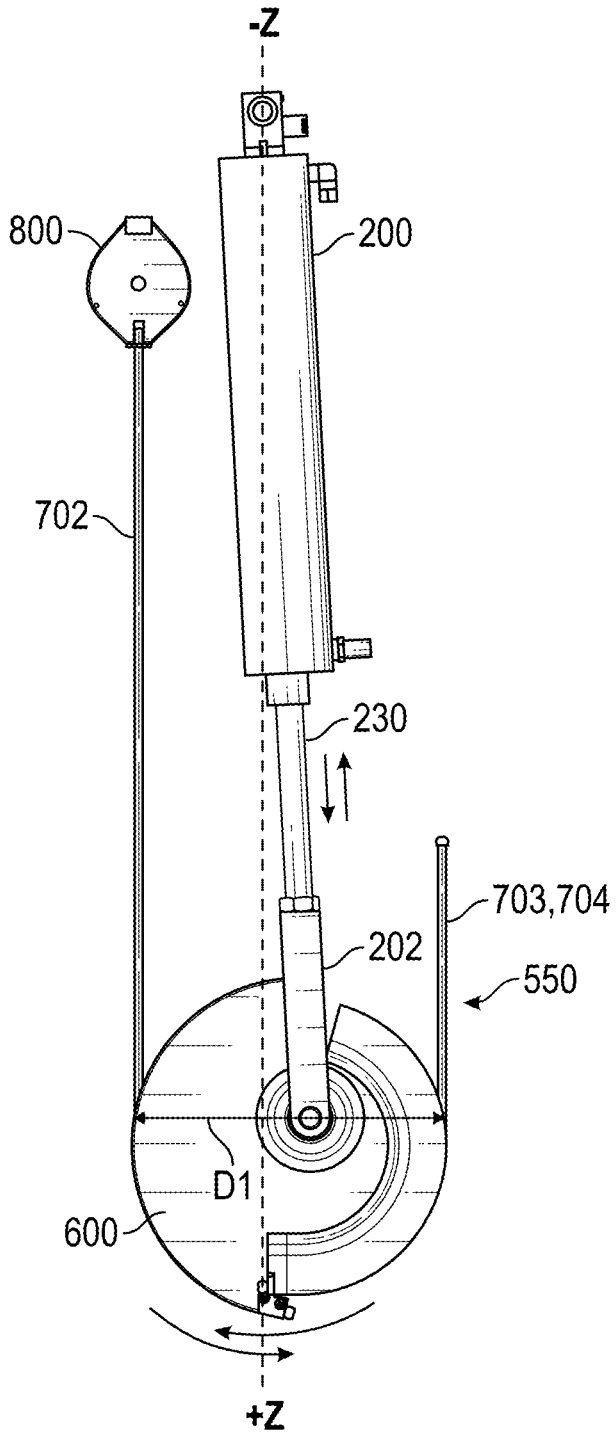
FIG. 16B is a back side view illustration of the coupling mechanism in a rotated position, according to some embodiments.

FIG. 16A shows the coupling mechanism 550 in a neutral position while FIG. 16B shows the coupling mechanism 550 in a rotated position.

In the neutral position, the resistance source 200, rod 230, clevis 202, and aperture of a cam 600 align substantially with the z-axis. As force is applied to the lower pulley assembly 800 via a user cable attached to the pulley wheels (not shown), the lower pulley assembly 800 moves in the-z direction parallel to the z-axis. As a result, the cam 600 rotates in a clockwise direction and about the aperture (i.e. rotational axis, axis of rotation) or attachment point with the clevis 202. Additionally, the cam 600, clevis 202, and rod 230 move in a −z direction toward the resistance source 200. As this movement happens, the nonuniform curvature of the inside and outside surfaces causes the resistance source 200 to rotate about an attachment point (i.e. second axis) with a housing which causes the cam 600 to move out of alignment with the z-axis. The curvature of an outside and inside surface of the cam 600 is designed to accommodate this movement and ensure that the force vectors acting through a first cable 702, second cable 703, and third cable 704 remain vertical.

As the force on the lower pulley assembly 800 is relaxed, the lower pulley assembly 800 moves vertically in the +z direction back to the position in FIG. 16A. Similarly, the cam 600 moves in the +z direction, rotates counterclockwise, and moves back into alignment with the z-axis as the resistance source 200 rotates about the attachment point with the housing.

Two cables 703, 704 are positioned on one side of the axis of rotation of the cam 600 to account for the discrepancy in force exerted on that side, in a rotated state, as opposed to the side with a single cable 702. As the cam 600 rotates about its axis, it also rotates about the second axis, while also moving toward the resistance source. During this movement, the distance between the rotational axis of the cam and the tangent contact points of cables 703, 704 shortens and the distance between the rotational axis and the tangent contact point of the first cable 702 increases thus resulting in a larger force acting on cables 703, 704. Meanwhile, the force acting on the first cable 702 remains constant throughout the cycle of movement. According to some embodiments, the curvature of the inside and outside surfaces on the cam vary such that the force acting on the first cable 702 increases or decreases throughout the cycle of movement.

In some embodiments, the load experienced by the cables 703, 704 is twice the load experienced by cable 702. In some embodiments, cables 703, 704 are rated to withstand up to 12,500 lbs.

The curvature of the surfaces of the cam 600 are such that a distance D1 between the cables 702 and 703,704 contacting the cam 600 is constant as the cam 600 rotates. This distance can also be expressed as the horizontal distance between parallel portions of cable 702 and cables 703, 704. Keeping D1 constant ensures that the first cable 702 remains parallel to cables 703, 704 and that the loads acting on the cables remain parallel. Thus, as the cam rotates from a neutral position, cables 702, 703, and 704 will remain vertical, or in-line, while the resistance source 200, rod 230, clevis 202, and cam 600 move out of line. This may ensure that the directional components of forces acting on the block and tackle pulley system remain constant throughout rotation.

Figure 16C:
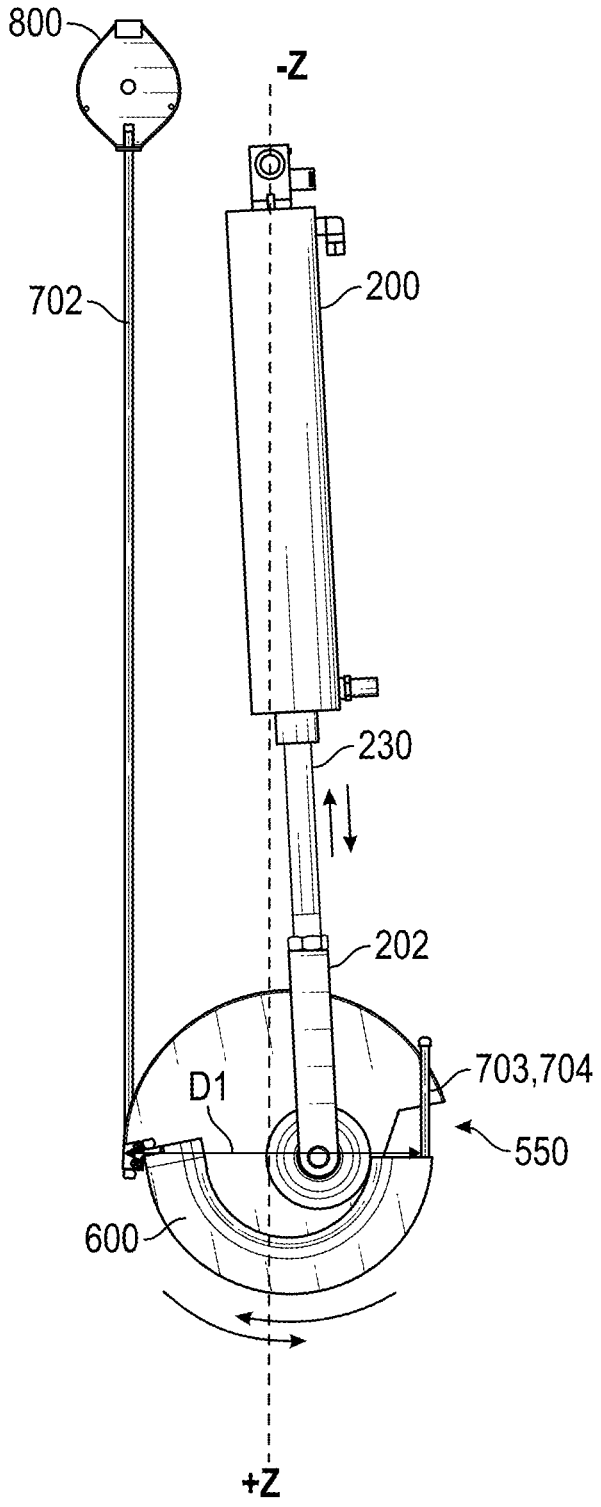
FIG. 16C is a back side view illustration of the coupling mechanism in a further rotated position, according to some embodiments.
Figure 16D:
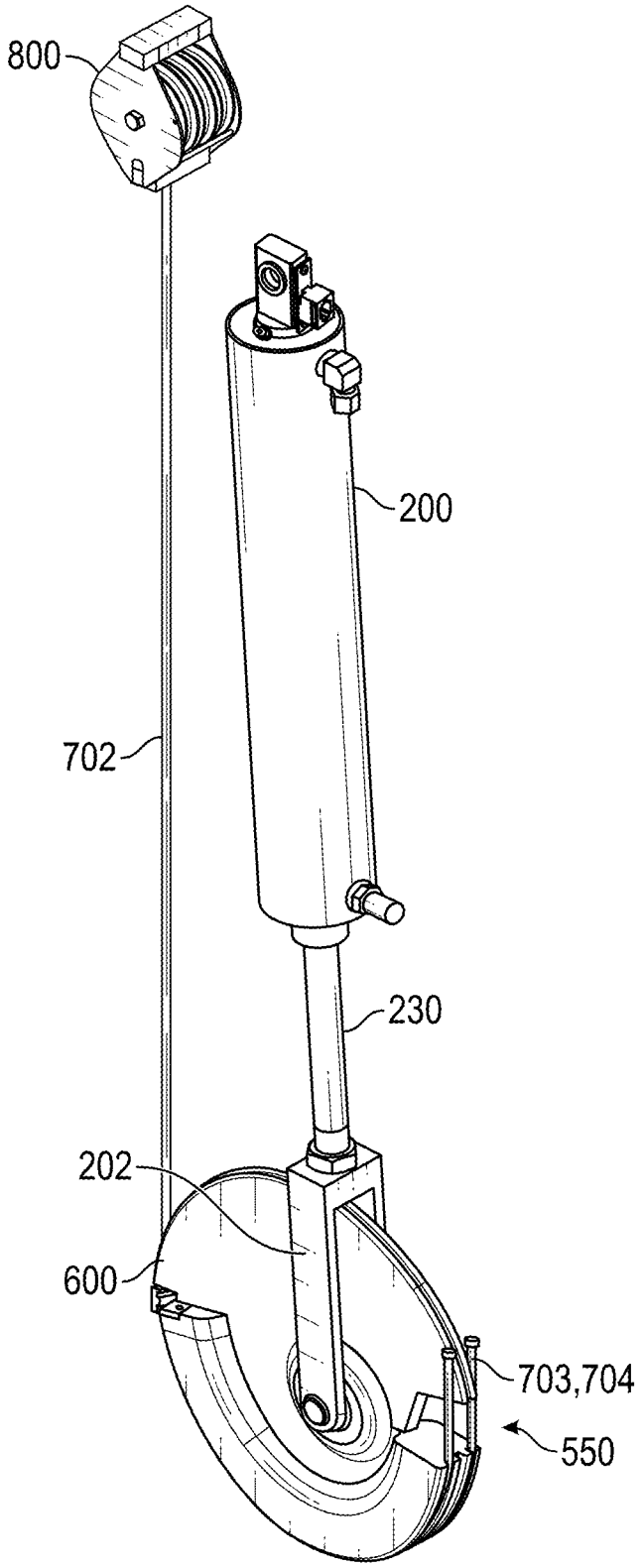
FIG. 16D is a perspective view illustration of the coupling mechanism in a further rotated position, according to some embodiments.

FIG. 16C shows the coupling mechanism 550 rotated to a further position. FIG. 16D is a perspective view of the coupling mechanism 550 rotated to the further position. The cam 600 is rotated so that an outer surface extends through the clevis 202 and between cables 703, 704. Thus this cam 600 can rotate further, compared to other similar designs, because of the shape of the outer surface and the use of two cables on one side. In use, this allows for more of the outer and inner surfaces of the cam to be utilized. In some embodiments, the cam 600 rotates greater than 90 degrees and less than 180 degrees. In some embodiments, the cam 600 rotates greater than 180 degrees and less than 270 degrees. In some embodiments, the cam 600 rotates 220 degrees. In some embodiments, the cam 600 rotates 90 degrees.

Figure 17:
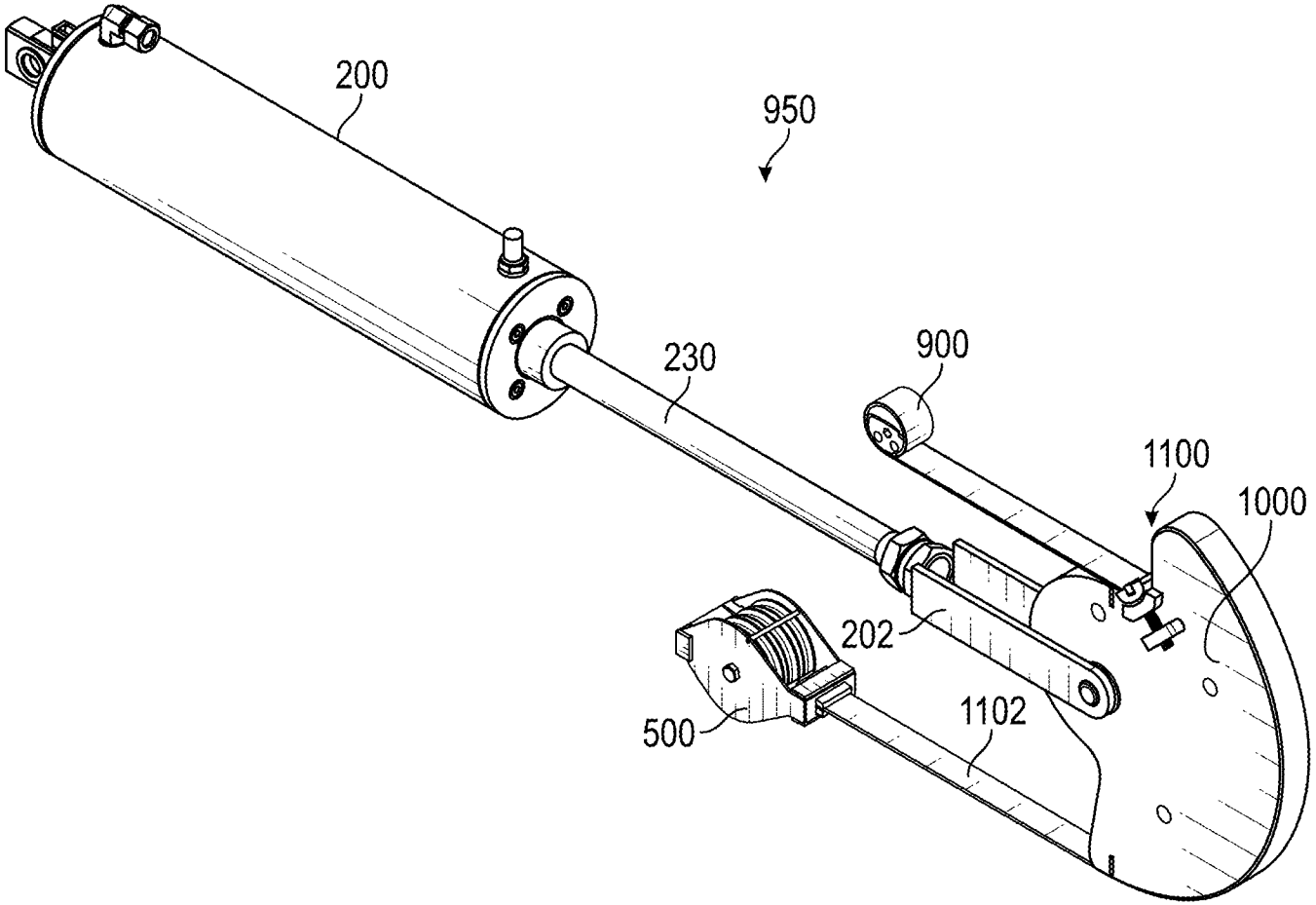
FIG. 17 is a perspective view illustration of the coupling mechanism, according to some embodiments.

FIG. 17 is a perspective view of another embodiment of a coupling mechanism 950 isolated from the rest of the exercise apparatus 100. This coupling mechanism 950 could be used in any of the exercise apparatus 100 described in FIG. 1, 2, 3, or 10. A resistance source 200 is shown attached to a rod 230 which is attached to a clevis 202. A cam 1000 is rotatably attached to the clevis 202. A belt 1102 is attached to the cam 1000 by a rounded belt clamp apparatus 1100. A first end of the belt 1102 extends along an outside surface of the cam 1000 and attaches to a lower pulley assembly 500. A user cable (not shown) may be attached to the pulley wheels of the lower pulley assembly 500. A second end of the belt 1102 extends along an inner surface of the cam 1000 and attaches to a belt lock 900.

According to some embodiments, the lower pulley assembly 500 is optional. In some embodiments, the first lower belt is attached to the handles (e.g. 110 of FIG. 1). In some embodiments, the first lower belt is attached to the user cable (e.g. 108).

Figure 18:
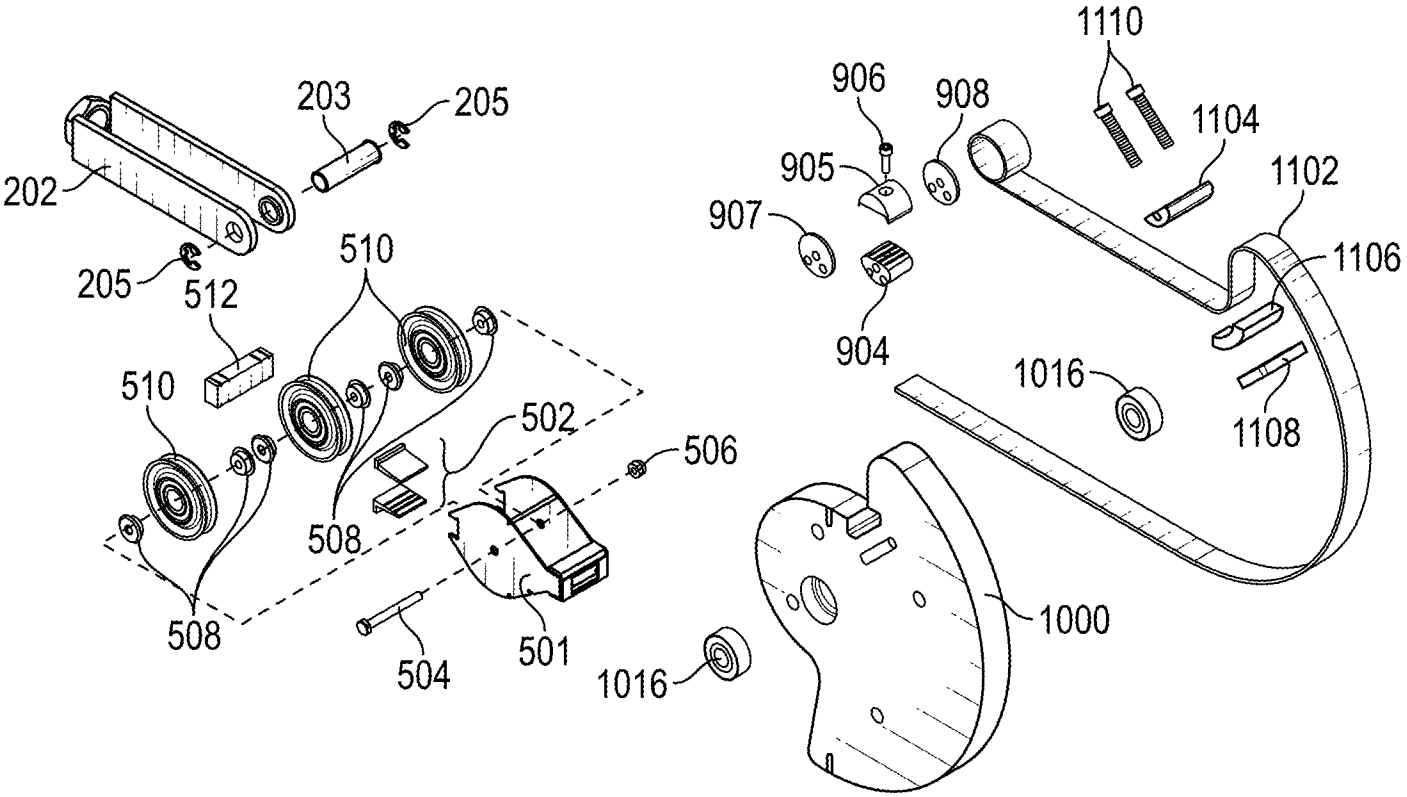
FIG. 18 is an exploded view illustration of the coupling mechanism without the resistance source and rod, according to some embodiments.

FIG. 18 shows an exploded view of the coupling mechanism without a resistance source and rod.

A cam 1000 includes a central aperture and several cutouts. Two bearings 1016 attach to the aperture. A shaft 203 is inserted through the aperture and two bearings 1016 to attach the cam 1000 to a clevis 202. Clips 205 are positioned on each side of the shaft 203 secure the shaft 203 in place. The cam 1000 may be a single unitary piece of material.

The cam 1000 attaches to a rounded belt clamp apparatus 1100. The rounded belt clamp apparatus 1100 includes a clamp plate 1108, a receiver portion 1106, a half round portion 1104, and two fasteners 1110 such as socket head screws. The rounded belt clamp apparatus 1100 is attached to the cam 1000 and clamps a belt 1102 to the cam 1000.

A belt lock 900 attaches to an end of the belt 1102. The belt lock 900 includes a upper piece 905, a lower piece 904, and a fastener 906 to secure the pieces together. The belt lock 900 further includes front and back plates 907, 908 which attach to and cover a front and back side of the belt lock 900. Apart from the front and back plates 907, 908, the belt lock 900 may be the same as the other belt locks described herein (i.e. 400 of FIGS. 8A-8E).

A lower pulley assembly 500 (i.e. FIGS. 9A-9E) attaches to another end of the belt 1102. The lower pulley assembly 500 includes a pulley housing 501 which encloses three pulley wheels 510 and several bushings 508 separating the wheels from each other and the pulley housing 501. In this embodiment there are four bushings 508. A bolt 504 and nut 506 secure the bushings 508 and three pulley wheels 510 to the pulley housing 501. The lower pulley assembly 500 further includes belt clamps 502 positioned on a proximal end of the pulley housing 501. The belt clamps 502 attach the belt 1102 to the pulley housing 501. A backstop 512 is attached to distal end of the pulley housing 501.

Figure 19A:
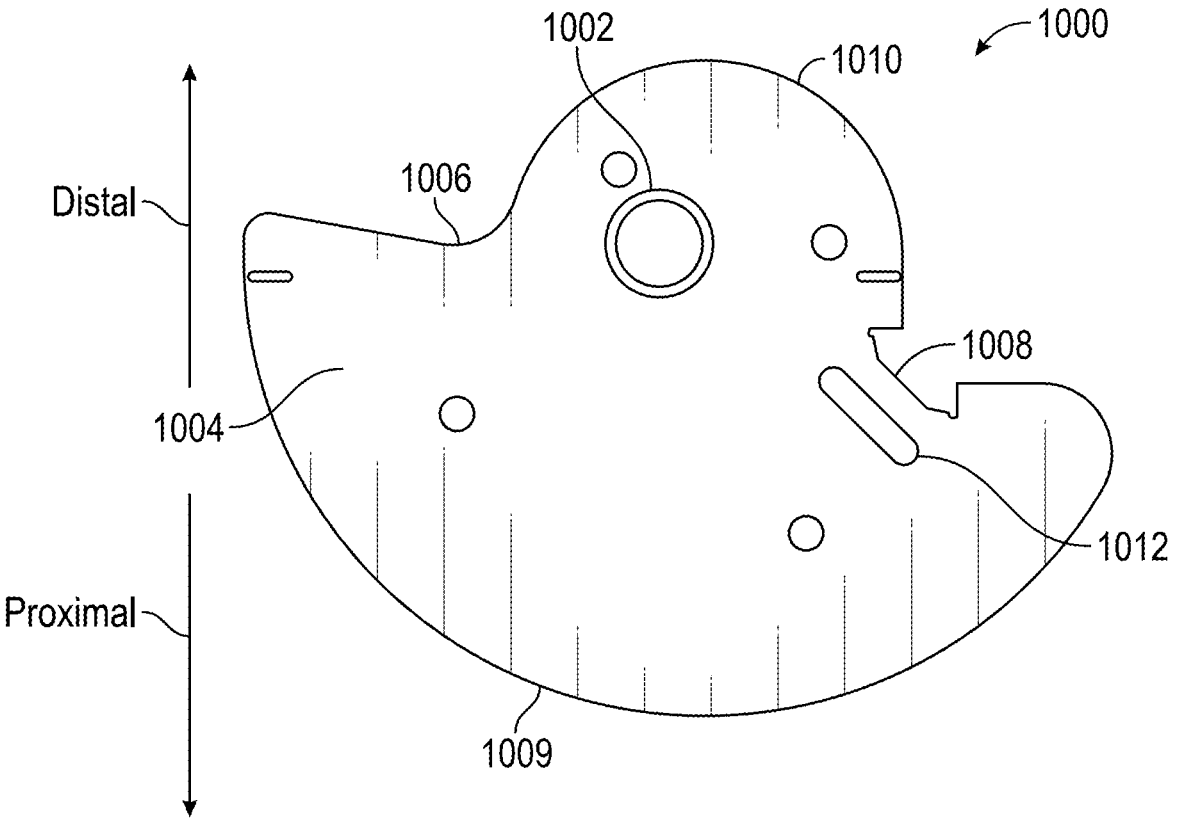
FIG. 19A is a back view illustration of the cam, according to some embodiments.

FIG. 19A is a back side view of a cam 1000. Although not shown, the front side view is symmetrical to the back side view in the illustrated embodiment. The cam 1000 has a back surface 1004, a front surface (not shown), an outer surface 1009 and an inner surface 1010. The outer surface 1009 can resemble the shape of a semicircle or crescent oriented such that the shape faces a distal direction (e.g. first circular segment). The cam 1000 has an inner surface 1010 which resembles the shape of a semicircle or crescent oriented such that the shape faces a proximal direction (e.g. second circular segment). The inner surface 1010 is smaller than the outer surface 1009. The inner surface 1010 does not meet the outer surface 1009 as it is separated by a receiver cutout 1008 on one side and an arcuate cutout 1006 on another side. This gives the cam 600 an appearance of a nonconcentric circle where one half is smaller than the other. A plate cutout 1012 is positioned adjacent and parallel to the receiver cutout 1008.

The curvature of both the inner surface 1010 and outer surface 1009 varies such that it is not consistent. As described above in relation to FIGS. 6A and 6B, the curvature of the inner surface 1010 and outer surface 1009 of the cam 1000 is such that the distance between portions of the belt which extends tangentially adjacent from either side of the cam 1000 will maintain constant (i.e. D2 of FIGS. 21A-21B) as the cam 1000 rotates and moves within each cycle. According to some embodiments, the curvature of each surface may be such that a diameter, made up of a radius of the inner surface 1010 and a radius of the outer surface 1009, based about an aperture 1002 (i.e. axis of rotation) may be constant throughout rotation. In some embodiments, the curvature may be logarithmic.

The aperture 1002 extends through the cam 1000 and is positioned between the outer surface 1009 and inner surface 1010 such that it is centrally offset. A portion of the cam 1000 extends into the aperture 1002 to form a bearing rest. Immediately surrounding the aperture 1002 on the front and back side is the front/back surface 1004 which is flat. The front/back surface 1004 extends in the proximal direction until it meets the outer surface 1009. The front/back surface 1004 extends in the distal direction until it meets inner surface 1010. In some embodiments, the cam 1000 does not include the receiver cutout 1003 or the plate cutout 1012 but is instead a solid piece.

Figure 19B:
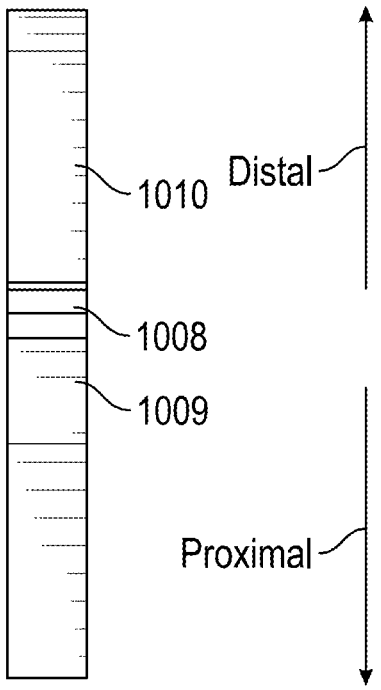
FIG. 19B is a left side view illustration of the cam, according to some embodiments.
Figure 19C:
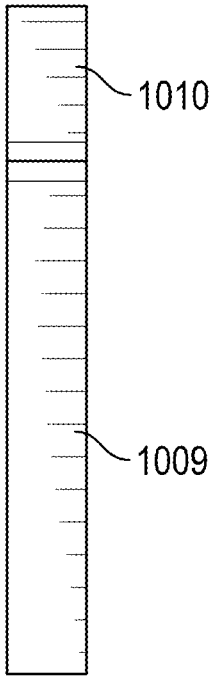
FIG. 19C is a right side view illustration of the cam, according to some embodiments.
Figure 19D:
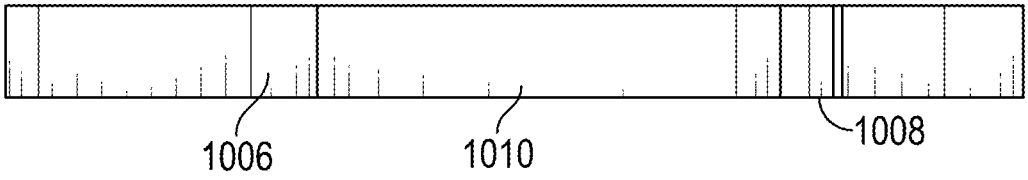
FIG. 19D is a top-down view illustration of the cam, according to some embodiments.
Figure 19E:
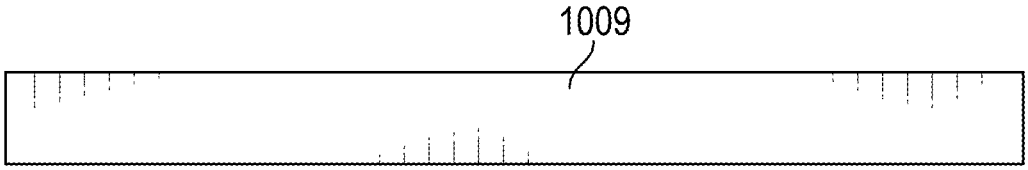
FIG. 19E is a bottom-up view illustration of the cam, according to some embodiments.

FIG. 19B is a left side view of the cam 1000 and FIG. 19C is a right side view of the cam 1000. FIG. 19D is a top down view of the cam 1000 and FIG. 19E is a bottom up view of the cam 1000. The outer surface 1009 is positioned adjacent and perpendicular to the front/back surfaces 1004. As shown in FIG. 19C the outer surface 1009 is separated from the inner surface 1010, however the arcuate cutout 1006 is not visible. As shown in FIG. 19D the outer surface 1009 is separated from the inner surface 1010 by the 1008.

In use, the belt is attached at the receiver cutout 1008. An end of the belt extends from the receiver cutout 1008 and contacts the inner surface 1010 before extending, tangentially adjacent, from the curvature of the inner surface 1010 to a belt lock. Another end extends from the receiver cutout 1008 to contact and wrap around the outer surface 1009 before extending, tangentially adjacent, from the curvature of the outer surface 1009 to a pulley assembly.

Figure 20A:
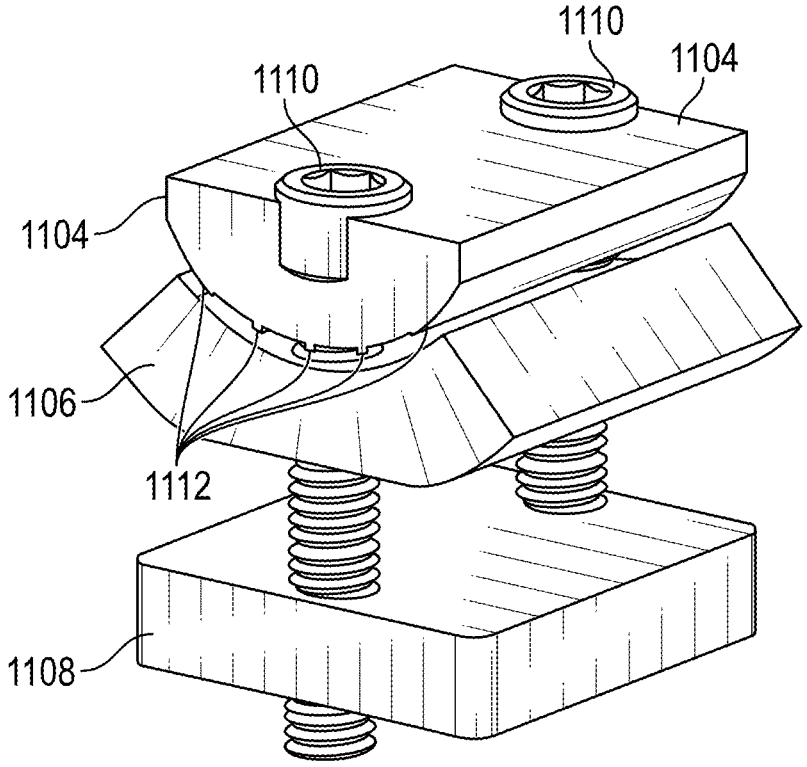
FIG. 20A is a perspective view illustration of a rounded belt clamp apparatus, according to some embodiments.
Figure 20B:
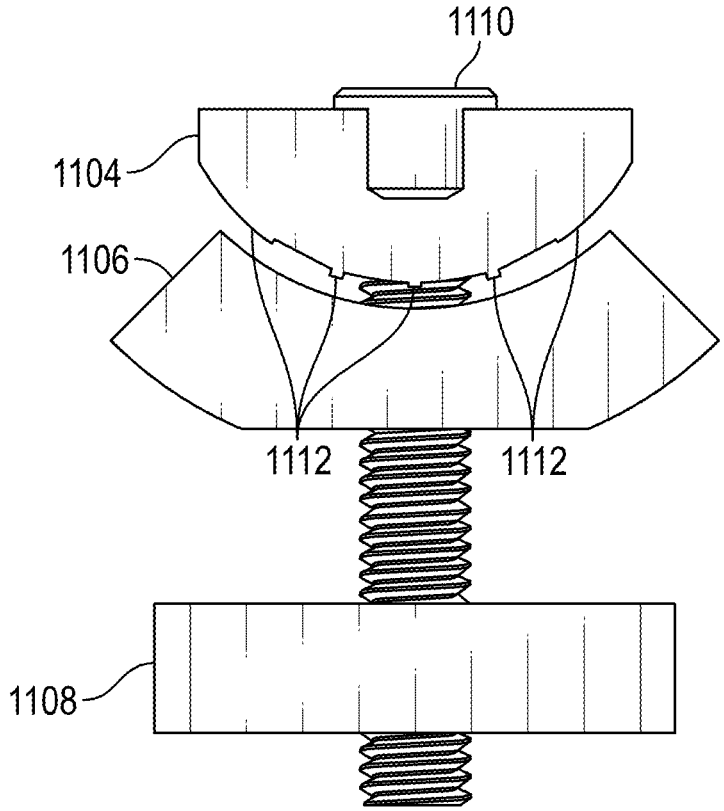
FIG. 20B is a back view illustration of the rounded belt clamp apparatus, according to some embodiments.
Figure 20C:
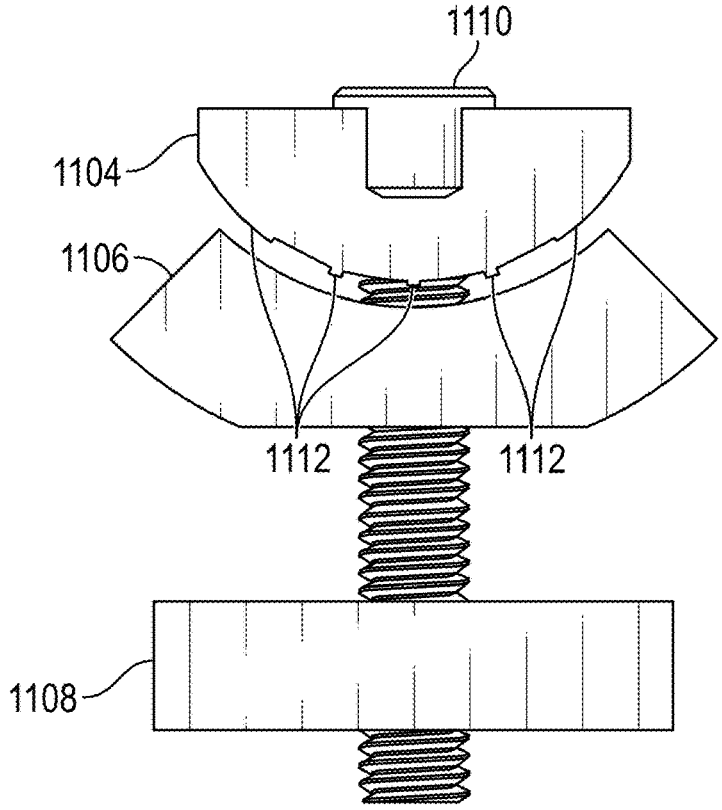
FIG. 20C is a front view illustration of the rounded belt clamp apparatus, according to some embodiments.
Figure 20D:
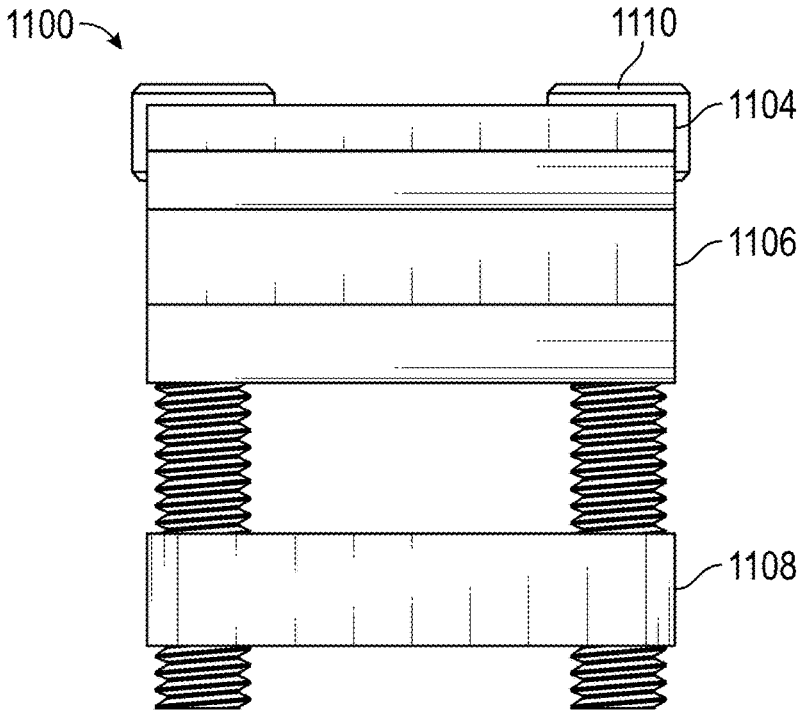
FIG. 20D is a left view illustration of the rounded belt clamp apparatus, according to some embodiments.
Figure 20E:
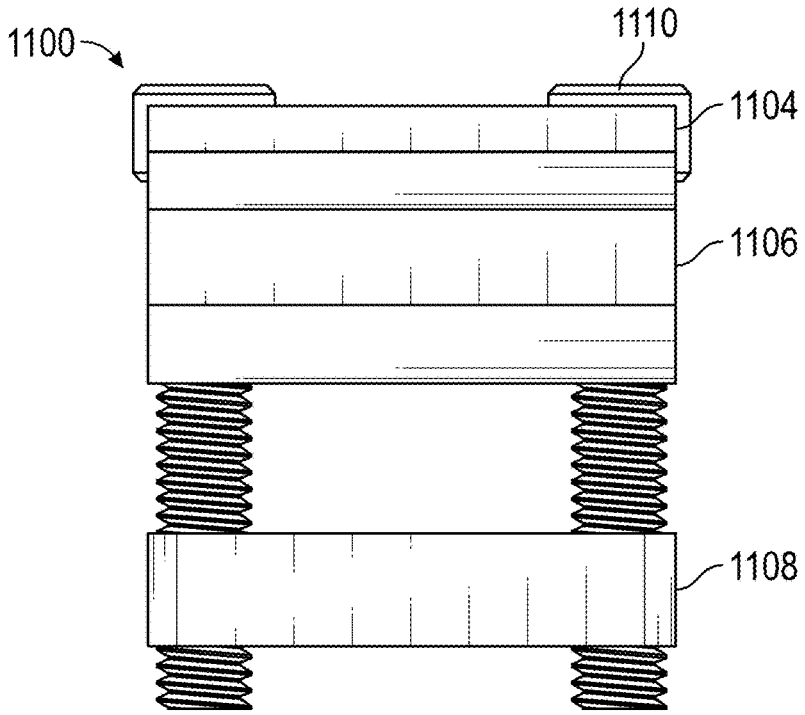
FIG. 20E is a right view illustration of the rounded belt clamp apparatus, according to some embodiments.
Figure 20F:
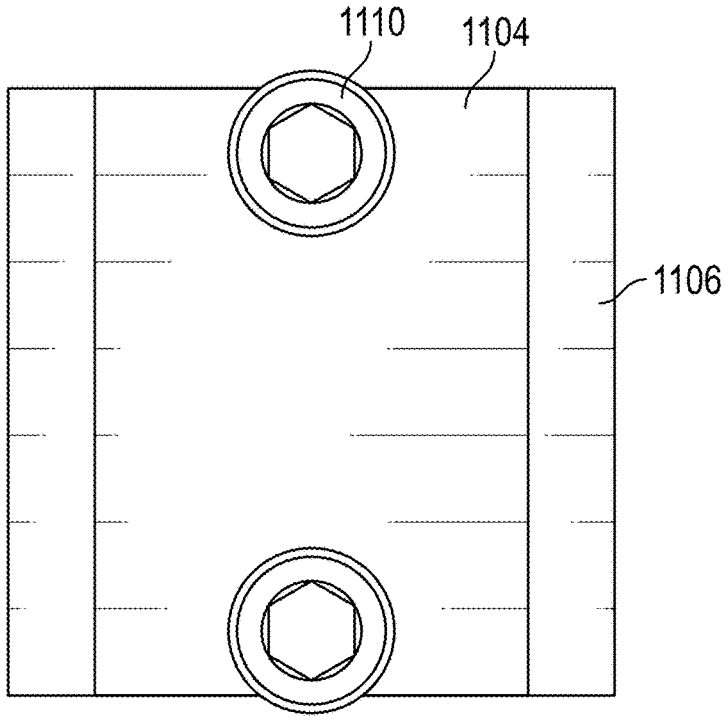
FIG. 20F is a top view illustration of the rounded belt clamp apparatus, according to some embodiments.
Figure 20G:
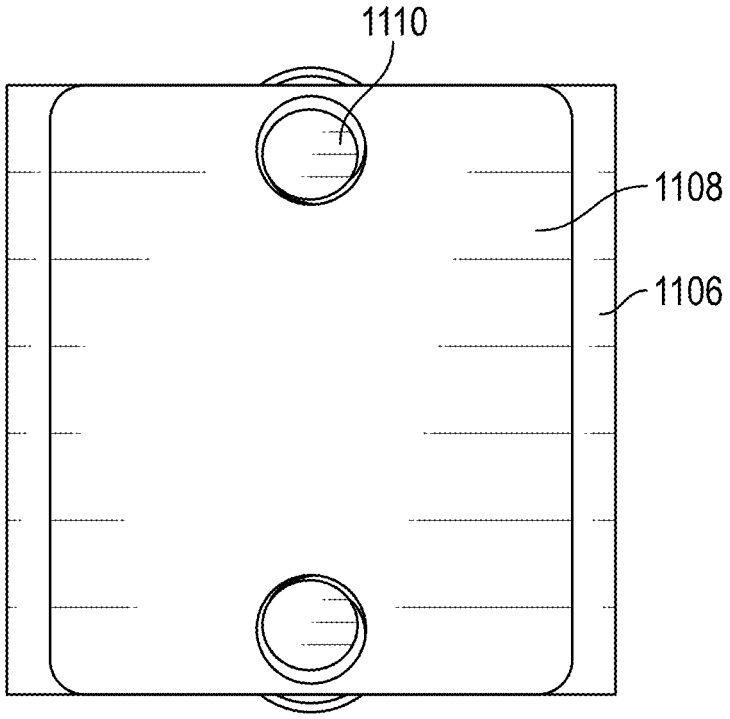
FIG. 20G is a bottom view illustration of the rounded belt clamp apparatus, according to some embodiments.

FIG. 20A is a perspective view of a rounded belt clamp apparatus 1100. FIG. 20B is a back view of the rounded belt clamp apparatus 1100. FIG. 20C is a front view of the rounded belt clamp apparatus 1100. FIG. 20D is a left side view of the rounded belt clamp apparatus 1100. FIG. 20E is a right side view of the rounded belt clamp apparatus 1100. FIG. 20F is a top view of the rounded belt clamp apparatus 1100. FIG. 20G is a bottom view of the rounded belt clamp apparatus 1100.

The rounded belt clamp apparatus 1100 includes a half round portion 1104, receiver portion 1106, clamp plate 1108, and two fasteners 1110.

The half round portion 1104 is shaped as a semicylinder which has a flat surface on a top side and a curved surface on a bottom side. Two holes traverse the surfaces and are positioned perpendicular to the flat surface. The holes are stepped so that a head of the two fasteners 1110 fits within. Each hole is positioned to intersect surfaces on opposing ends of the semicylinder. Thus, when inserted into the holes, the head of each fastener 1110 is partially exposed while a shank of each fastener is not. The curved surface includes five teeth 1112 which extend radially. In some embodiments, the number of teeth is more than 1 and less than 10. In some embodiments, the curved surface does not include teeth.

The receiver portion 1106 is arcuate in shape and has an upper surface which matches the curvature of the half round portion 1104 curved surface. In some embodiments, the upper surface of the receiver portion 1106 includes one or more teeth. The receiver portion 1106 has a lower surface which is flat and is parallel to the flat surface of the half round portion 1104. Separating the upper and lower surface are pointed edges. Two holes extend through the receiver portion 1106.

The clamp plate 1108 is shaped as a rectangular prism with rounded edges and positioned below the receiver portion 1106. Two threaded holes extend through the clamp plate 1108.

When assembled, the two fasteners 1110 extend through the holes of the half round portion 1104, receiver portion 1106, and threaded holes of the clamp plate 1108 thus attaching each piece together.

Figure 20H:
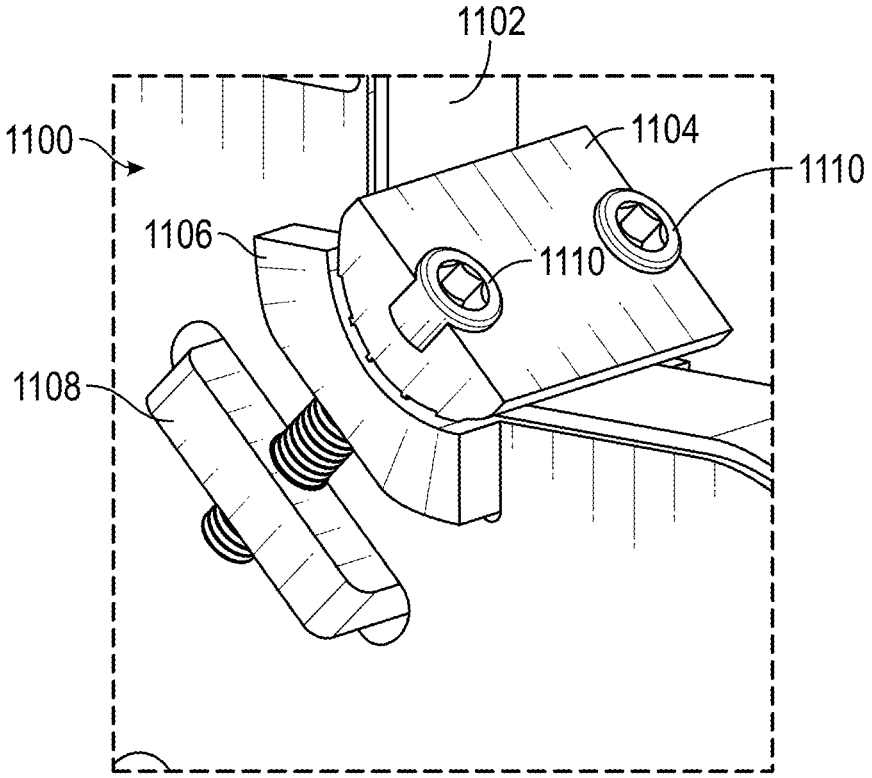
FIG. 20H is a close up perspective view illustration of the rounded belt clamp apparatus attached to the cam, according to some embodiments.

FIG. 20H is a perspective view of the rounded belt clamp apparatus 1100 attached to a cam 1000. During assembly, the clamp plate 1108 is inserted into a plate cutout 1012 of the cam 1000. The receiver portion 1106 is inserted into a receiver cutout 1008 of the cam 1000. A belt 1102 is positioned on the cam 1000 such that it lays flat against the curved surface of the receiver portion 1106. The half round portion 1104 is then placed on top of the belt 1102 thus clamping the belt between the half round portion 1104 and receiver portion 1106. Half round portion 1104, receiver portion 1106, and clamp plate 1108 are aligned such that the holes of each are concentric. The two fasteners 1110 are then inserted into the holes and tightened to secure the belt 1102 into place.

In certain embodiments, the clamp apparatus does not include the receiver portion 1106 and the clamp plate 1108. Rather, the half round portion is fastened directly to the cam 1000 to secure the belt.

Figure 21A:
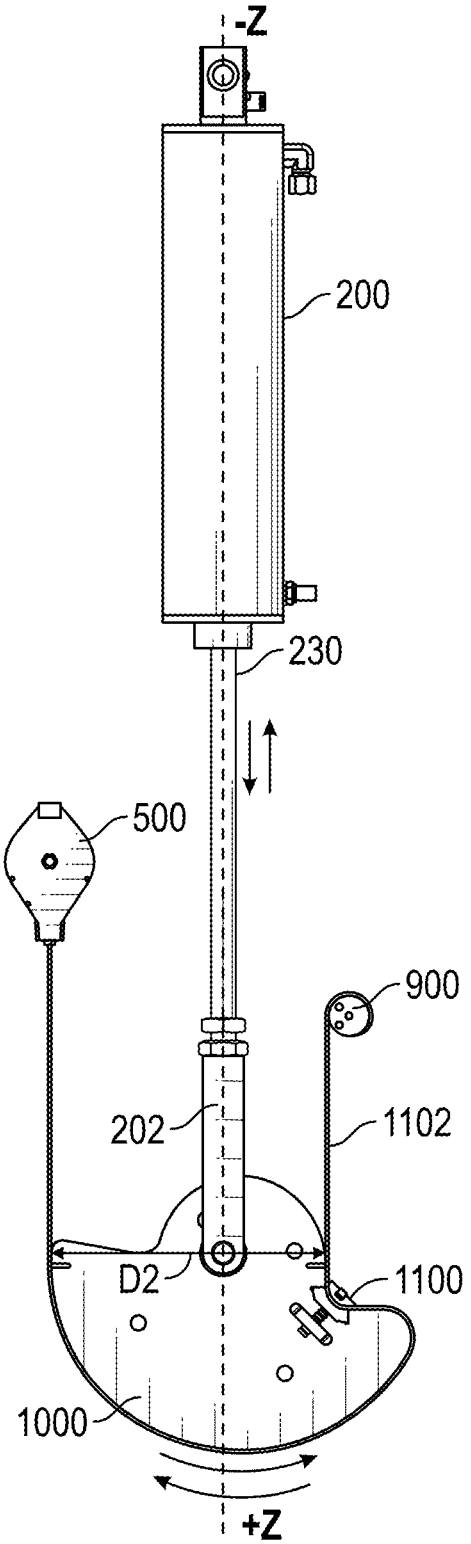
FIG. 21A is a back side view illustration of the coupling mechanism in a neutral position, according to some embodiments.
Figure 21B:
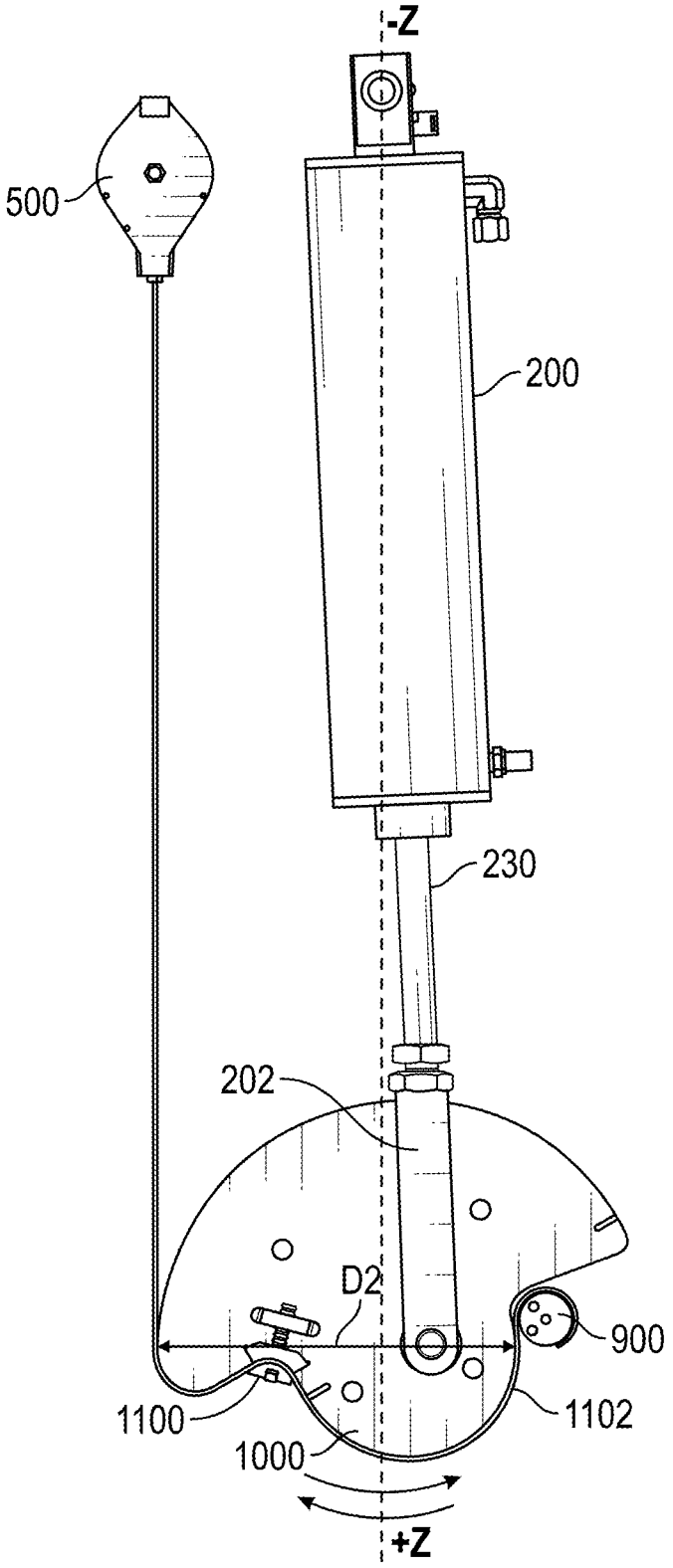
FIG. 21B is a back side view illustration of the coupling mechanism in a rotated position, according to some embodiments.

FIG. 21A shows the coupling mechanism 950 in a neutral position. FIG. 21B shows the coupling mechanism 950 in a rotated position.

In the neutral position, the resistance source 200, rod 230, clevis 202, and aperture of a cam 1000 align substantially with the z-axis. As force is applied to the lower pulley assembly 500 via a user cable attached to the pulley wheels (not shown), the lower pulley assembly 500 moves in the-z direction parallel to the z-axis. As a result, the cam 1000 rotates in a clockwise direction and about the aperture (i.e. rotational axis, axis of rotation) or attachment point with the clevis 202. Additionally, the cam 1000, clevis 202, and rod 230 move in a-z direction toward the resistance source 200. As this movement happens, the nonuniform curvature of the inside and outside surfaces causes the resistance source 200 to rotate about an attachment point (i.e. second axis) with a housing which causes the cam 1000 to move out of alignment with the z-axis. The curvature of an outside and inside surface of the cam 1000 is designed to accommodate this movement and ensure that the force vectors acting along the belt 1102 and between the lower pulley assembly 500 and cam 1000, and belt lock 900 and cam 1000, remain vertical.

As the force on the lower pulley assembly 500 is relaxed, the lower pulley assembly 800 moves vertically in the +z direction back to the position in FIG. 16A. Similarly, the cam 1000 moves in the +z direction, rotates counterclockwise, and moves back into alignment with the z-axis as the resistance source 200 rotates about the attachment point with the housing.

The curvature of the surfaces of the cam 1000 are such that a distance D2 between the portion of the belt 1102 tangentially extending from the cam 1000 to the pulley 500 and the portion of the belt 1102 tangentially extending from the cam 1000 to the belt lock 900 remains constant as the cam 1000 rotates. For example, as the radius of the outer diameter increases the radius of the inner diameter decreases. Distance D2 can further be expressed as the horizontal distance between parallel portions of belt 1102.

As disclosed herein, each cam (i.e. FIGS. 7A-7C, FIGS. 13A-13E, FIGS. 19A-19E) rotates about an axis of rotation or aperture. Each cam may rotate about this axis to different degrees depending on the unique shape of each cam and the positioning of the cables/belts that attach to each cam. In some embodiments, the cam rotates 90 degrees or less. In some embodiments, the cam rotates more than 90 degrees and less than 180 degrees. In some embodiments, the cam rotates more than 180 degrees and less than 270 degrees. In some embodiments, the cam rotates more than 270 degrees and less than 360 degrees. In some embodiments, the cam rotates 360 degrees.

As disclosed herein, each coupling mechanism may be implemented on any of the exercise apparatus or exercise equipment described in the incorporated references. In some embodiments, each coupling mechanism may optionally include a pulley assembly and/or block and tackle pulley system. In some embodiments, the belts or cables may be attached directly to or coupled with the handles or arms of the exercise apparatus. Additional or alternative pulleys may be needed to direct the cables or belts to the handles or arms.

Each component of the coupling mechanism may be composed of one or more materials including polymer, plastic, composite, carbon fiber, or metal. In some embodiments, the cam is composed of plastic or aluminum. In some embodiments, the belt lock is composed of aluminum.

While certain embodiments have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products. For example, any of the components for a coupling mechanism described herein can be provided separately, or integrated together (e.g., packaged together, or attached together) to form a coupling mechanism.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount, depending on the desired function or desired result.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

The headings provided herein, if any, are for convenience only and do not necessarily affect the scope or meaning of the devices and methods disclosed herein.

What is claimed is:

1. A coupling mechanism for an exercise apparatus, the coupling mechanism comprising:
- a resistance source rotatably coupled with a housing;
- a rod coupled to the resistance source;
- a clevis coupled to the rod;
- a cam rotatably coupled to the clevis about an axis, the cam comprising:
  - a curved outside surface having a first channel; and
  - a curved inside surface having a second channel and a third channel;
- a first cable, wherein one end of the first cable is coupled to one or more resistance engagements and another end of the cable is connected to the cam; and
- a second cable and a third cable coupled to the housing on one end and the cam on another end.

2. The coupling mechanism of claim 1, further comprising a cable key which couples the first, second, and third cables to the cam.

3. The coupling mechanism of claim 1, wherein the curved outside surface is larger than the curved inside surface.

4. The coupling mechanism of claim 1, wherein a curvature of the curved inside surface and a curvature of the curved outside surface are noncontinuous.

5. The coupling mechanism of claim 1, wherein the axis is nonconcentric with the curved inside surface and the curved outside surface.

6. The coupling mechanism of claim 1, wherein the axis is positioned off center of the cam.

7. The coupling mechanism of claim 1, wherein a distance between the axis of rotation and the curved outside surface is larger than a distance between the axis of rotation and the curved inside surface.

8. The coupling mechanism of claim 1, wherein a horizontal distance between the first cable and the second and third cables remains constant as the cam rotates around the axis, rotates about a coupling of the resistance source and housing, and moves toward the resistance source.

9. The coupling mechanism of claim 8, wherein the curved outside surface and first channel pass between the second and third cables as the cam rotates and moves.

10. The coupling mechanism of claim 8, wherein a force exerted on the first cable remains constant as the cam rotates and moves.

11. The coupling mechanism of claim 8, wherein the cables remain oriented vertically as the cam rotates and moves.

12. The coupling mechanism of claim 1, wherein the first cable is positioned within the first channel and wrapped around the curved outside surface of the cam when the cam is in a neutral position.

13. The coupling mechanism of claim 1, wherein the second cable and the third cable are positioned within the second channel and the third channel, respectively, and wrapped around the curved inside surface of the cam when the cam is in a rotated position.

14. The coupling mechanism of claim 1, further comprising a pulley assembly coupling the first cable to the one or more resistance engagements.

15. A coupling mechanism for an exercise apparatus, the coupling mechanism comprising:

a resistance source rotatably coupled with a housing;

a rod coupled to the resistance source and configured to oscillate in a linear direction;

a clevis coupled to the rod;

a cam rotatably coupled to the clevis about an axis, the cam comprising:

a curved outside surface; and a curved inside surface positioned opposite the curved outside surface;

one or more tension members coupled to the cam and disposed on the curved outside surface, wherein a first portion of the one or more tension members extends away from the cam tangentially adjacent to the curved outside surface, wherein a second portion of the one or more tension members extends away from the cam tangentially adjacent to the curved inside surface; and an anchor attached to the housing and coupled to the second portion of the one or more tension members; and a movable resistance engagement coupled to the first portion of the one or more tension members.

16. The coupling mechanism of claim 15, wherein a curvature of the curved inside surface and a curvature of the curved outside surface are noncontinuous.

17. The coupling mechanism of claim 15, wherein the axis is nonconcentric with the curved inside surface and the curved outside surface.

18. The coupling mechanism of claim 15, wherein the axis is positioned off center of the cam.

19. The coupling mechanism of claim 15, wherein a distance between the axis of rotation and the curved outside surface is larger, on average, than a distance between the axis of rotation and the curved inside surface.

20. The coupling mechanism of claim 15, wherein a horizontal distance between the first and second portions of the one or more tension members extending tangentially adjacent from the cam remains constant as the cam rotates around the axis, rotates about a coupling of the resistance source and housing, and moves toward the resistance source.

21. The coupling mechanism of claim 20, wherein the first and second portions of the one or more tension members are oriented parallel to one another.

22. The coupling mechanism of claim 21, wherein the first and second portions of the one or more tension members do not change orientation as the cam rotates and moves.

23. The coupling mechanism of claim 22, wherein the first and second portions of the one or more tension members are oriented vertically.

24. The coupling mechanism of claim 20, wherein a force exerted on the first portion of the one or more tension members does not change as the cam rotates and moves.

25. The coupling mechanism of claim 15, further comprising a pulley assembly coupling the first portion of the one or more tension members to the movable resistance engagement.

26. The coupling mechanism of claim 15, wherein the one or more tension members comprises a first belt or cable.

27. The coupling mechanism of claim 26, wherein the first belt is fixed to the cam between the curved inside surface and curved outside surface.

28. The coupling mechanism of claim 27, further comprising a second belt, wherein the first belt is fixed to the cam and a pulley assembly, and wherein the first belt is partially disposed on the curved outside surface of the cam.

29. The coupling mechanism of claim 28, wherein the second belt is fixed to the cam and the anchor, and wherein the second belt is partially disposed on the curved inside surface of the cam.

* * * * *